US005190846A

United States Patent [19]

Yagihara et al.

[11] Patent Number: 5,190,846

[45] Date of Patent: Mar. 2, 1993

[54] SILVER HALIDE PHOTOGRAPHIC MATERIAL

[75] Inventors: Morio Yagihara; Hisashi Okamura; Kazunobu Katoh, all of Kanagawa, Japan

[73] Assignee: Fuji Photo Film Co., Ltd., Kanagawa, Japan

[21] Appl. No.: 614,181

[22] Filed: Nov. 13, 1990

[30] Foreign Application Priority Data

Nov. 16, 1989 [JP] Japan ..... 1-298140

[51] Int. Cl.[5] ..... G03C 5/54; G03C 1/42; G03C 1/06; G03C 1/34

[52] U.S. Cl. ..... 450/264; 430/223; 430/517; 430/544; 430/559; 430/564; 430/566; 430/598; 430/611; 430/613; 430/614; 430/955; 430/957; 430/959

[58] Field of Search ..... 430/223, 264, 955, 957, 430/959, 544, 598, 564, 566, 559, 611, 613, 614, 517

[56] References Cited

U.S. PATENT DOCUMENTS 4,770,990 9/1988 Nakamura et al. ..... 430/223
4,971,888 11/1990 Okada et al. ..... 430/264
5,085,971 2/1992 Katoh et al. ..... 430/957

*Primary Examiner*—Richard L. Schilling
*Attorney, Agent, or Firm*—Sughrue, Mion, Zinn, Macpeak & Seas

[57] ABSTRACT

A silver halide photographic material comprising a support having thereon at least one light-sensitive silver halide emulsion layer, wherein the silver halide photographic material contains at least one photographic agent represented by the following formula (I):

(I)

wherein X represents a hydrogen atom or a group capable of forming a hydrogen atom upon hydrolysis; Time represents a divalent linking group; PUG represents a photographically useful group; V represents wherein $R_0$ represents n alkoxy group or an aryloxy group, an iminomethylene group or $R_1$ represents a hydrogen atom, an aliphatic group, an aromatic group, a heterocyclic group, an alkoxy group, an aryloxy group, an amino group or $—CHR_2—(Time)_m—PUG$; $R_2$ represents a hydrogen atom, an aliphatic group, an aromatic group or a heterocyclic group; m represents 0 or 1; and n represents 0 or 1. The redox compound represented by formula (I) has excellent preservability and rapidly releases a photographically useful agent.

25 Claims, No Drawings

SILVER HALIDE PHOTOGRAPHIC MATERIAL

FIELD OF THE INVENTION

The present invention relates to a silver halide photographic material, and more particularly, to a silver halide photographic material containing a compound which is capable of releasing silver imagewise (hereinafter simply referred to as imagewise) a photographically useful group during development processing.

BACKGROUND OF THE INVENTION

Improvement in the performance of a photographic image is greatly improved upon imagewise release of a photographically useful reagent simultaneously with the formation of the silver image is known. For instance, DIR couplers in the field of color photographic light-sensitive materials are examples. DIR couplers function to improve graininess of the color image, improve sharpness due to an edge effect and improve color reproducibility due to the diffusion of an inhibitor into other layers by release of a developing inhibitor upon coupling with an oxidation product of a color developing agent at development. DIR couplers are described in detail, for example, in U.S. Pat. Nos. 3,227,554 and 4,248,962, JP-B-58-9942 (the term "JP-B" as used herein means an "examined Japanese patent publication"), JP-B-51-16141, JP-A-52-90932 (the term "JP-A" as used herein means an "unexamined published Japanese patent application"), JP-A-56-114946, JP-A-57-154234, JP-A-58-188035, JP-A-57-151944 and JP-A-58-217932.

Also, recently an improvement in the graininess of the color image or an increase in sensitivity can be achieved by using couplers capable of releasing a competing compound, a development accelerator or a fogging agent upon coupling with an oxidation product of a color developing agent as described, for example, in British Patent 1,546,837, U.S. Pat. No. 3,408,194, JP-A-57-138636, JP-A-57-150845, JP-A-59-50439 and JP-A-59-170840.

Further, colored couplers having an azo dye moiety as a releasing group are employed for the purpose of improving color reproducibility by a masking effect. More specifically, azo dyes released imagewise in the image areas upon coupling with an oxidation product of a color developing agent leach into a processing solution and are removed, and in consequence, colored couplers having an azo dye remain in the non-image areas, as described in detail, for example, in JP-A-51-26034, JP-A-51-110328, U.S. Pat. No. 4,004,929, are British patent 1,443,875 and 1,464,361.

As described above, functional couplers capable of releasing a photographically useful reagent markedly contribute to an improvement in the image quality of the color image and sensitivity. However, these functional couplers have a fundamental defect in that they can not be utilized in the field of photography wherein a color developing agent is not employed, for example, black-and-white photography and diffusion transfer photography, because they release a photographically useful reagent upon coupling with an oxidation product of a color developing agent. Further, they have another problem in that azomethine dyes formed adversely affect the color reproducibility of color image. In this respect, non-color forming DIR couplers as described for example, in JP-A-49-77635 and JP-A-50-20725 and dye runaway type couplers as described, for example, in JP-A-59-168444 have been proposed. However, problems, which arise because they have a low coupling activity and because they cause severe contamination of a processing solution, are not yet solved.

In order to solve the problems of these functional couplers, redox compounds capable of releasing a photographically useful reagent irrespect of a kind of developing agent have been eagerly sought, but they are still insufficient. More specifically, DIR hydroquinones as described, for example, in JP-A-49-129536, U.S. Pat. Nos. 3,379,529, 3,620,746, 4,322,878 and 4,377,634, DIR aminophenols as described, for example, in JP-A-52-57828, p-nitrobenzyl derivative as described, for example, in European Patent 45,129, hydrazine derivatives as described, for example, in U.S. Pat. No. 4,684,604, and redox compounds having at least one carbonyl group as described, for example, in JP A-61-213847 are known. However, these compounds have problems because some of them only have a low releasing speed for the photographically useful reagent and because those having a high releasing speed are unstable during storage. Thus, improvement has been desired.

On the other hand, in the photomechanical process field, development of a photographic light-sensitive material having good reproducibility of the original has been required in order to cope with the diversity and complexity of printed materials. A method using a redox compound as described, for example, in JP-A-61-213847 is known, but the method is still insufficient since dot gradation is elongated.

In order to solve this problem, a method using a hydroxamic acid derivative as described in Japanese Patent Application No. 63-98803 has been proposed. Although some improvement has been made, still a further increase in a release speed of photographically useful reagent and improvement in preservability thereof are still required in order to particularly fulfill the requirement of reducing the pH of a developing solution for the purpose of increasing processing stability or further shortening a processing time.

SUMMARY OF THE INVENTION

Therefore, an object of the present invention is to provide a novel redox compound capable of releasing a photographically useful reagent irrespective of the kind of developing agent used.

Another object of the present invention is to provide a novel redox compound which has excellent storage stability and a high releasing speed of a photographically useful reagent.

A further object of the present invention is to provide a silver halide photographic material having improved image quality.

A still further object of the present invention is to provide a silver halide photographic material with high sensitivity.

An even further object of the present invention is to provide a silver halide photographic material of ultra-high contrast (particularly a $\gamma$ of 10 or more).

Other objects of the present invention will become apparent from the following detailed description and examples.

These objects of the present invention are accomplished by a silver halide photographic material comprising a support having thereon at least one light-sensitive silver halide emulsion layer, wherein the silver halide photographic material contains at least one photographic agent represented by the following formula (I):

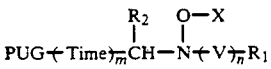

(I)

wherein X represents a hydrogen atom or a group capable of forming a hydrogen atom upon hydrolysis; Time represents a divalent linking group; PUG represents a photographically useful group; V represents

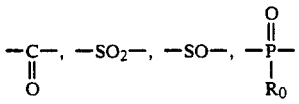

(wherein $R_0$ represents an alkoxy group or an aryloxy group),

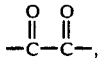

an iminomethylene group or

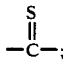

$R_1$ represents a hydrogen atom, an aliphatic group, an aromatic group, a heterocyclic group, an alkoxy group, an aryloxy group, an amino group or —CH-$R_2$—(Time)$_m$PUG; $R_2$ represents a hydrogen atom, an aliphatic group, an aromatic group or a heterocyclic group; m represents 0 or 1; and n represents 0 or 1.

DETAILED DESCRIPTION OF THE INVENTION

The compound represented by formula (I) according to the present invention is explained in greater detail below.

In formula (I), the group capable of forming a hydrogen atom upon hydrolysis includes those known as blocking groups for photographic agents. Specific examples thereof include blocking groups such as acyl groups and sulfonyl groups as disclosed in JP-B-48-9968, JP-A-52-8828, JP-A-57-82834, U.S. Pat. No. 3,311,476 and JP-B-47-44805 (U.S. Pat. No. 3,615,617); blocking groups which release a photographically useful agent by means of a reverse Michael reaction as disclosed in JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175), JP-A-59-105642 and JP-A-59-105640; blocking groups which release a photographically useful agent with the formation of a quinonemethide or a quinonemethide-like compound by an intramolecular electron transfer as disclosed in JP-B-54-39727, U.S. Pat. Nos. 3,674,478, 3,932,480 and 3,993,661, JP-A-57-135944, JP-A-57-135945 and JP-A-57-136640; those in which an intramolecular ring closing reaction occurs as disclosed in JP-A-55-53330 and JP-A-59-218439; those in which a ring opening of a five-membered or six-membered ring occurs as disclosed in JP-A-57-76541 (U.S. Pat. No. 4,335,200), JP-A-57-135949, JP-A-57-179842, JP-A-59-137945, JP-A-59-219741 and JP-A-60-41034; blocking groups which release photographically useful agents by a Michael reaction as disclosed in JP-A-59-201057, JP-A-61-43739, JP-A-61-95346 and JP-A-61-95347; and blocking groups such as an imidomethyl group as disclosed in JP-A57-158638. The disclosure of each of the above patent documents is hereby incorporated by reference.

In formula (I), Time represents a divalent linking group and may have a timing control function. m represents 0 or 1, and when m is 0, PUG is directly connected to the moiety

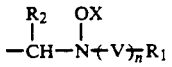

in the compound represented by formula (I).

The divalent linking group represented by Time is a group capable of releasing PUG through one or more reaction stages from Time-PUG which has been released from an oxidation product of the oxidation-reduction mother nucleus. Time is connected to the moiety

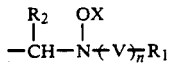

in the compound represented by formula (I) through a nitrogen atom included therein.

The divalent linking groups represented by Time include, for example, those capable of releasing a photographically useful group (hereinafter simply referred to as "PUG") in an intramolecular ring-closing reaction of a p-nitrophenoxy derivative as described, for example, in U.S. Pat. No. 4,248,962 (JP-A-54-145135); those capable of releasing PUG in an intramolecular ring closing reaction after the ring cleavage as described, for example, in U.S. Pat. Nos. 4,310,612 (JP-A-55-53330) and 4,358,525; those capable of releasing PUG accompanied by the formation of an acid anhydride in an intramolecular ring closing reaction of a carboxy group of succinic acid mono-ester or analoque thereof as described, for example, in U.S. Pat. Nos. 4,330,617, 4,446,216 and 4,483,919 and JP-A-59-121328; those capable of releasing PUG accompanied by the formation of quinonemonomethane or analogue thereof upon electron transfer via the conjugated double bonds of an aryloxy group or a heterocyclic oxy group as described, for example, in U.S. Pat. Nos. 4,409,323 and 4,421,845, *Research Disclosure,* No, 21228 (December, 1981), U.S. Pat. No. 4,416,977 (JP-A-57-135944), JP-A-58-209736 and JP-A-58-209738; those capable of releasing PUG from the γ-position of enamine upon electron transfer in an enamine structure moiety of a nitrogen-containing hetero ring as described, for example, in U.S. Pat. No. 4,420,554 (JP-A-57-136640), JP-A-57-135945, JP-A-57-188035, JP-A-58-98728 and JP-A-58-209737; those capable of releasing PUG in an intramolecular ring-closing reaction of an oxy group formed by electron transfer to a carbonyl group which is conjugated with a nitrogen atom in a nitrogen-containing hetero ring as described, for example, in JP-A-57-56837; those capable of releasing PUG accompanied by the formation of an aldehyde as described, for example, in U.S. Pat. No. 4,146,396 (JP-A-52-90932), JP-A-59-93442 and JP-A-59-75475; those capable of releasing PUG accompanied by a decarboxylation of a carboxy group as described, for example, in JP-A-51-146828, JP-A-57-179842 and JP-A-59-104641; those capable of releasing PUG from a structure —O—COOCR$_a$R$_b$—PUG accompanied by decarboxylation and the subsequent formation of an aldehyde; those capable of releasing PUG accompanied by the formation of an isocyanate as described, for example, in JP-A-60-7429; and those capable of releasing PUG upon coupling with an oxidation product of a color developing agent as described, for example, in U.S. Pat. No. 4,438,193. The disclosures of these patent documents are each herein incorporated by reference.

Specific examples of the divalent linking groups represented by Time are described in detail, for example, in JP-A-61-236549 and JP-A-1-269936, each of which is incorporated herein by reference.

Preferred specific examples of divalent linking groups are set forth below, wherein the symbol (*) denotes the position at which the moiety

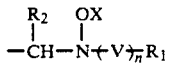

is bonded, and a symbol (**) denotes the position at which PUG is bonded.

T-(1)

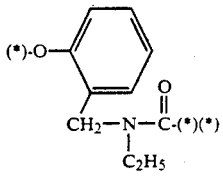

T-(2)

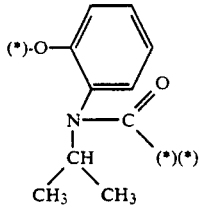

T-(3)

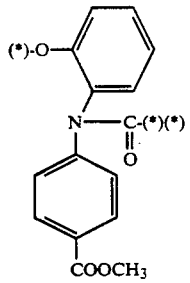

T-(4)

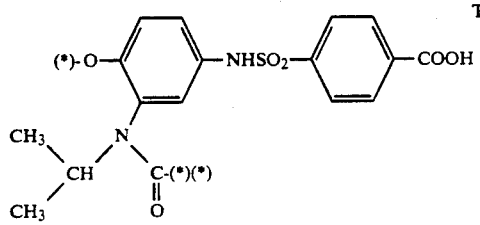

-continued (T)-5

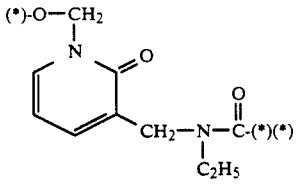

T-(6)

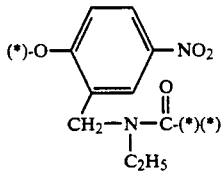

T-(7)

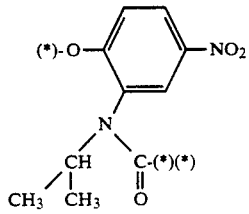

T-(8)

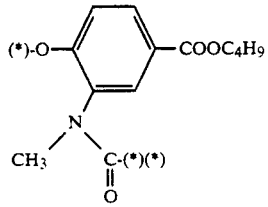

T-(9)

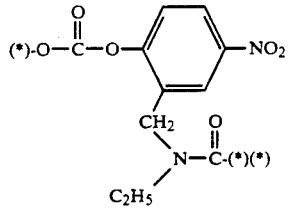

T-(10)

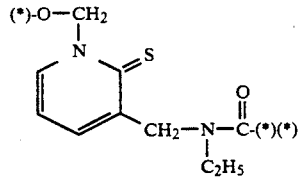

T-(11)

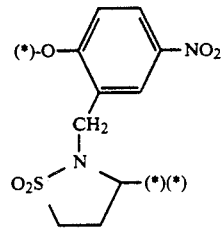

-continued
T-(12)
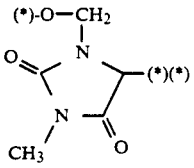
T-(13)
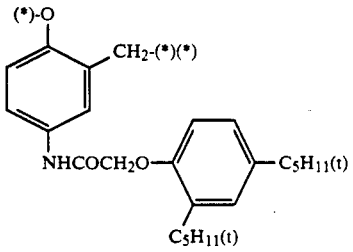
T-(14)
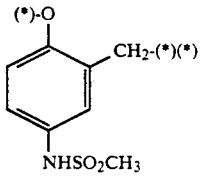
T-(15)
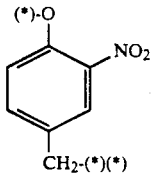
T-(16)
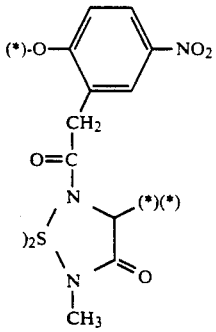
T-(17)
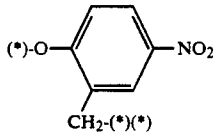
T-(18)
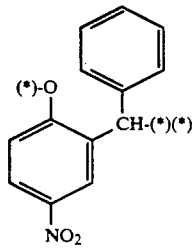
-continued
T-(19)
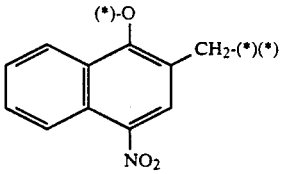
T-(20)
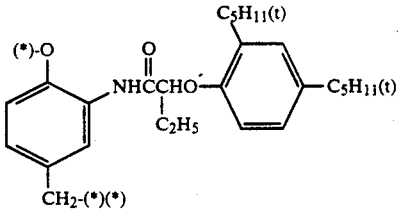
T-(21)
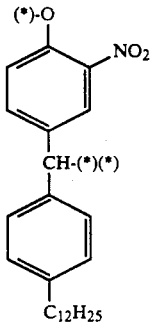
T-(22)
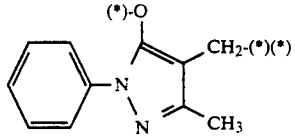
T-(23)
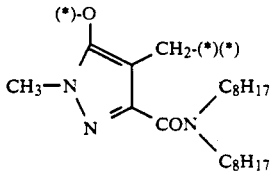
T-(24)
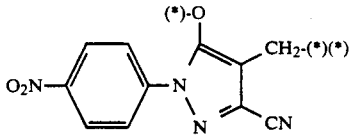
T-(25)
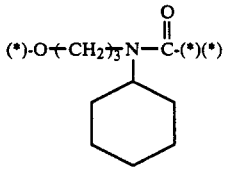
T-(26)
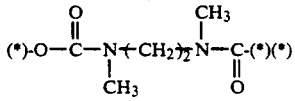
T-(27)
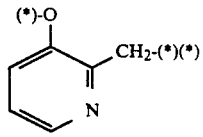

-continued

T-(28)

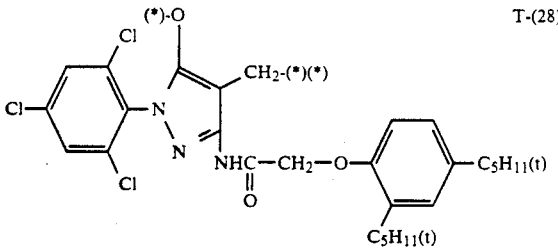

T-(29)

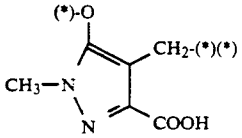

T-(30)

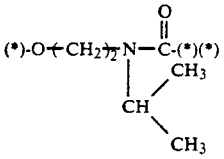

T-(31)

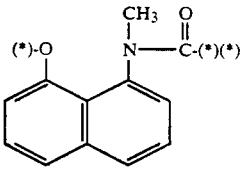

T-(32)

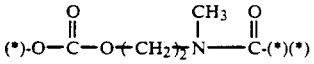

T-(33)

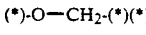

T-(34)

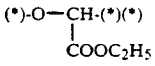

T-(35)

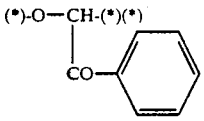

T-(36)

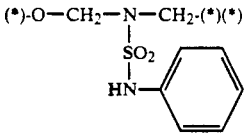

T-(37)

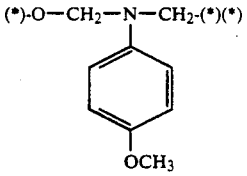

T-(38)

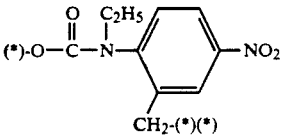

-continued

T-(39)

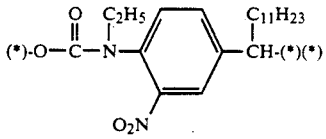

T-(40)

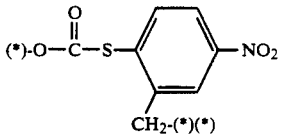

T-(41)

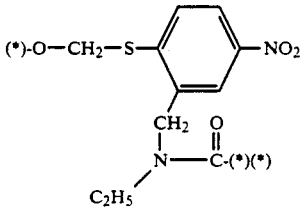

T-(42)

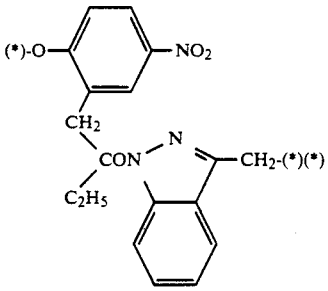

PUG in formula (I) represents a photographically useful group as $(\text{Time})_m$PUG or PUG. PUG is connected to the moiety

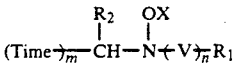

in the compound represented by formula (I) through a hetero atom present therein.

Examples of the photographically useful groups include development inhibitors, development accelerators, fogging agents, couplers, coupler releasing couplers, diffusible or nondiffusible dyes, desilvering accelerators, desilvering inhibitors, silver halide solvents, competing compounds, developing agents, auxiliary developing agents, fixing accelerators, fixing inhibitors, image stabilizers, color toning agents, processing-dependency improving agents, dot improving agents, color image stabilizers, photographic dyes, surfactants, hardening agents, ultraviolet light absorbing agents, fluorescent whitening agents, desensitizing agents, contrast increasing agents, chelating agents, and precursors thereof.

These photographically useful groups often overlap in terms of specific utility and typical examples are described in more specific terms below.

When PUG is a development inhibitor, it can be a known development inhibitor which has a hetero atom and it is bonded via a hetero atom. Examples of these inhibitors are described, for example, in C. E. K. Mees and T. H. James, *The Theory of the Photographic Process*, Third Edition, pages 344 to 346 (Macmillan, 1966).

Suitable examples of development inhibitors include compounds having a mercapto group attached to a hetero ring, such as substituted or unsubstituted mercaptoazoles (specifically, 1-phenyl-5-mercaptotetrazole, 1-(4-carboxyphenyl)-5-mercaptotetrazole, 1-(3-hydroxyphenyl)-5-mercaptotetrazole, 1-(4-sulfophenyl)-5-mercaptotetrazole, 1-(3-sulfophenyl)-5-mercaptotetrazole, 1-(4-sulfamoylphenyl)-5-mercaptotetrazole, 1-(3-hexanoylaminophenyl)-5-mercaptotetrazole, 1-ethyl-5-mercaptotetrazole, 1-(2-carboxyethyl)-5-mercaptotetrazole, 2-methylthio-5-mercapto-1,3,4-thiadiazole, 2-(2-carboxyethylthio)-5-mercapto-1,3,4-thiadiazole, 3-methyl-4-phenyl-5-mercapto-1,2,4-triazole, 2-(2-dimethylaminoethylthio)-5-mercapto-1,3,4-thiadiazole, 1-(4-n-hexylcarbamoylphenyl)-2-mercaptoimidazole, 3-acetylamino-4-methyl-5-mercapto-1,2,4-triazole, 2-mercaptobenzoxazole, 2-mercaptobenzimidazole, 2-mercaptobenzothiazole, 2-mercapto-6-nitro-1,3-benzoxazole, 1-(1-naphthyl)-5-mercaptotetrazole, 2-phenyl-5-mercapto-1,3,4-oxadiazole, 1-[3-(3-methylureido)-phenyl]-5-mercaptotetrazole, 1-(4-nitrophenyl)-5-mercaptotetrazole, and 5-(2-ethylhexanoylamino)-2-mercaptobenzimidazole), substituted or unsubstituted mercaptoazaindenes (specifically, 6-methyl-4-mercapto-1,3,3a,7-tetraazaindene, 6-methyl-2-benzyl-4-mercapto-1,3,3a,7-tetraazaindene, 6-phenyl-4-mercaptotetraazaindene, and 4,6-dimethyl-2-mercapto-1,3,3a,7-tetraazaindene), substituted or unsubstituted mercapto-pyrimidines (specifically, 2-mercaptopyrimidine, 2-mercapto-4-methyl-6-hydroxypyrimidine, and 2-mercapto-4-propylpyrimidine), heterocyclic compounds which are able to form iminosilver, such as substituted or unsubstituted benzotriazoles (specifically, benzotriazole, 5-nitrobenzotriazole, 5-methylbenzotriazole, 5,6-dichlorobenzotriazole, 5-bromobenzotriazole, 5-methoxybenzotriazole, 5-acetylaminobenzotriazole, 5-n-butylbenzotriazole, 5-nitro-6-chlorobenzotriazole, 5,6-dimethylbenzotriazole, and 4,5,6,7-tetrachlorobenzotriazole), substituted or unsubstituted indazoles (specifically, indazole, 5-nitroindazole, 3-nitro-indazole, 3-chloro-5-nitroindazole, 3-cyanoindazole, 3-n-butylcarbamoylindazole, and 5-nitro-3-methanesulfonylindazole), and substituted or unsubstituted benzimidazoles (specifically, 5-nitrobenzimidazole, 4-nitrobenzimidazole, 5,6-dichlorobenzimidazole, 5-cyano-6-chlorobenzimidazole and 5-trifluoromethyl-6-chlorobenzimidazole).

The development inhibitor may be a compound which has a development inhibiting function when released from the oxidation reduction mother nucleus of formula (I) upon a substitution reaction subsequent to an oxidation reduction reaction on development processing and is converted to a compound having a very low development inhibiting function or substantially no development inhibiting function.

This type of development inhibitor moiety whose development inhibiting function is changed can be represented by the following formula (II):

—AF—CCD (II)

The groups represented by AF formula (II) preferably include those represented by formula (P-1), (P-2), (P-3), (P-4) or (P-5) described below. In the formulae, the symbol(*)(*)(*) denotes the position of bonding to Time, and the position substituted with CCD is also indicated.

(P-1)

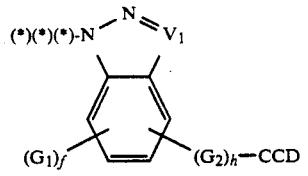

(P-2)

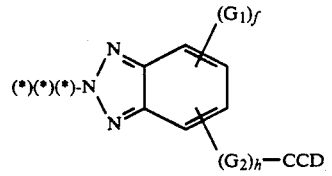

(P-3)

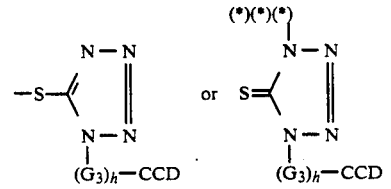

(P-4)

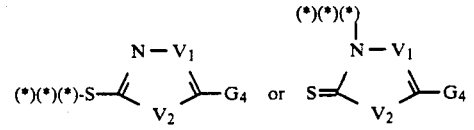

(P-5)

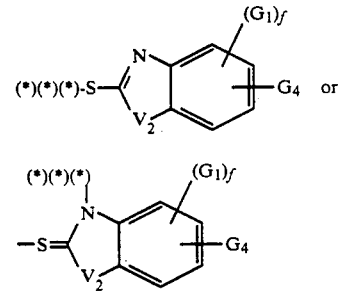

wherein $G_1$ represents a hydrogen atom, a halogen atom, an alkyl group (for example, methyl, ethyl), an acylamino group (for example, benzamido, hexanamido), an alkoxy group (for example, methoxy, benzyloxy), a sulfonamido group (for example, methanesulfonamido, benzenesulfonamido), an aryl group (for example, phenyl, 4-chlorophenyl), an alkylthio group (for example, methylthio, butylthio), an alkylamino group (for example, cyclohexylamino), an anilino group (for example, anilino, 4-methoxycarbonylanilino), an amino group, an alkoxycarbonyl group (for example, methoxycarbonyl, butoxycarbonyl), an acyloxy group (for example, acetyl, butanoyl, benzoyl), a nitro group, a cyano group, a sulfonyl group (for example, butanesulfonyl, benzenesulfonyl), an aryloxy group (for example, phenoxy, naphthyloxy), a hydroxy group, a thioamido group (for example, butanethioamido, benzenethiocarbonamido), a carbamoyl group (for example, carbamoyl, N-arylcarbamoyl), a sulfamoyl group (for example, sulfamoyl, N-arylsulfamoyl), a carboxy group, a ureido group (for example, ureido, N-ethylureido) or an aryloxycarbonyl group (for example, phenoxycarbonyl, 4-methoxyphenoxycarbonyl); $G_2$ represents a divalent group selected from the substituents defined for $G_1$ which can form a divalent group; $G_3$ represents a substituted or unsubstituted alkylene group or a substituted or unsubstituted arylene group, each of which may contain an ether bond, an ester bond, a thioether bond, an amido bond, a ureido bond, an imido bond, a sulfone group, a sulfonamido group, or a carbonyl group or a divalent group composed of two or more these bonding groups, alkylene groups and arylene groups; $V_1$ represents a nitrogen atom or a methine group; $V_2$ represents an oxygen atom, a sulfur atom,

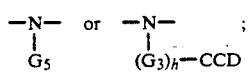

$G_4$ represents a substituent selected from those defined for $G_1$ or $-(G_3)_h-CCD$; $G_5$ represents a hydrogen atom, an alkyl group (for example, methyl, ethyl) or an aryl group (for example, phenyl, naphthyl); f represents an integer of 1 or 2, when f is 2, the two $G_1$'s may be the same or different; and h represents 0 or 1, provided in that at least one of the groups represented by $V_2$ and $G_4$ in formulae (P-4) and (P-5) is a group containing CCD.

When the groups represented by $G_1$, $G_2$, $G_3$, $G_4$ or $G_5$ in formula (P 1), (P-2), (P-3), (P-4) or (P-5) contain alkyl moieties, they may be substituted or unsubstituted, straight chain, branched chain or cyclic, saturated or unsaturated alkyl groups and may contain from 1 to 22 carbon atoms, preferably from 1 to 10 carbon atoms. Further, when the groups represented by $G_1$, $G_2$, $G_3$, $G_4$ or $G_5$ contain aryl moieties, they may be substituted and contain from 6 to 10 carbon atoms, and are preferably substituted or unsubstituted phenyl groups.

The groups represented by CCD in formula (II) preferably include those represented by formula (D-1) to (D-16) described below.

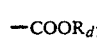

(D-1)

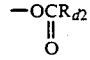

(D-2)

wherein $R_{d1}$ and $Rd_{d2}$ each represents a substituted or unsubstituted alkyl group (preferably having from 1 to 10 carbon atoms, for example, methyl, ethyl, 2,3-dichloropropyl, 2,2,3,3,-tetrafluoropropyl, butoxycarbonylmethyl, cyclohexylaminocarbonylmethyl, methoxyethyl, or propargyl), a substituted or unsubstituted aryl group (preferably having from 6 to 10 carbon atoms, for example, phenyl, 3,4-methyleneoxyphenyl, p-methoxyphenyl, p-cyanophenyl, or m-nitrophenyl) or a substituted or unsubstituted aralkyl group (preferably having from 7 to 12 carbon atoms, for example, benzyl, or p-nitrobenzyl).

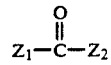

(D-3)

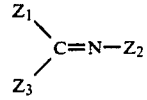

(D-4)

-continued

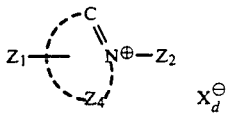

(D-5)

wherein $Z_1$ and $Z_2$ each represents a bond to AF, a hydrogen atom, an alkylamino group (for example, $CH_3-NH-$, or

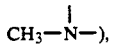

an alkyl group (for example, methyl, propyl, methoxymethyl, or benzyl), an aryl group (for example, phenyl, 4-chlorophenyl, naphthyl, 4-methoxyphenyl, or 4-butanamidophenyl), an acylamido group wherein the nitrogen atom may be substituted (for example, acetamido, or benzamido), or a 4-membered, 5-membered, 6-membered or 7-membered substituted or unsubstituted heterocyclic group containing at least one hetero atom selected from a nitrogen atom, a sulfur atom and an oxygen atom (for example, 2-pyridyl, 2-pyrrolidinyl, 4-imidazolyl, or 3-chloro-5-pyrazolyl); $Z_3$ represents a hydrogen atom, a halogen atom, an alkyl group (for example, methyl, or propyl), an aryl group (for example, phenyl, 4-chlorophenyl, or naphthyl), a 4-membered, 5-membered, 6-membered or 7-membered heterocyclic group containing at least one hetero atom selected from a nitrogen atom, a sulfur atom and an oxygen atom (for example, 2-pyridyl, or 2-pyrrolidinyl), an alkoxy group (for example, methoxy, or butoxy), an acyl group (for example, acetyl, or benzoyl), a carbamoyl group wherein the nitrogen atom may be substituted (for example, N-butylcarbamoyl, or N-phenylcarbamoyl), a sulfamoyl group wherein the nitrogen atom may be substituted (for example, N-phenylsulfamoyl), a sulfonyl group (for example, propanesulfonyl, or benzenesulfonyl), an alkoxycarbonyl group (for example, ethoxycarbonyl), an acylamino group (for example, acetamido, or benzamido), a sulfonamido group (for example, benzenesulfonamido), an alkylthio group (for example, butylthio), or a ureido group wherein the nitrogen atom may be substituted (for example, 3-phenylureido, or 3-butylureido), or $Z_1$ and $Z_3$ may combine with each other to form a ring; $Z_4$ represents an atomic group necessary to form a 5-membered or 6-membered unsaturated hetero ring, wherein the atoms are selected from a carbon atom, a hydrogen atom, a nitrogen atom, an oxygen atom and a sulfur atom; and $X_d^{\ominus}$ represents an organic sulfonic acid anion, an organic carboxylic acid anion, a halogen ion, or an inorganic anion (for example, tetrafluoroborate).

Suitable examples of hetero rings formed with $Z_4$ include those represented by the following formulae, wherein $Z_1$ is bonded to a position which can be substituted.

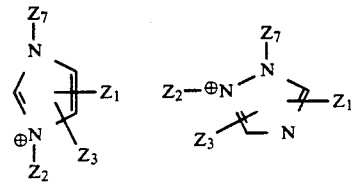

-continued

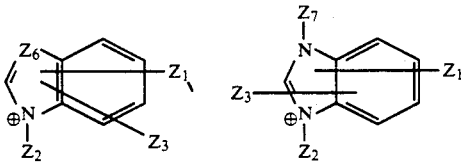

wherein $Z_7$ has the same meaning as defined for $Z_1$ or $Z_2$ above; and $Z_6$ represents an oxygen atom or a sulfur atom.

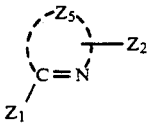

(D-6)

wherein $Z_1$ and $Z_2$ each has the same meaning as defined above; $Z_5$ represents an atomic group necessary to form a 5-membered, 6-membered or 7-membered ring together with

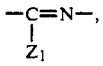

wherein the atoms are selected from a carbon atom, an oxygen atom, and a nitrogen atom which do not result in the ring formed with

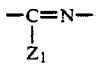

being aromatic in nature, preferably an alkylene group which may be substituted (for example, $-(CH_2)_4-$), an alkenylene group which may be substituted (for example, $-CH_2-CH=CH-CH_2-$, or

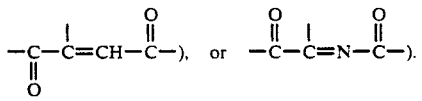

In formula (D-3), (D-4), (D-5) or (D-6), when the group represented by $Z_1$, $Z_2$, $Z_3$ or $Z_4$ contains an alkyl moiety, it may be any of a substituted or unsubstituted, straight chain, branched chain or cyclic, saturated or unsaturated alkyl group and contains from 1 to 16 carbon atoms, preferably from 1 to 10 carbon atoms. Further, when the group represented by $Z_1$, $Z_2$, $Z_3$ or $Z_7$ contains an aryl moiety, it may be substituted and contains from 6 to 10 carbon atoms, and is preferably a substituted or unsubstituted phenyl group.

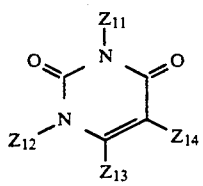

(D-7)

-continued

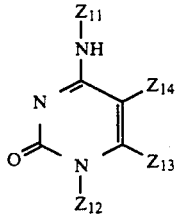

(D-8)

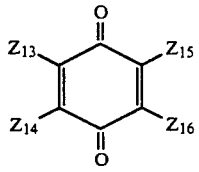

(D-9)

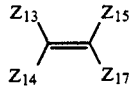

(D-10)

wherein at least one of $Z_{11}$ to $Z_{17}$ is an AF group as described above or a group containing an AF group; $Z_{11}$ and $Z_{12}$ each represents a hydrogen atom, an alkyl group, an aryl group or an AF group; $Z_{13}$, $Z_{14}$, $Z_{15}$ and $Z_{16}$ each represents a hydrogen atom, an alkyl group, an aryl group, a halogen atom (for example, chlorine), an alkoxy group (for example, methoxy, or butoxy), an aryloxy group (for example, phenoxy, or p-carboxyphenoxy), an arylthio group (for example, phenylthio), an alkylthio group (for example, methylthio, butylthio), an alkoxycarbonyl group (for example, ethoxycarbonyl, octyloxycarbonyl), an aryloxycarbonyl group (for example, phenoxycarbonyl), an alkanesulfonyl group (for example, methanesulfonyl), a sulfamoyl group (for example, sulfamoyl, methylsulfamoyl), a carbamoyl group (for example, carbamoyl, N-phenylcarbamoyl), a ureido group (for example, N-methylureido), an acyl group (for example, acetyl, benzoyl), an acylamino group (for example, acetamido, or benzamido), an arylsulfonyl group (for example, benzenesulfonyl), a 5-membered or 6-membered heterocyclic group containing at least one hetero atom selected from a nitrogen atom, an oxygen atom and a sulfur atom (for example, imidazolyl, 1,2,4-triazolyl, thiadiazolyl, or oxadiazolyl), an acyloxy group (for example, acetyloxy), a nitro group, a cyano group, a carboxy group, a thiocarbamoyl group (for example, phenylthiocarbamoyl), a sulfamoylamino group (for example, N-phenylsulfamoylamino), a diacylamino group (for example, diacetylamino), an allylidenamino group (for example, benzylidenamino), or an AF group; $Z_{17}$ represents a halogen atom, an alkoxycarbonyl group, an aryloxycarbonyl group, an alkanesulfonyl group, a sulfamoyl group, a carbamoyl group, an acyl group, a diacylamino group, an arylsulfonyl group, a heterocyclic group, a nitro group, a cyano group, a carboxy group or a sulfonamido group.

Of the groups defined for $Z_{17}$ above, those capable of forming divalent groups may have the AF group at one end thereof. Specific examples of the groups defined for Z include those illustrated for $Z_{13}$ to $Z_{16}$ above.

In formula (D-7), (D-8), (D-9) or (D-10), when the group represented by $Z_{11}$, $Z_{12}$, $Z_{13}$, $Z_{14}$, $Z_{15}$, $Z_{16}$ or $Z_{17}$ contains an alkyl moiety, it may be any of substituted or unsubstituted, straight chain, branched chain or cyclic, saturated or unsaturated alkyl group and contains from 1 to 16 carbon atoms, preferably from 1 to 8 carbon atoms. Further, when the group represented by $Z_{11}$, $Z_{12}$, $Z_{13}$, $Z_{14}$, $Z_{15}$, $Z_{16}$ or $Z_{17}$ contains an aryl moiety, it may be substituted and contains from 6 to 10 carbon atoms, and is preferably a substituted or unsubstituted phenyl group.

In formula (D-9), $Z_{15}$ and $Z_{16}$ each may form a divalent group and combine with each other to form a ring (for example, benzene).

In formula (D-10), $Z_{15}$ and $Z_{17}$ each may form a divalent group and combine with each other to form a ring (for example, benzothiazolidene).

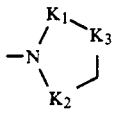
(D-11)

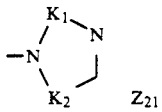
(D-12)

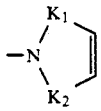
(D-13)

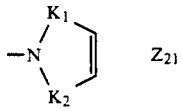
(D-14)

wherein $Z_{21}$ represents an atomic group necessary to form a 6-membered saturated or unsaturated ring; $K_1$ and $K_2$ each represents an electron withdrawing group (for example,

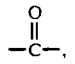

—$SO_2$—); and $K_3$ represents

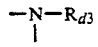

(wherein $R_{d3}$ represents an alkyl group preferably having 6 or less carbon atoms).

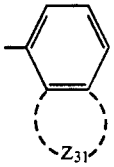
(D-15)

-continued

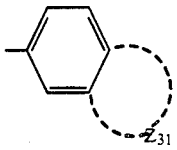
(D-16)

wherein $Z_{31}$ represents an atomic group necessary to form a 5-membered or 6-membered lactone ring or a 5-membered imido ring.

The groups represented by formula (D-15) or (D-16) are employed only when h is 0 in formula (P-1), (P-2), (P-3), (P-4) or (P-5) described above.

Specific examples of PUG represented by formula (II) include 1-(3-phenoxycarbonylphenyl)-5-mercaptotetrazole, 1-(4-phenoxycarbonylphenyl)-5-mercaptotetrazole, 1-(3-maleimidophenyl)-5-mercaptotetrazole, 5-(phenoxycarbonyl)benzotriazole, 5-(p-cyanophenoxycarbonyl)benzotriazole, 2-phenoxycarboylmethylthio-5-mercapto-1,3,4-thiadiazole, 5-nitro-3-phenoxycarbonylindazole, 5-phenoxycarbonyl-2-mercaptobenzimidazole, 5-(2,3-dichloropropyloxycarbonyl)benzotriazole, 5-benzyloxycarbonylbenzotriazole, 5-(butylcarbamoylmethoxycarbonyl)benzotriazole, 5-(butoxycarbonylmethoxycarbonyl)benzotriazole, 1-(4-benzoyloxyphenyl)-5-mercaptotetrazole, 5-(2-methanesulfonyletoxycarbonyl)-2-mercaptobenzothiazole, 1-[4-(2-chloroethoxycarbonyl)phenyl]-2-mercaptoimidazole, 2-{3-[thiophen-2-yl-carbonyl]-propyl}thio-5-mercapto-1,3,4-thiadiazole, 5-cinnamoylaminobenzotriazole, 1-(3-vinylcarbonylphenyl)-5-mercaptotetrazole, 5-succinimidomethylbenzotriazole, 2-(4-succinimidophenyl)-5-mercapto-1,3,4-oxadiazole, 3-[4-(benzo-1,2-isothiazole-3-oxo-1,1-dioxo-2-yl)phenyl]-5-mercapto-4-methyl-1,2,4-triazole and 6-phenoxycarbonyl-2-mercaptobenzoxazole.

When PUG is a diffusible or non-diffusible dye, examples of suitable dyes include the compounds described in *Kokino Photochemicals-Kozokino to Oyotenbo,* pages 197 to 211 (CMC, 1985). Specific examples of dyes include arylidene-type dyes, styryl-type dyes, butadiene-type dyes, oxonol-type dyes, cyanine-type dyes, merocyanine-type dyes, hemicyanine-type dyes, stilbene-type dyes, chalcone-type dyes, coumarin-type dyes, azo dyes, azomethine dyes, azopyrazolone dyes, indaniline-type dyes, indophenol-type dyes, anthraquinone-type dyes, triarylmethane-type dyes, diarylmethane-type dyes, alizarin-type dyes, nitro-type dyes, quinoline-type dyes, indigo-type dyes and phthalocyanine-type dyes. In addition, leuco-forms of these dyes, dyes with a temporarily shifted absorption wavelength as well as dye precursors such as tetrazolium salts. Further, these dyes may form chelated dyes with appropriate metals. These types of dyes are described, for example, in U.S. Pat. Nos. 3,880,658, 3,931,144, 3,932,380, 3,932,381 and 3,942,987.

Specific examples of dyes generally employed in the present invention are set forth below.

Dye-1
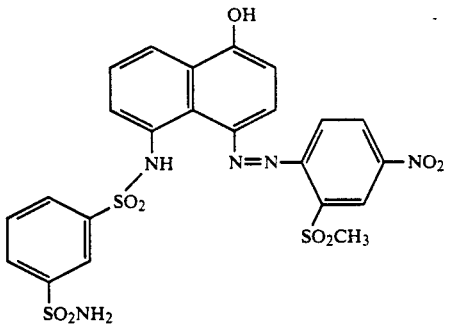
Dye-2
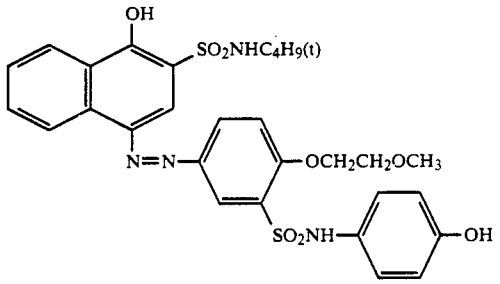
Dye-3
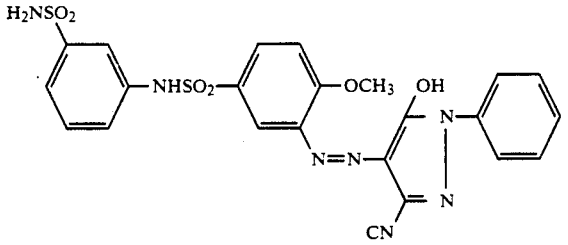
Dye-4
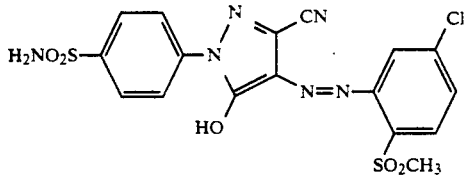
Dye-5
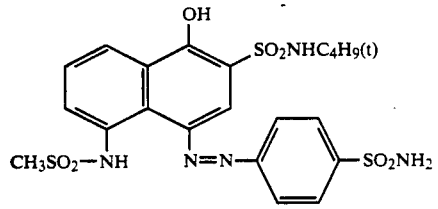
Dye-6
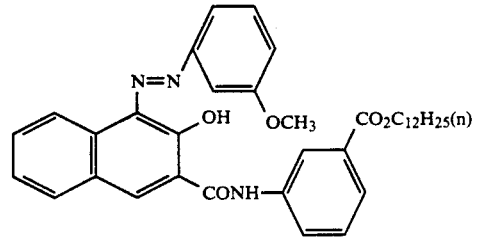

-continued
Dye-7
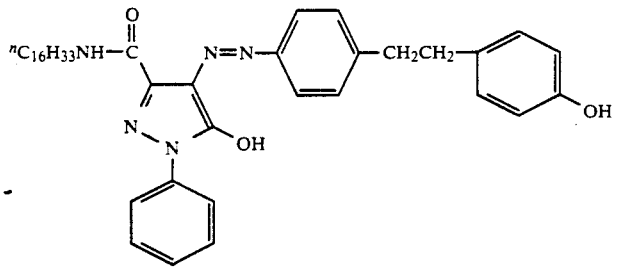
Dye-8
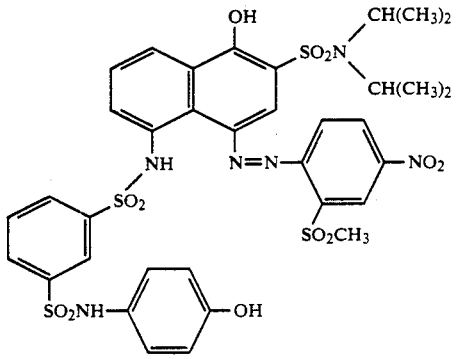
Dye-9
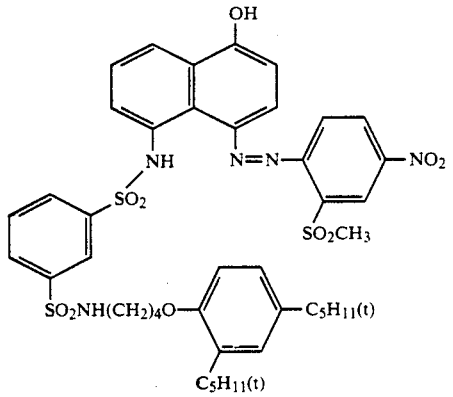
Dye-10
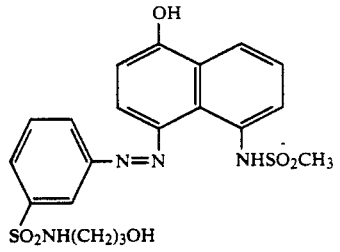
Dye-11
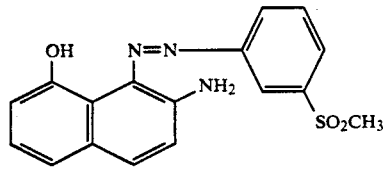
Dye-12
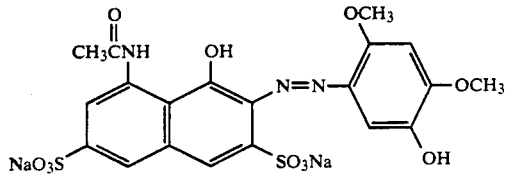

-continued
Dye-13
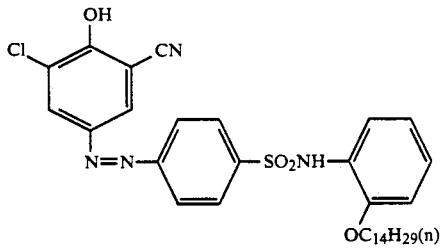
Dye-14
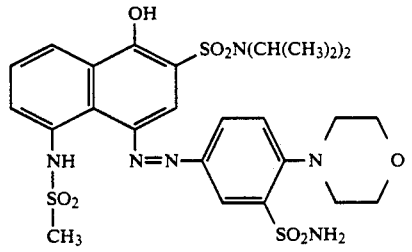
Dye-15
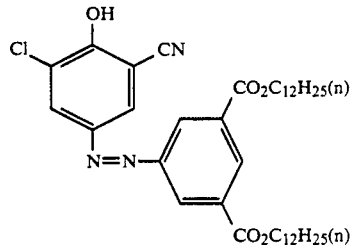
Dye-16
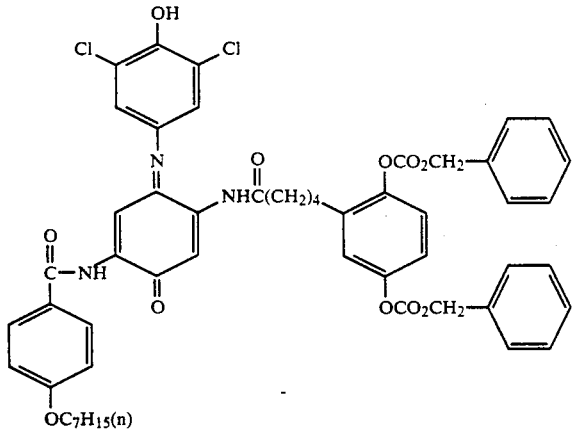
Dye-17
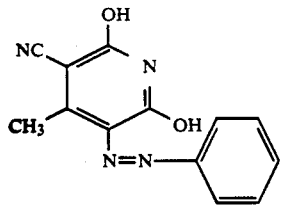
Dye-18
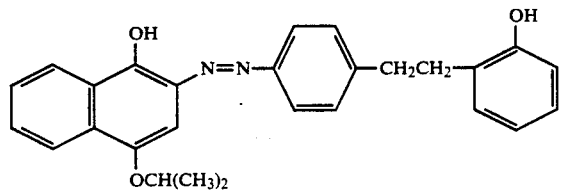

-continued
Dye-19
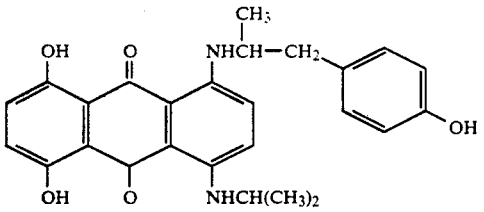
Dye-20
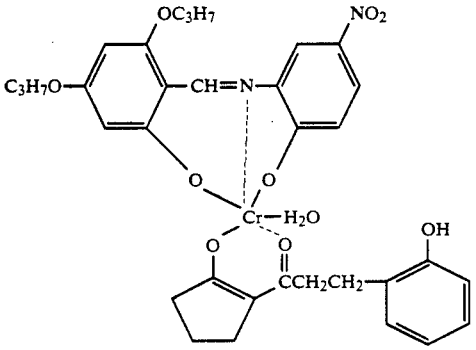
Dye-21
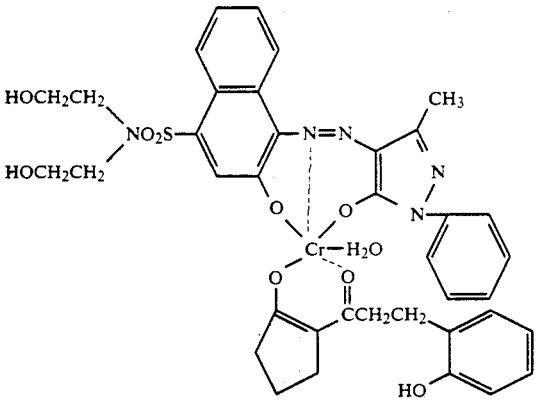
Dye-22
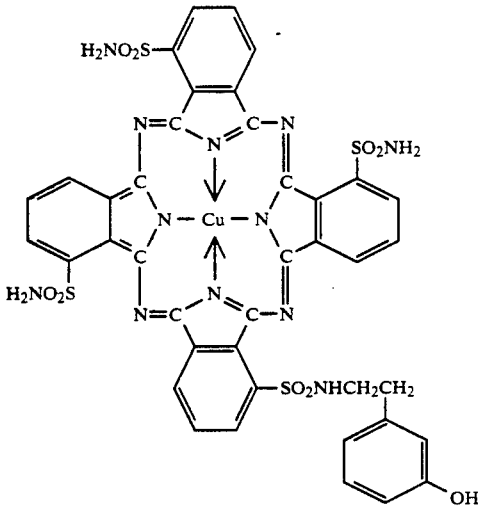

-continued
Dye-23
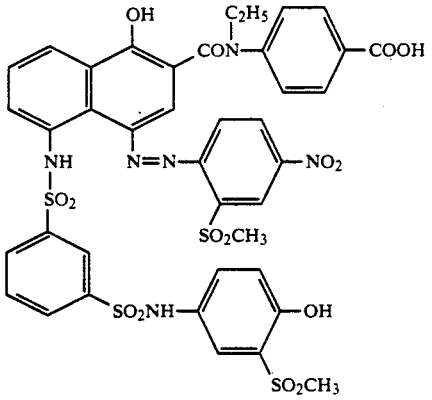
Dye-24
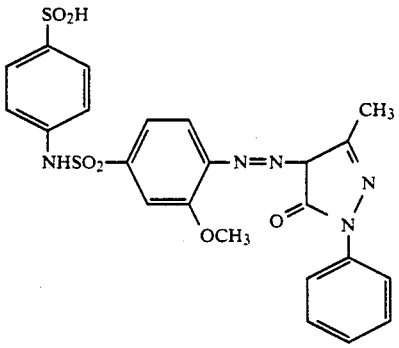
Dye-25
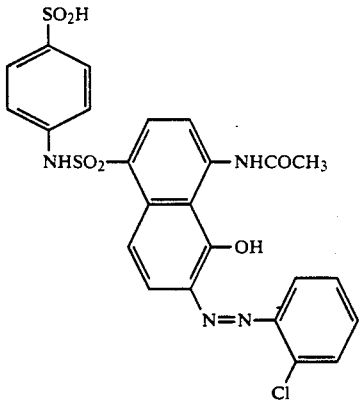
Dye-26
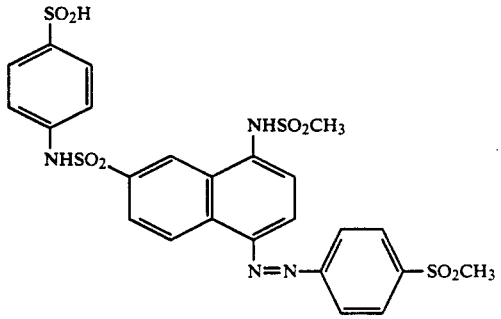

-continued
Dye-27
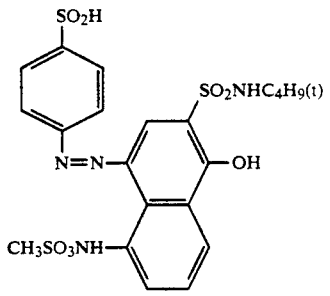
Dye-28
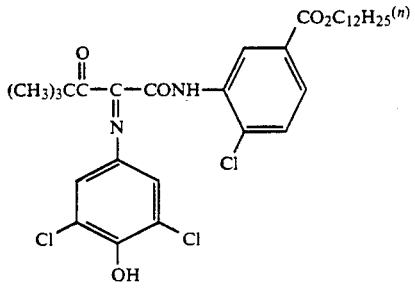
Dye-29
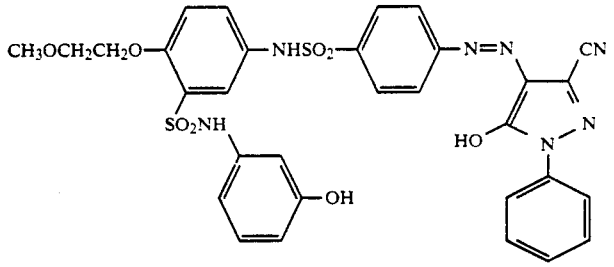
Dye-30
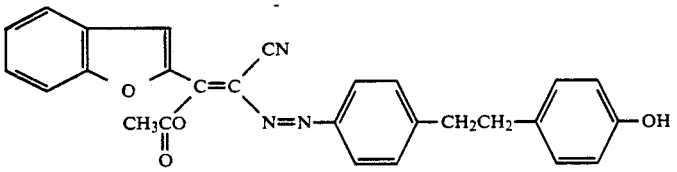
Dye-31
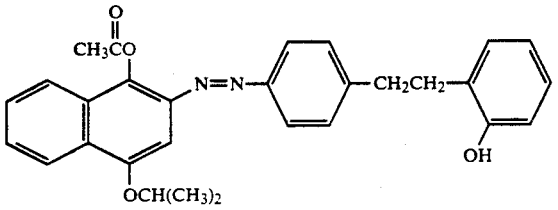

-continued
Dye-32
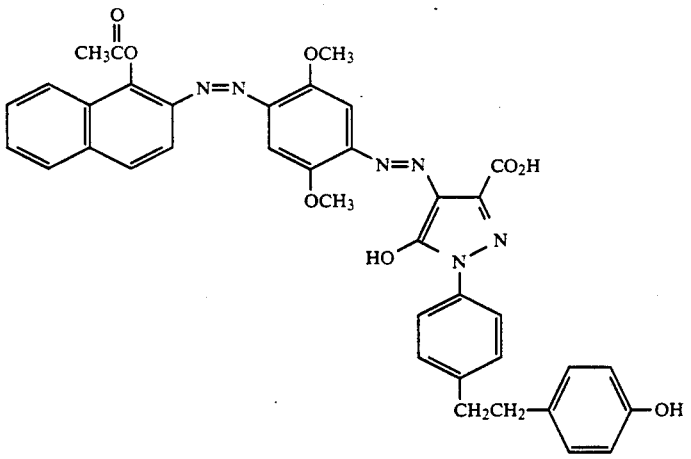
Dye-33
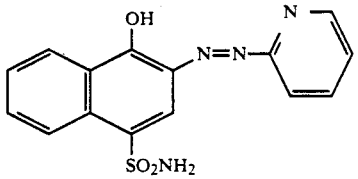
Dye-34
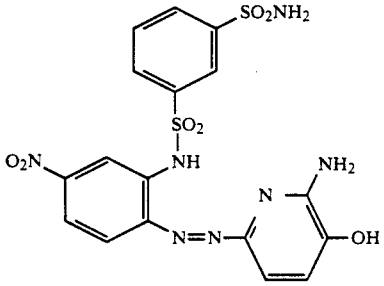
Dye-35
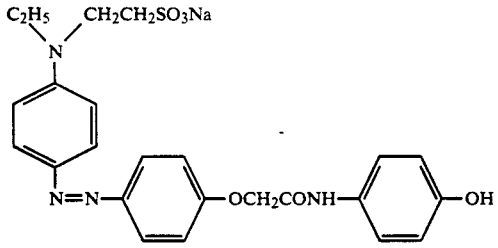
Dye-36
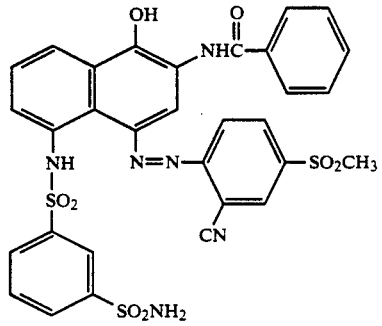

-continued
Dye-37
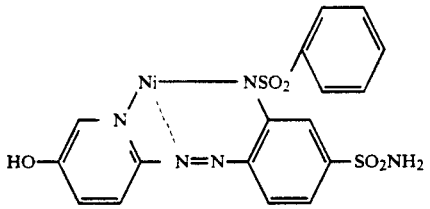
Dye-38
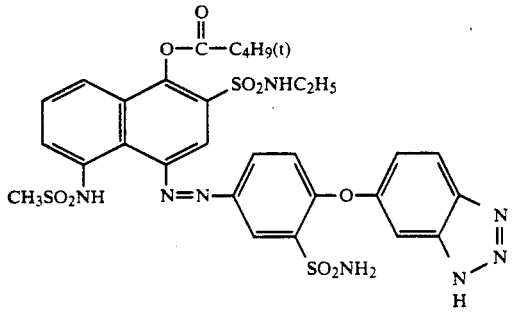
Dye-39
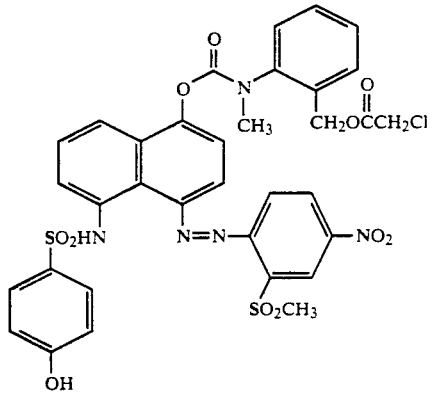
Dye-40
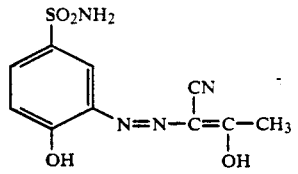
Dye-41
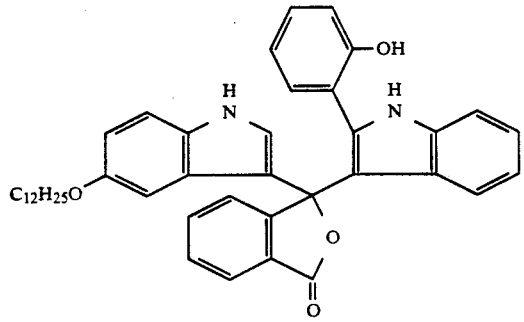

-continued

Dye-42

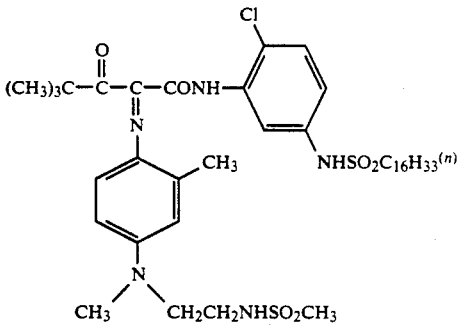

Dye-43

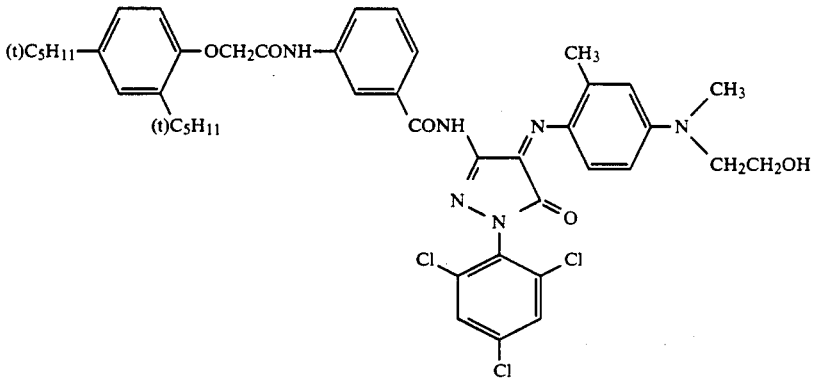

Dye-44

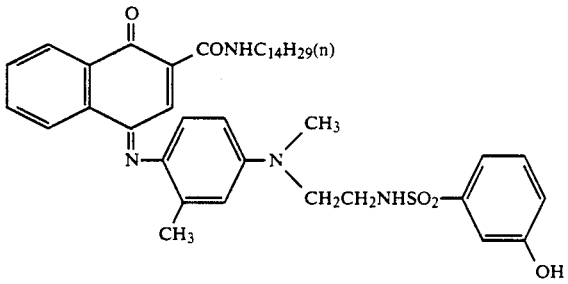

When PUG is a development accelerator, examples of suitable development accelerators include those represented by the following formula (III):

$$(*)(*)(*)—L_1-(L_2)_kA \qquad (III)$$

wherein the symbol (*)(*)(*) denotes the position of bonding to Time; $L_1$ represents a group which can be further released from the released Time during development processing; $L_2$ represents a divalent linking group; k represents an integer of 0 or 1; and A is a group which substantially exhibits a fogging action against a silver halide emulsion in a developing solution.

Preferred examples of $L_1$ include an aryloxy group, a heterocyclic oxy group, an arylthio group, an alkylthio group, a heterocyclic thio and an azolyl group.

Specific examples of $L_1$ are set forth below.

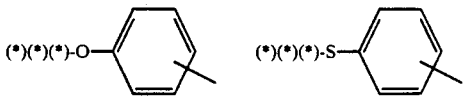

-continued

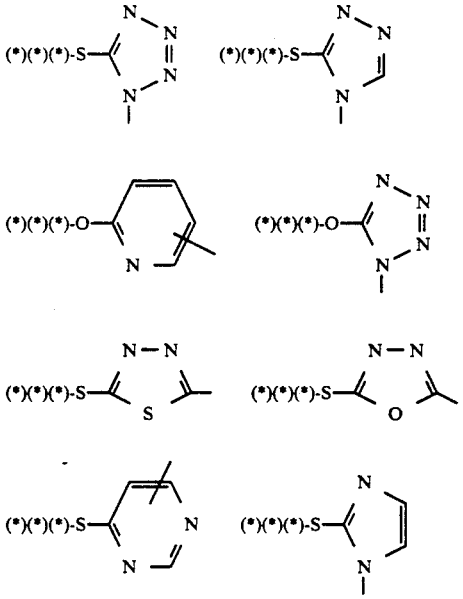

(*)(*)(*)-S—$(CH_2)_2$—, (*)(*)(*)-S—$(CH_2)_4$—,

-continued

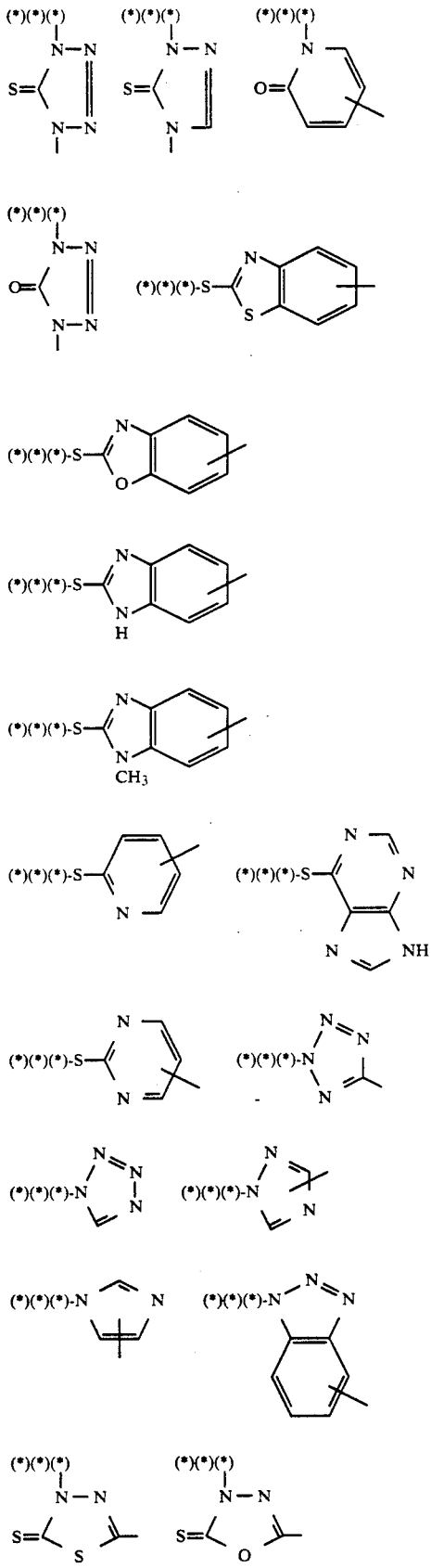

-continued

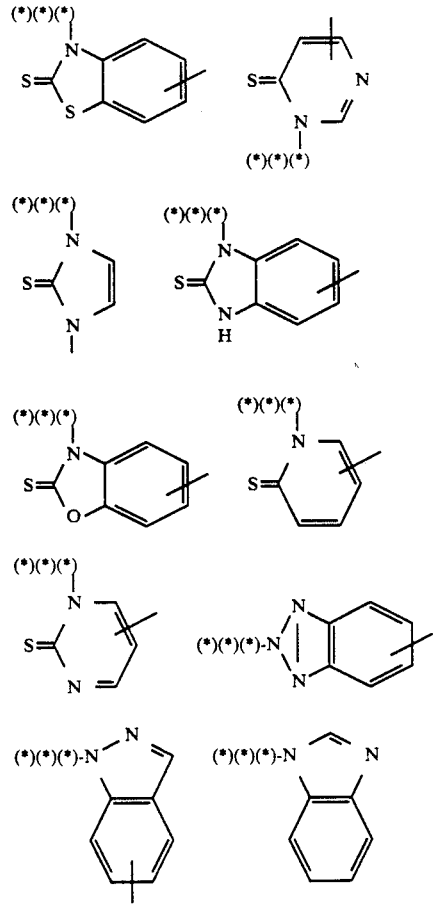

Suitable examples of $L_2$ include an alkylene group, an alkenylene group, an arylene group, a divalent heterocyclic group, —O—, —S—, an imino group, —COO—, CONH—, —NHCONH—, —NHCOO—, —$SO_2$NH—, —CO—, —$SO_2$—, —SO—, —NH-$SO_2$NH— and combinations of these groups.

Preferred examples of A include reducing groups (such as those having a partial structure of hydrazine, hydrazide, hydrazone, hydroxylamine, polyamine, enamine, hydroquinone, catechol, p-aminophenol, o-aminophenol, aldehyde or acetylene), groups capable of acting on silver halide during development to form a developable silver sulfide center (such as those having a partial structure of thiourea, thioamide, thiocarbamate, dithiocarbamate, thiohydantoin or rhodanine), and quaternary salts (such as pyridinium salt).

Of the groups represented by A, those particularly useful are represented by the following formula (IV):

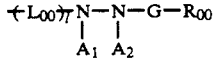

(IV)

wherein $A_1$ and $A_2$ each represents a hydrogen atom, or one of $A_1$ and $A_2$ represents a hydrogen atom, and the other represents a sulfinic acid moiety or

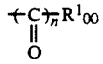

(wherein $R^1_{00}$ represents an alkyl group, an alkenyl group, an aryl group, an alkoxy group or an aryloxy group; and n represents an integer of 1 or 2); $R_{00}$ represents a hydrogen atom, an alkyl group, an aryl group, an alkoxy group, an aryloxy group, an amino group, an alkoxycarbonyl group, an aryloxycarbonyl group, a carbamoyl group, an azo group or a heterocyclic group; G represents a carbonyl group, a sulfonyl group, a sulfoxy group, a

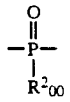

group (wherein $R^2_{00}$ represents an alkoxy group or an aryloxy group) or an iminomethylene group; $L_{00}$ represents an arylene group or a divalent heterocyclic group; and l represents an integer of 0 or 1.

Specific examples of PUG represented by formula (III) are as set forth below. In the following formulae the symbol (*)(*)(*) denotes the position of bonding to Time.

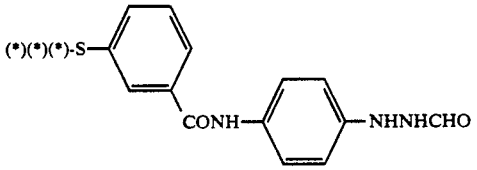

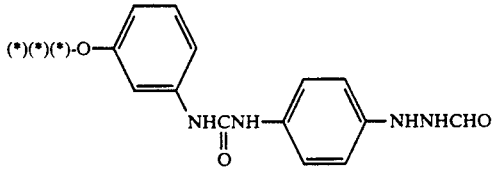

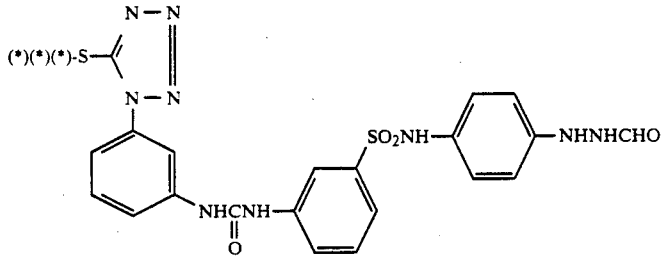

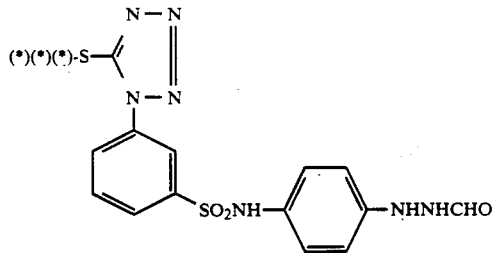

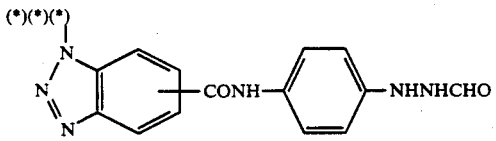

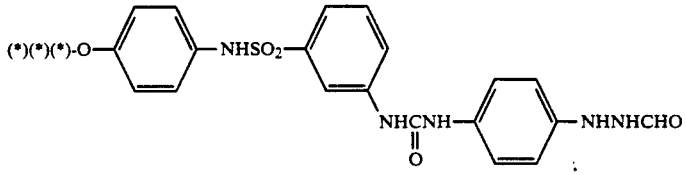

-continued
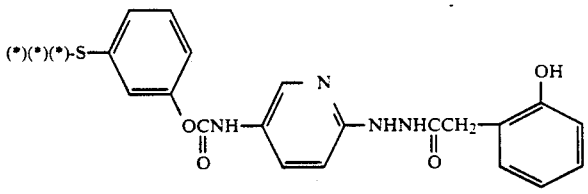
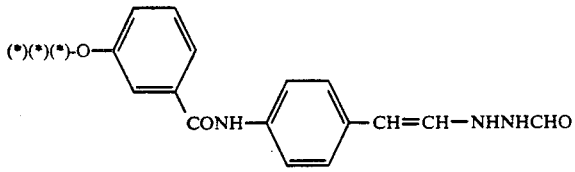
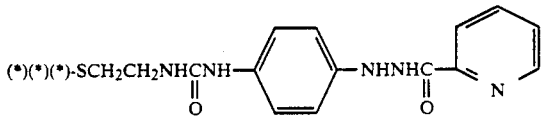
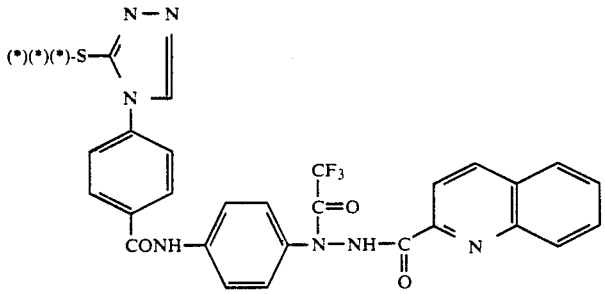
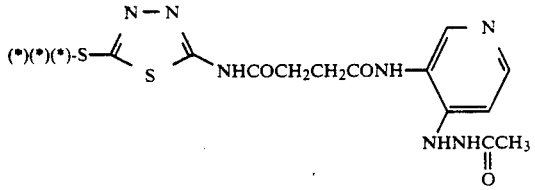
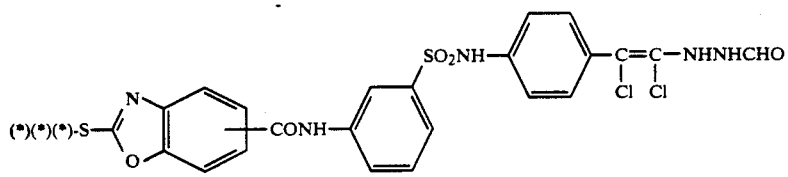
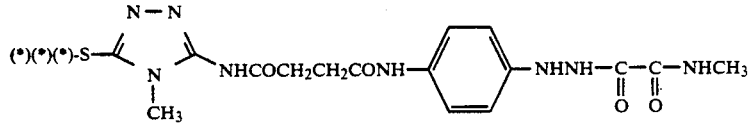
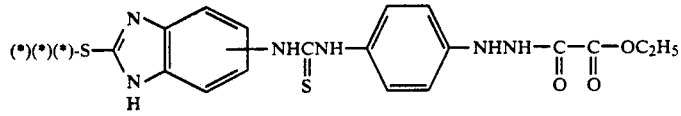

-continued

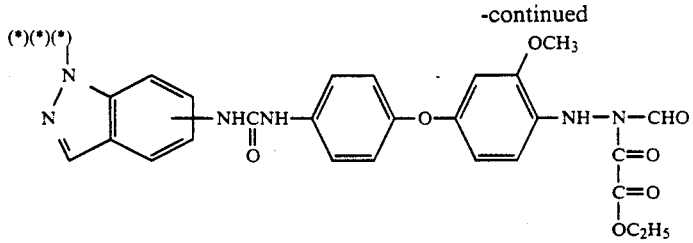

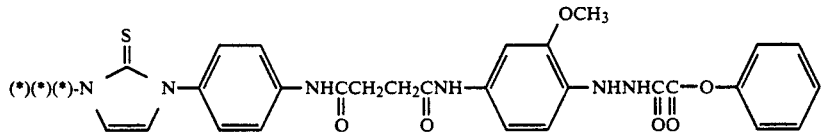

Examples of fogging agents for PUG further include releasing groups released from the couplers as described in JP-A-59-170840.

Examples of silver halide solvents for PUG include meso-ionic compounds as described, for example, in JP-A-60-163042 and U.S. Pat. Nos. 4,003,910 and 4,378,424; and amino-group-containing mercaptoazoles and azolethiones as described in JP-A-57-202531. More specifically, those described in JP-A-61-230135 are suitable examples.

Other groups of PUG are those described, for example, in JP-A-61-230135 and U.S. Pat. No. 4,248,962.

In formula (I), V represents

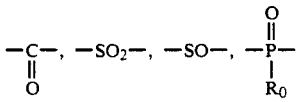

(wherein $R_0$ represents an alkoxy group or an aryloxy group), an iminomethylene group or

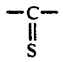

and preferably represents

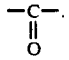

$R_1$ in formula (I) represents a hydrogen atom, an aliphatic group, an aromatic group, a heterocyclic group, an alkoxy group, an aryloxy group, an amino group or $-CH_2-(Time)_m-PUG$.

The aliphatic group represented by $R_1$ includes a straight chain, branched chain or cyclic alkyl group, an alkenyl group and an alkynyl group (for example, methyl, tert-butyl, n-octyl, tert-octyl, cyclohexyl, hexenyl, pyrrolidyl, tetrahydrofuryl, or n-dodecyl), and preferably contains from 1 to 30 carbon atoms, particularly from 1 to 20 carbon atoms.

The aromatic group represented by $R_1$ includes a monocyclic or bicyclic aryl group (for example, phenyl, or nephthyl), and preferably contains from 6 to 30 carbon atoms particularly from 6 to 20 carbon atoms.

The heterocyclic group represented by $R_1$ includes a 3-membered to 10-membered saturated or unsaturated heterocyclic group containing at least one hetero atom selected from a nitrogen atom, an oxygen atom and a sulfur atom, which may be a monocyclic ring or form a condensed ring together with an aromatic ring or a hetero ring. Preferred heterocyclic groups are 5-membered or 6-membered aromatic heterocyclic groups, for example, pyridyl, quinolinyl, pyrimidyl, or benzothiazolyl.

The alkoxy group represented by $R_1$ includes a straight chain, branched chain or cyclic alkoxy group (for example, methoxy, butoxy, octyloxy, dodecyloxy, or tert-butoxy), and preferably contains from 1 to 30 carbon atoms, particularly from 1 to 20 carbon atoms.

The aryloxy group represented by $R_1$ includes a monocyclic or bicyclic aryloxy group (for example, phenoxy, or naphthoxy), and preferably contains from 6 to 30 carbon atoms, particularly from 6 to 20 carbon atoms.

The amino group represented by $R_1$ includes an unsubstituted amino group, an aliphatic amino group, an aromatic amino group, and a heterocyclic amino group (for example, amino, methylamino, anilino, dimethylamino, tert-butylamino, or pyridylamino), and preferably contains from 1 to 30 carbon atoms, particularly from 1 to 20 carbon atoms.

The group represented by $R_1$ may be substituted with one or more substituents. Suitable examples of substituents include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an aryl group, an alkylthio group, an arylthio group, a sulfonyl group, a sulfinyl group, a hydroxy group, a halogen atom, a cyano group, a sulfo group, a carboxy group, an aryloxycarbonyl group, an acyl group, an alkoxycarbonyl group, an acyloxy group, a carbonamido group, a sulfonamido group, a nitro group, an alkylthio group, and an arylthio group. These groups may further be substituted, and combine with each other to form a ring.

Preferred examples of $R_1$ are a hydrogen atom, an alkyl group and an aryl group.

$R_2$ in formula (I) represents a hydrogen atom, an aliphatic group, an aromatic group or a heterocyclic group. The aliphatic group, aromatic group and heterocyclic group each has the same meaning as those defined for $R_1$.

m and n in formula (I) each represents 0 or 1.

Specific examples of the photographic agents represented by the general formula (I) which can be used in the present invention are as set forth below, but the present invention should not be construed as being limited thereto.

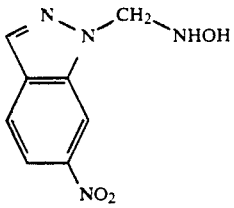
I-1
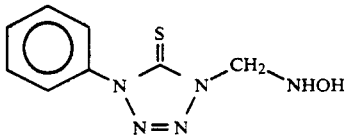
I-2
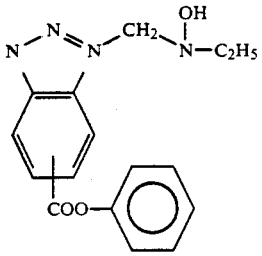
I-3
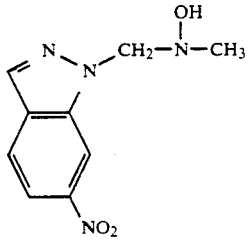
I-4
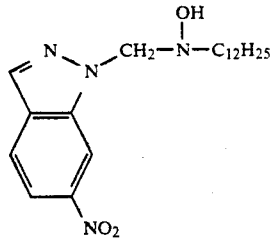
I-5
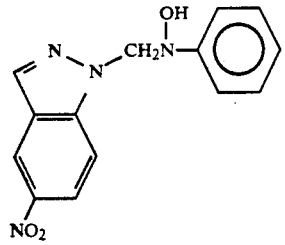
I-6
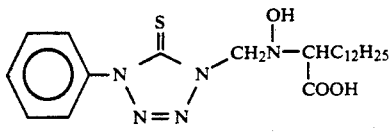
I-7

-continued
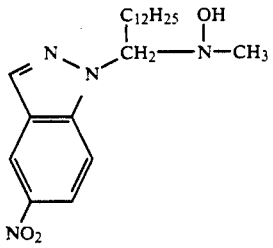
I-8
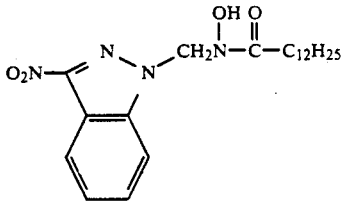
I-9
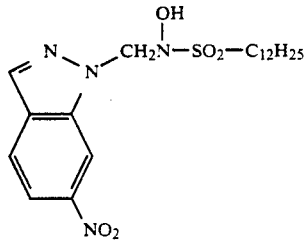
I-10
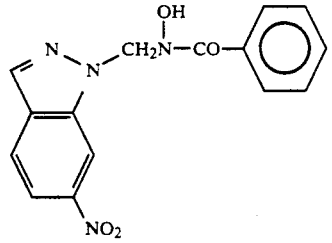
I-11
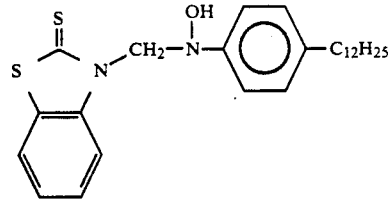
I-12
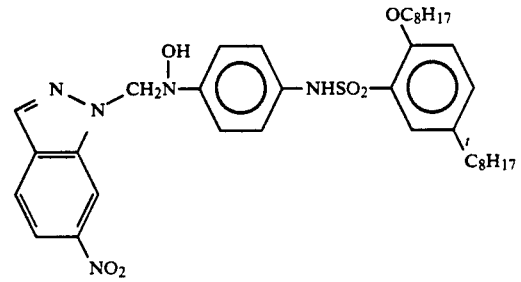
I-13

-continued
I-14
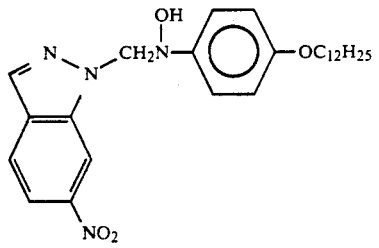
I-15
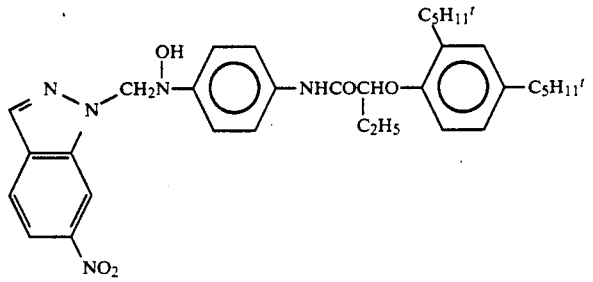
I-16
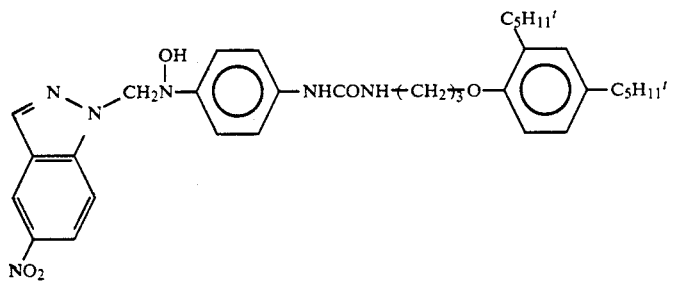
I-17
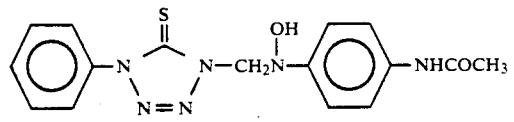
I-18
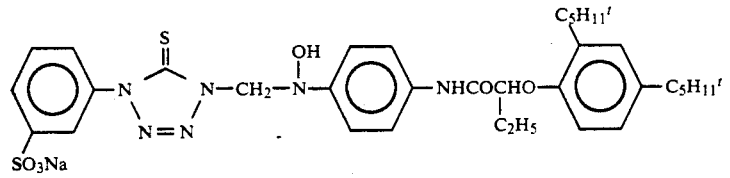
I-19
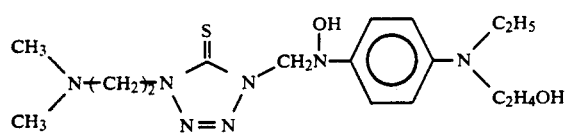
I-20
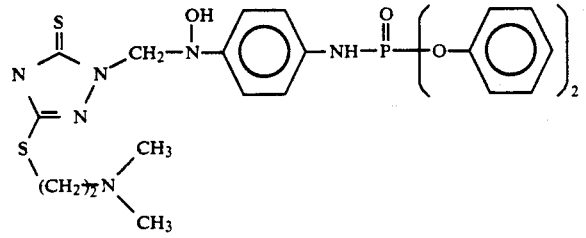

-continued
I-21
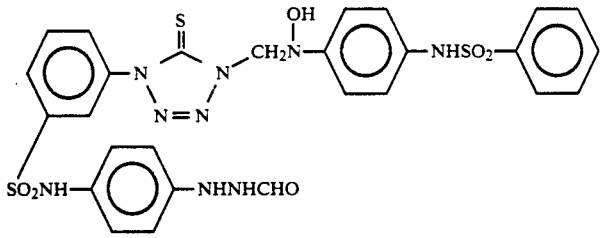
I-22
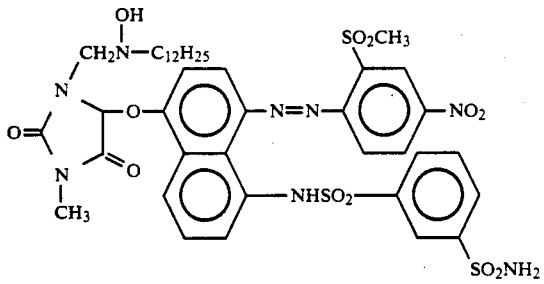
I-23
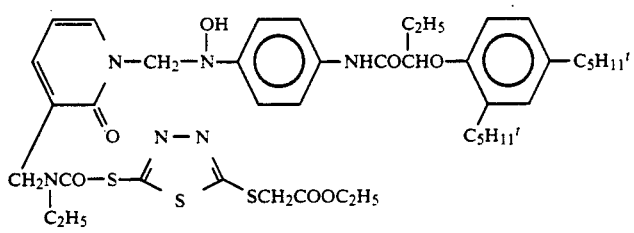
I-24
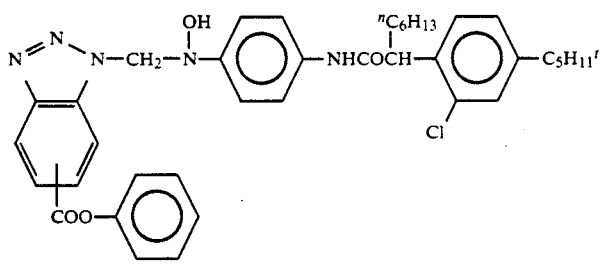
I-25
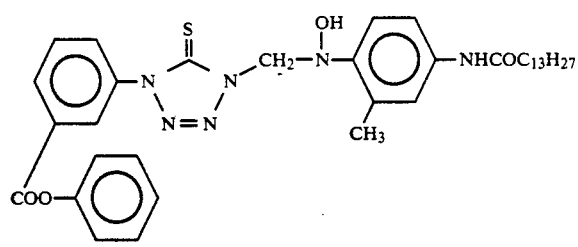
I-26
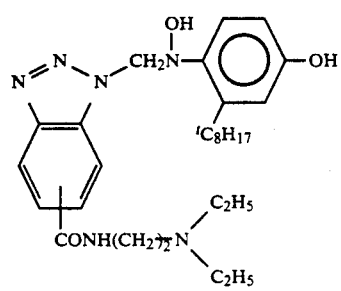

-continued
I-27
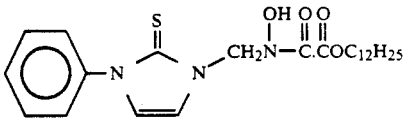
I-28
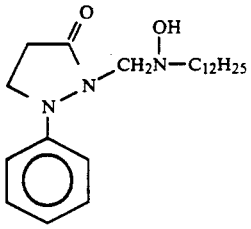
I-29
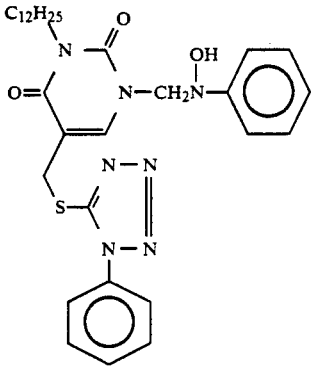
I-30
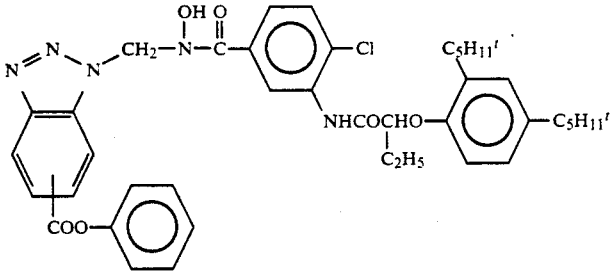
I-31
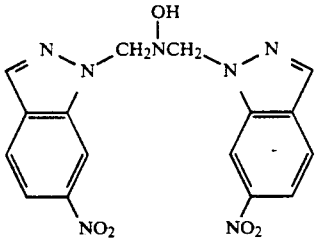
I-32
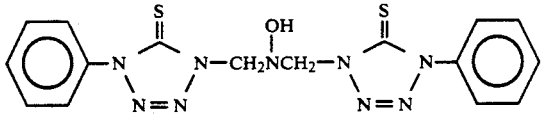
I-33
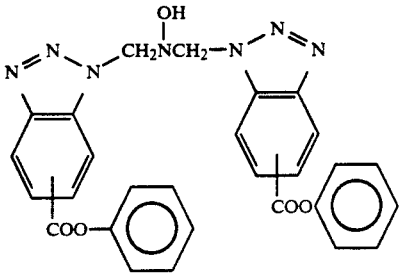

-continued

I-34

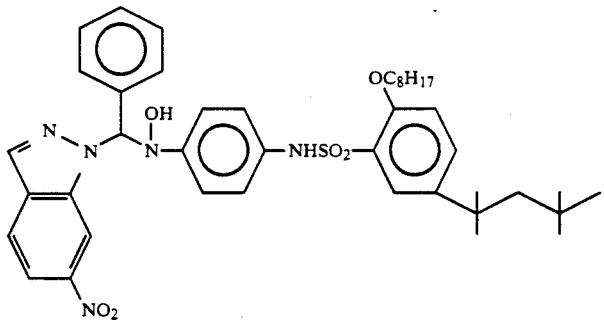

I-35

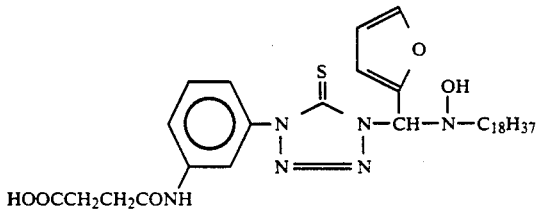

I-36

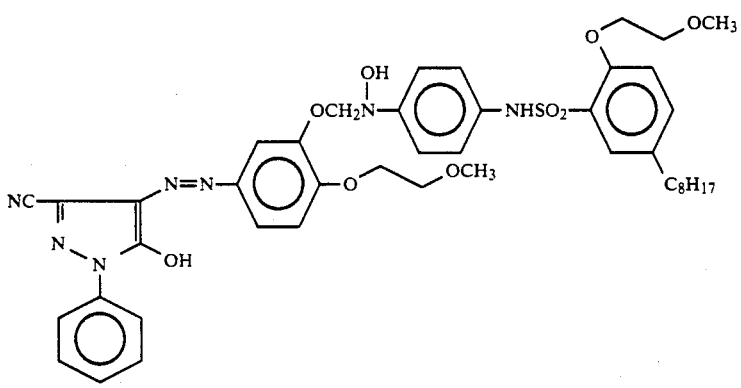

I-37

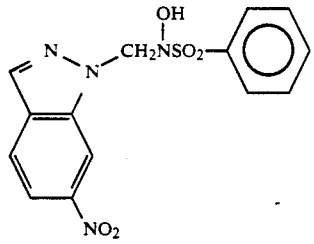

General synthetic methods of the compounds of formula (I) include the following two methods, A and B:

Method A

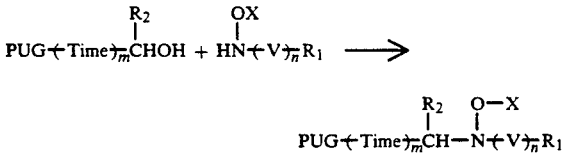

Method A

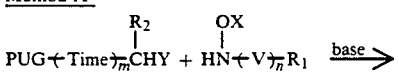

-continued

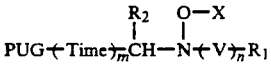

In the foregoing, PUG, Time, V, $R_1$, $R_2$, X, m and n each has the same meaning as in formula (I) and Y represents a halogen atom. The base which can be used in Method B includes an inorganic base and an organic base.

Representative synthesis methods of the compounds of formula (I) which can be used in the present invention are specifically described below. Unless otherwise indicated herein, all parts, percents, ratios and the like are by weight.

SYNTHESIS EXAMPLE 1

Synthesis of Compound I-4

11.6 g of 1-hydroxymethyl-6-nitroindazole and 5.5 g of N-methylhydroxylamine hydrochloride were added to 100 ml of acetonitrile, and then 8.3 g of potassium carbonate was added thereto. The mixture was stirred at room temperature (about 20° to 30° C.) for 5 hours, and filtered. The crystals thus obtained were washed with water, and recrystallized from acetonitrile to obtain 6.5 g (yield: 48.8%) of Compound I-4 as a white solid. Melting point: 142° to 143° C.

SYNTHESIS EXAMPLE 2

Synthesis of Compound I-31

12.2 g of 1-hydroxymethyl-6-nitroindazole and 2.1 g of hydroxylamine hydrochloride were added to 100 ml of acetonitrile, and then 4.1 g of potassium carbonate was added thereto. The mixture was stirred at room temperature for 6 hours, and subjected to purification in the same manner as described in Synthesis Example 1 to obtain 3.8 g (yield: 33.0%) of Compound I-31 as a white solid. Melting point: 198° to 199° C.

SYNTHESIS EXAMPLE 3

Synthesis of Compound I-37

7.7 g of 1-hydroxymethyl-6-nitroindazole and 7.3 g of benzenesulfohydroxamic acid were added to 100 ml of acetonitrile, and the mixture was stirred at room temperature for 5 hours, and filtered. The crystals thus obtained were recrystallized from acetonitrile to obtain 9.0 g (yield: 64.6 g) of Compound I-37 as a white solid. Melting point: 160° to 161° C.

SYNTHESIS EXAMPLE 4

Synthesis of Compound I-11

9.7 g of 1-hydroxymethyl-6-nitroindazole and 13.7 g of benzohydroxamic acid were added to 100 ml of acetonitrile, and the mixture was stirred at room temperature for 6 hours, and subjected to purification in the same manner as described in Synthesis Example 3 to obtain 5.0 g (yield: 32.0%) of Compound I-11 as a white solid. Melting point: 204° to 205° C.

The compound represented by formula (I) which can be used in the present invention is believed either to be cross-oxidized by a redox reaction with the oxidation product of the developing agent or of the auxiliary developing agent formed imagewise during development, or to be oxidized itself by direct reduction of a silver salt to release imagewise a photographically useful substance and thus is converted into a colorless oxidation product.

Because the compound used in the present invention releases imagewise a photographically useful group quickly, effectively and with good timing characteristics, various applications are appropriate for use of the present invention. For example, a development inhibiting substance released will inhibit imagewise development and exhibit DIR effects such as finer grains, softening of tone and improved sharpness of the image, improved color reproduction and the like. Further, if a diffusible or nondiffusible dye is released, it may be possible to form color images. As is described later, the compound represented by formula (I) used in the present invention is extremely active and exhibits remarkable photographic effects through efficient action in comparison with hitherto known compounds having a similar action.

The compound according to the present invention can be used to achieve the objects of the present invention by addition to a silver halide emulsion layer and/or a hydrophilic colloid layer provided either over or beneath a silver halide emulsion layer. When applying the compound represented by formula (I) used in the present invention, a suitable releasing group PUG needs to be selected depending on the objects of its use. Further, the amount to be added depends on the kind of photographic light-sensitive material as well as on the properties of the PUG selected. In general, a preferable amount to be added is in the range of from $1\times10^{-7}$ to $1\times10^{3}$ mol per mol of silver halide.

For example, where PUG is a development inhibitor, the compound according to the present invention is preferably used in an amount of from $1\times10^{-7}$ to $1\times10^{-1}$ mol per mol of silver halide, and an amount ranging from $1\times10^{-6}$ to $5\times10^{-2}$ mol is particularly preferred. Where PUG is a development accelerator or fogging agent, the amount to be used is preferably the same as that described above for the development inhibitor use.

Further, for example, when the PUG is a dye to be used for forming an image, it is preferable to use the compounds according to the present invention in an amount of from $1\times10^{-3}$ to 10 mols per mol of silver halide, and an amount ranging from $1\times10^{-2}$ to 4 mols is particularly preferred.

Conventional methods can be employed to add the compound used in the present invention to a silver halide emulsion layer and/or other hydrophilic colloid layers. More specifically, a water-soluble compound may be added to an aqueous solution of gelatin in the form of an aqueous solution thereof or as the compound per se. For a compound which is insoluble or sparingly soluble in water, a method which comprises mixing the compound with an aqueous solution of gelatin after dissolving it in a solvent miscible with water, for example, as described in U.S. Pat. No. 2,322,027, can be used. For example, the compound can be dissolved in the following solvent, and thereafter dispersed in a hydrophilic colloid: alkyl phthalates (e.g., dibutyl phthalate and dioctyl phthalate), phosphoric esters (e.g., diphenyl phosphate, triphenyl phosphate, tricresyl phosphate, and dioctyl butyl phosphate), citric esters (e.g., tributyl acetyl citrate), benzoic esters (e.g., octyl benzoate), alkylamides (e.g., diethyllaurylamide), fatty acid esters (e.g., dibutoxyethylsuccinate and diethyl azeolate), trimesic esters (e.g., tributyl trimesate); or organic solvents having a boiling pint of from about 30° C. to 150° C., such as lower alkyl acetates (e.g., ethyl acetate, butyl acetate), ethyl propionate, secondary butyl alcohol, methyl isobutyl ketone, $\beta$-ethoxyethyl acetate, and methyl Cellosolve acetate. The above described high boiling point organic solvent and low boiling point organic solvent may be used in combination, if desired.

The compound represented by formula (I) as used in the present invention can be used as an emulsified dispersion in combination with a reducing material such as hydroquinone and its derivatives, catechol and its derivatives, aminophenol and its derivatives or ascorbic acid and its derivatives.

The compound represented by formula (I) used in the present invention preferably is employed in combination with a hydrazine derivative represented by the following formula (V):

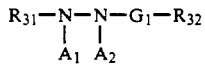

(V)

wherein $R_{31}$ represents an aliphatic group or an aromatic group; $R_{32}$ represents a hydrogen atom, an alkyl group, an aryl group, an alkoxyl group, an aryloxy group, an amino group, a carbamoyl group, or an oxycarbonyl group; $G_1$ represents a

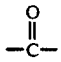

group, a $-SO_2-$ group, a $-SO-$ group, a

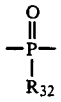

group, (wherein $R_{32}$ is as defined above), a

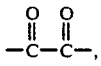

group, a thiocarbonyl group, or an iminomethylene group; $A_1$ and $A_2$ each represents a hydrogen atom, or one of $A_1$ or $A_2$ represents a hydrogen atom, and the other represents a substituted or unsubstituted alkylsulfonyl group, a substituted or unsubstituted arylsulfonyl group, or a substituted or unsubstituted acyl group.

In formula (V), the aliphatic group represented by $R_{31}$ is preferably an aliphatic group containing from 1 to 30 carbon atoms, and more preferably a straight chain, branched chain or cyclic alkyl group having from 1 to 20 carbon atoms. The branched chain alkyl group may be cyclized to form a saturated heterocyclic ring containing at least one hetero atom. Further, the alkyl group may be substituted with, for example, an aryl group, an alkoxyl group, a sulfoxy group, a sulfonamido group, or a carbonamido group.

The aromatic group represented by $R_{31}$ in formula (V) is a monocyclic or bicyclic aryl group or an unsaturated heterocyclic group. The unsaturated heterocyclic group may be condensed with a monocyclic or bicyclic aryl group to form a heteroaryl group. Examples of aromatic groups for $R_{31}$ include a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, with those containing a benzene ring being particularly preferred.

$R_{31}$ particularly preferably represents an aryl group.

The aryl group or unsaturated heterocyclic group represented by $R_{31}$ may be substituted with one or more substituents typically including, for example, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, an alkyl or aryl sulfonyl group, an alkyl or aryl sulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxy group, a phosphonamido group, a diacylamino group, an imido group, and a

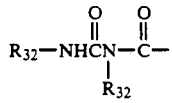

group (wherein $R_{32}$ is as defined above). Preferred examples of suitable substituents include a straight chain, branched chain or cyclic alkyl group (preferably having from 1 to 20 carbon atoms), an aralkyl group (preferably a monocyclic or bicyclic group having from 1 to 3 carbon atoms in the alkyl moiety thereof), an alkoxyl group (preferably having from 1 to 20 carbon atoms), a substituted amino group (preferably an amino group substituted with an alkyl group having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atoms), and a phosphonamido group (preferably having from 1 to 30 carbon atoms).

The alkyl group represented by $R_{32}$ in formula (V) preferably contains from 1 to 4 carbon atoms and may be substituted, e.g., with one or more of a halogen atom, a hydroxy group, a cyano group, a carboxy group, a sulfo group, an alkoxyl group, a phenyl group, an alkyl or aryl sulfonyl group, an acyl group, an alkoxycarbonyl group, an aryloxycarbonyl group, a carbamoyl group, a sulfamoyl group, a nitro group, a heteroaromatic group, and a

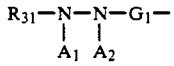

group (wherein $R_{31}$, $A_1$, $A_2$ and $G_1$ each is as defined above). These groups may further be substituted.

The aryl group represented by $R_{32}$ preferably includes a monocyclic or bicyclic aryl group, such as those containing a benzene ring. The aryl group may have one or more substituents including a halogen atom, an alkyl group, a cyano group, a carboxy group, a sulfo group and a sulfonyl group.

The alkoxyl group represented by $R_{32}$ preferably contains from 1 to 8 carbon atoms and may be substituted, for example, with a halogen atom, or an aryl group.

The aryloxy group represented by $R_{32}$ is preferably monocyclic and may be substituted, for example, with a halogen atom.

The amino group represented by $R_{32}$ may be substituted, for example, with an alkyl group, a halogen atom, a cyano group, a nitro group, or a carboxyl group. Preferred examples of amino groups are an unsubstituted amino group, an alkylamino group having from 1 to 10 carbon atoms, and an arylamino group.

The carbamoyl group represented by $R_{32}$ may be substituted, for example, with an alkyl group, a halogen atom, a cyano group, or a carboxy group. Preferred examples of carbamoyl groups are an unsubstituted carbamoyl group, an alkylcarbamoyl group having from 1 to 10 carbon atoms, and an arylcarbamoyl group.

The oxycarbonyl group represented by $R_{32}$ preferably includes an alkoxycarbonyl group having from 1 to 10 carbon atoms and an aryloxycarbonyl group. The oxycarbonyl group may be substituted, for example, with an alkyl group, a halogen atom, a cyano group, or a nitro group.

Where $G_1$ is a $$-\overset{\overset{\displaystyle O}{\|}}{C}-$$

group, $R_{32}$ preferably represents a hydrogen atom, an alkyl group (e.g., methyl, trifluoromethyl, 3-hydroxypropyl, 3-methanesulfonamidopropyl, and phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl and 2-hydroxymethylphenyl), and more preferably, a hydrogen atom.

Where $G_1$ is a $-SO_2-$ group, $R_{32}$ preferably represents an alkyl group (e.g., methyl), an aralkyl group (e.g., o-hydroxyphenylmethyl), an aryl group (e.g., phenyl), or a substituted amino group (e.g., dimethylamino).

Where $G_1$ is a $-SO-$ group, $R_{32}$ preferably represents a cyanobenzyl group or a methylthiobenzyl group. .

Where $G_1$ is $$-\overset{\overset{\displaystyle O}{\|}}{\underset{\underset{\displaystyle R_{32}}{|}}{P}}-,$$

$R_{32}$ preferably represents a methoxy group, an ethoxy group, a butoxy group, a phenoxy group, or a phenyl group, and more preferably a phenoxy group.

Where $G_1$ is an N-substituted or unsubstituted iminomethylene group, $R_{32}$ preferably represents a methyl group, an ethyl group, or a substituted or unsubstituted phenyl group.

Substituents applicable to $R_{32}$ include those illustrated above as the substituents of $R_{31}$.

In formula (V), $G_1$ most preferably represents a $$-\overset{\overset{\displaystyle O}{\|}}{C}-$$

group.

$R_{32}$ may be a group which causes the $G_1$—$R_{32}$ moiety split from the remainder of formula (V) to induce cyclization producing a cyclic structure containing the —$G_1$—$R_{32}$ moiety More specifically, such a group is represented by the following formula (a):

$$-R_{33}-Z_{31} \qquad \text{(a)}$$

wherein $Z_{31}$ represents a group which nucleophilically attacks $G_1$ to split the $G_1$—$R_{33}$—$Z_{31}$ moiety from the remainder; $R_{33}$ represents a group derived by removable of one hydrogen atom from $R_{32}$; and $R_{33}$ and $Z_{31}$ form a cyclic structure together with $G_1$ upon nucleophilic attack of $Z_{31}$ on $G_1$.

In greater detail, when the hydrazine compound of formula (V) undergoes a reaction such as an oxidation to produce an intermediate represented by the formula of $R_{31}$—N=N—$G_1$—$R_{33}$—$Z_{31}$, $Z_{31}$ easily reacts nucleophilically with $G_1$ to split $R_{31}$—N=N from $G_1$. A group such as $Z_{31}$ includes a functional group capable of direct reaction with $G_1$, e.g., OH, SH, $NHR_{34}$ (wherein $R_{34}$ represents a hydrogen atom, an alkyl group, an aryl group, —$COR_{35}$, or —$SO_2R_{35}$, wherein $R_{35}$ represents a hydrogen atom, an alkyl group, an aryl group, or a heterocyclic group), and —COOH (these functional groups may be temporarily protected so that the functional group is released upon hydrolysis with an alkali, etc.) and a functional group which becomes capable of reacting with $G_1$ on reaction with a nucleophilic agent (e.g., a hydroxide ion and a sulfite ion), such as $$-\overset{\overset{\displaystyle O}{\|}}{C}-R_{36} \text{ and } -\overset{\overset{\displaystyle N-R_{37}}{\|}}{C}-R_{36}$$

(wherein $R_{36}$ and $R_{37}$ each represents a hydrogen atom, an alkyl group, an alkenyl group, an aryl group, or a heterocyclic group).

The ring formed by $G_1$, $R_{33}$, and $Z_{31}$ is preferably a 5-membered or 6-membered ring.

Preferred groups represented by formula (a) are those represented by formula (b) or (c) described below.

$$\begin{array}{l} \quad\quad\quad\quad \left(CR_b^1R_b^2\right)_m C \\ \quad\quad\quad\quad\quad\quad\quad\quad \| \\ Z_{31}\left(CR_b^3R_b^4\right)_n C \end{array} \quad \text{B} \qquad \text{(b)}$$

wherein $Z_{31}$ is as defined above; $R_b^1$, $R_b^2$, $R_b^3$, and $R_b^4$, which may be the same or different, each represents a hydrogen atom, an alkyl group (preferably having from 1 to 12 carbon atoms), an alkenyl group (preferably having from 2 to 12 carbon atoms), or an aryl group (preferably having from 6 to 12 carbon atoms); B represents an atomic group necessary to form a substituted or unsubstituted 5-membered or 6-membered ring; m and n each represents 0 or 1; and (n+m) is 1 or 2.

In formula (b), examples of the 5-membered or 6-membered ring formed by B include, for example, cyclohexene, cycloheptene, benzene, naphthalene, pyridine, and quinoline rings.

$$\left(\overset{\overset{\displaystyle R_c^3}{|}}{N}\right)_p\left(CR_c^1R_c^2\right)_q Z_{31} \qquad \text{(c)}$$

wherein $Z_{31}$ is as defined above; $R_c^1$ and $R_c^2$, which may be the same or different, each represents a hydrogen atom, an alkyl group, an alkenyl group, an aryl group, or a halogen atom; $R_c^3$ represents a hydrogen atom, an alkyl group, an alkenyl group, or an aryl group; p represents 0 or 1; q represents an integer of from 1 to 4; $R_c^1$, $R_c^2$, and $R_c^3$ may combine and form a ring so long as $Z_{31}$ remains capable of intramolecular nucleophilic attack on $G_1$.

$R_c^1$ and $R_c^2$ each preferably represents a hydrogen atom, a halogen atom, or an alkyl group, and $R_c^3$ preferably represents an alkyl group or an aryl group.

q preferably represents 1 to 3. When q is 1, p represents 1 or 2; when q is 2, p represents 0 or 1; when q is 3, p represents 0 or 1; and when q is 2 or 3, the $CR_c^1R_c^2$ moieties may be the same or different.

In formula (V), $A_1$ and $A_2$ each represents a hydrogen atom, an alkylsulfonyl or arylsulfonyl group having 20 or less carbon atoms (preferably a phenyl-sulfonyl group or a phenylsulfonyl group which is substituted so that the sum of the Hammett's substituent constants is −0.5 or more), an acyl group having 20 or less carbon atoms (preferably a benzoyl group, a benzoyl group which is substituted so that the sum of the Hammett's substituent constants is −0.5 or more, or a straight chain, branched chain or cyclic, substituted or unsubstituted aliphatic acyl group (examples of substituents include a halogen atom, an ether group, a sulfonamido group, a carbonamido group, a hydroxy group, a carboxy group, and a sulfo group)).

$A_1$ and $A_2$ each particularly preferably represents a hydrogen atom.

$R_{31}$ or $R_{32}$ in formula (V) may contain a ballast group conventionally employed in immobile photographic additives such as couplers. A ballast group is a group which contains at least 8 carbon atoms and is relatively inert to photographic characteristics. Suitable examples of ballast groups include an alkyl group, an alkoxy group, a phenyl group, an alkylphenyl group, a phenoxy group, and an alkylphenoxy group.

$R_{31}$ or $R_{32}$ in formula (V) may further contain a group which accelerates adsorption onto the surfaces of the silver halide grains (hereinafter referred to as an adsorption group). Examples of suitable adsorption groups include a thiourea group, a heterocyclic thioamido group, a mercapto heterocyclic group, and a triazole group as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Specific examples of hydrazine derivative represented by formula (V) are set forth below, but the present invention should not be construed as being limited thereto.

(V-1)

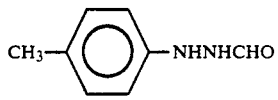

(V-2)

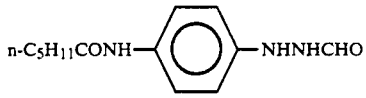

(V-3)

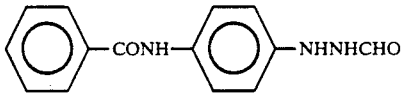

(V-4)

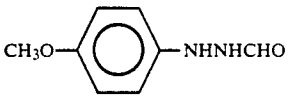

(V-5)

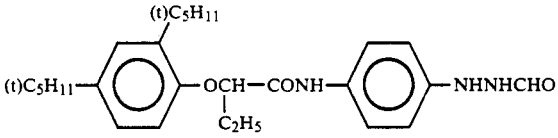

(V-6)

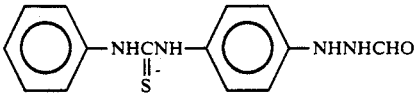

(V-7)

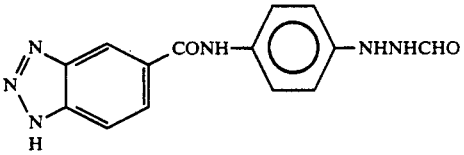

(V-8)

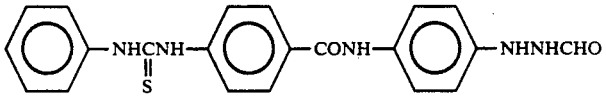

(V-9)

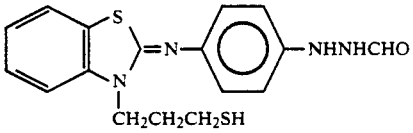

-continued
(V-10)
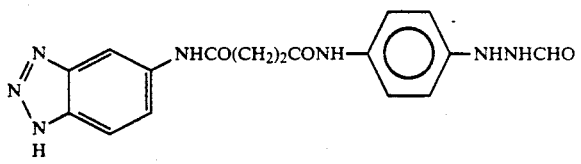
(V-11)
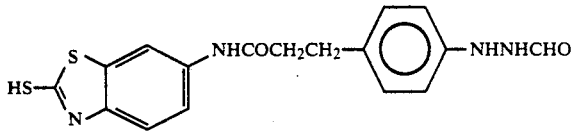
(V-12)
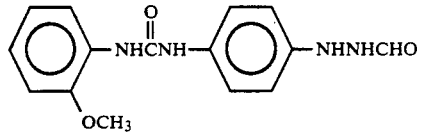
(V-13)
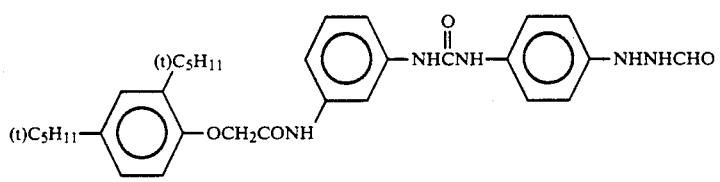
(V-14)
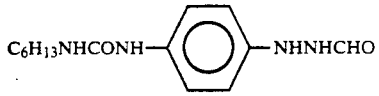
(V-15)
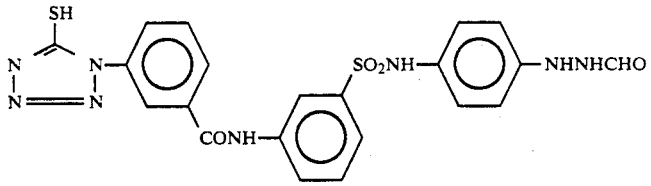
(V-16)
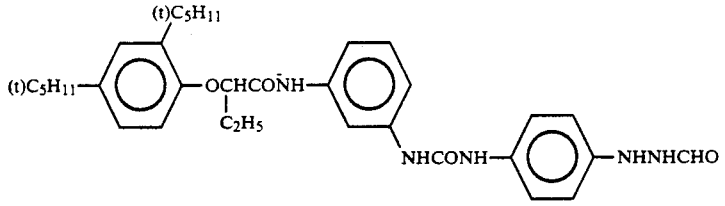
(V-17)
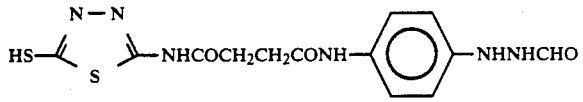
(V-18)
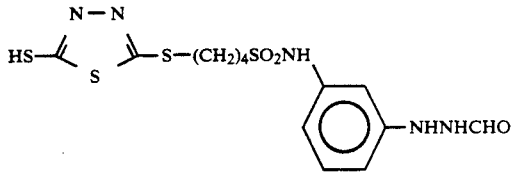

-continued
(V-19)
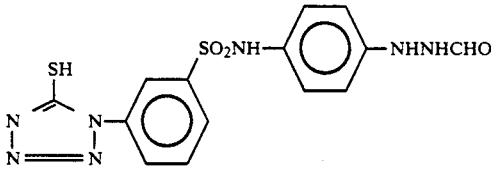
(V-20)
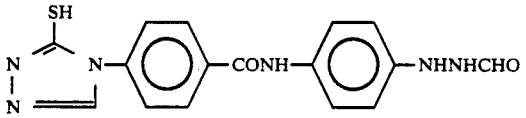
(V-21)
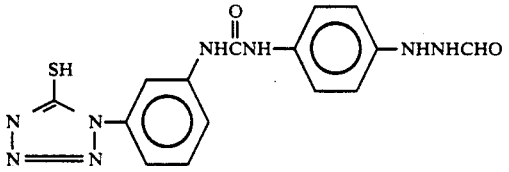
(V-22)
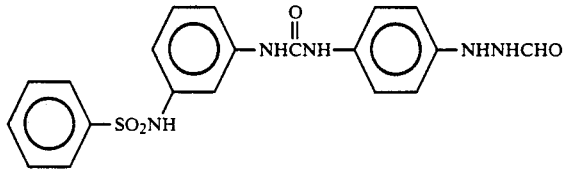
(V-23)
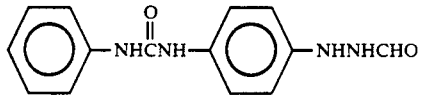
(V-24)
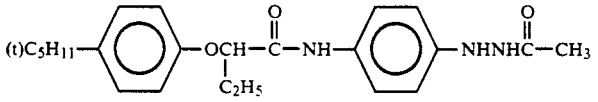
(V-25)
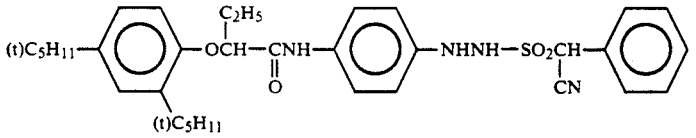
(V-26)
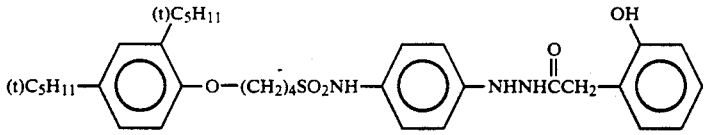
(V-27)
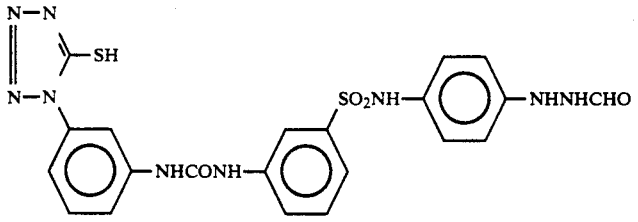
(V-28)
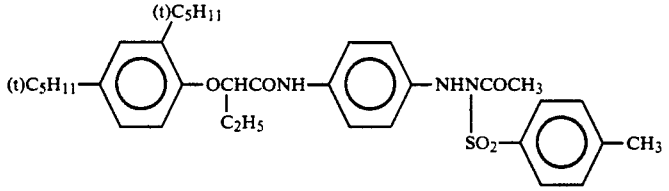

-continued
(V-29)
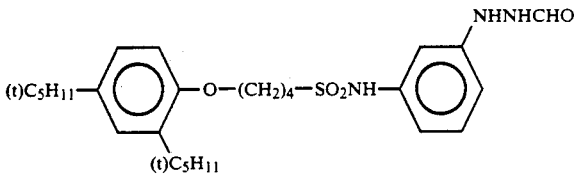
(V-30)
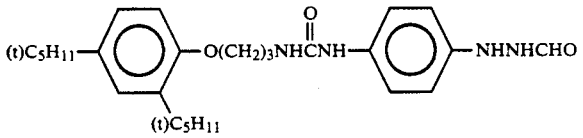
(V-31)
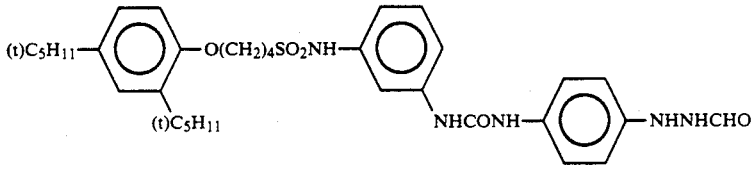
(V-32)
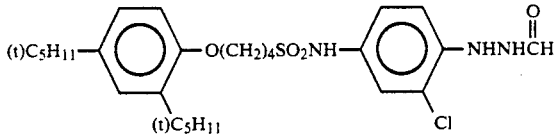
(V-33)
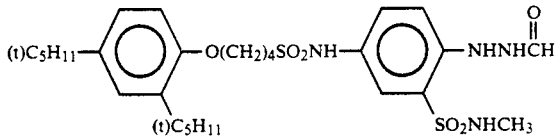
(V-34)
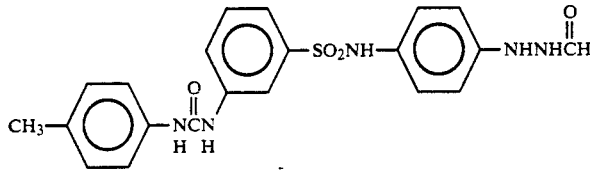
(V-35)
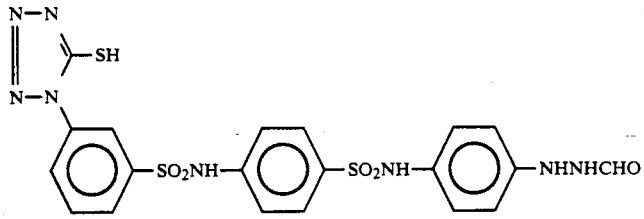
(V-36)
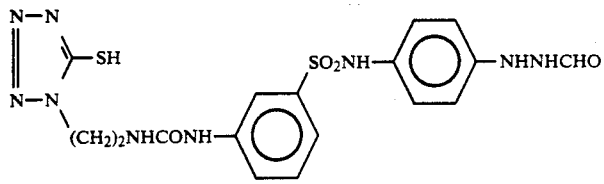

-continued
(V-37)
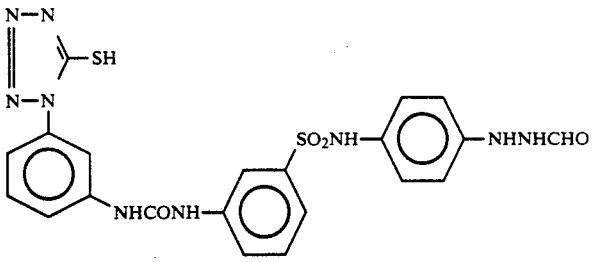
(V-38)
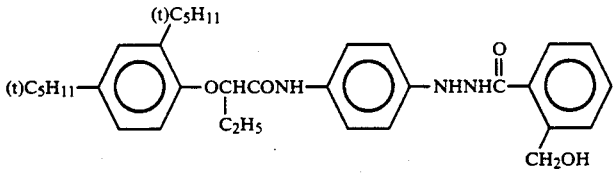
(V-39)
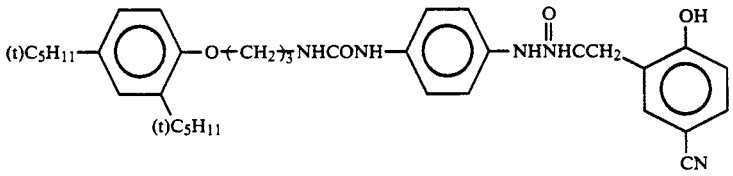
(V-40)
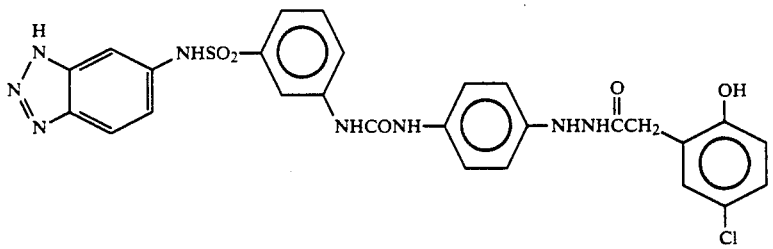
(V-41)
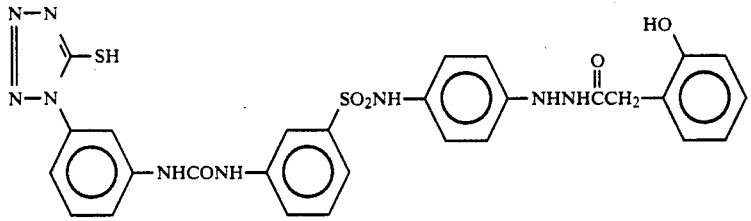
(V-42)
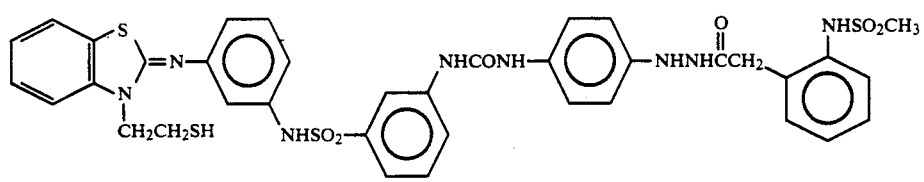
(V-43)
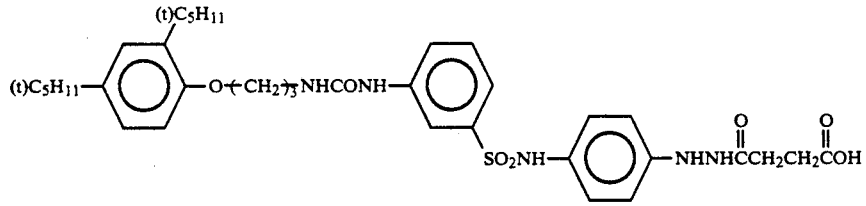
(V-44)
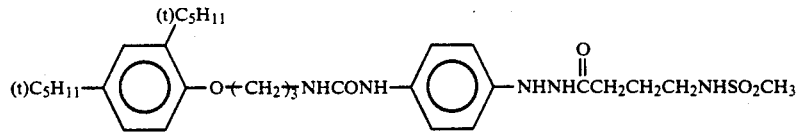

-continued
(V-45)
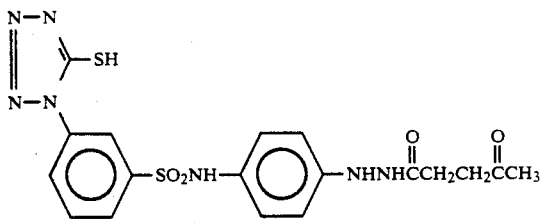
(V-46)
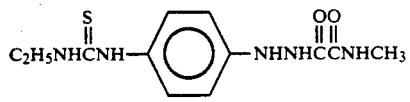
(V-47)
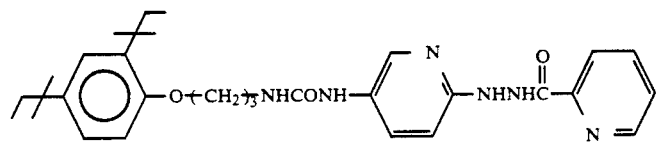
(V-48)
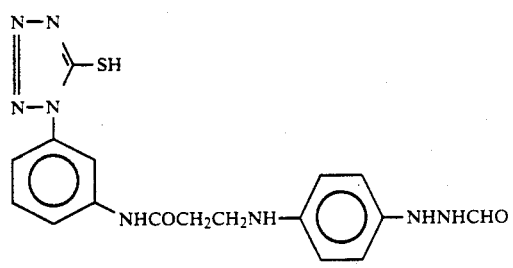
(V-49)
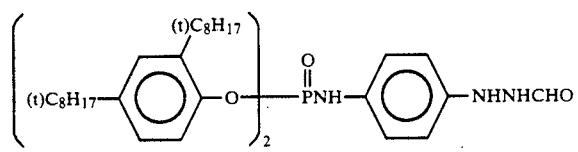
(V-50)
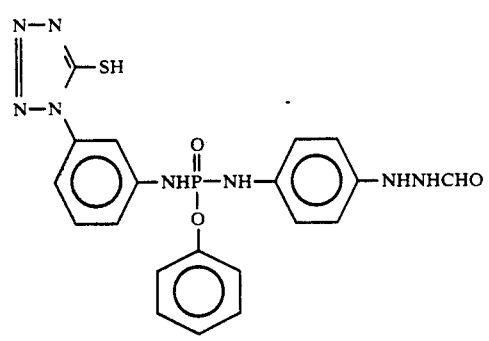
(V-51)
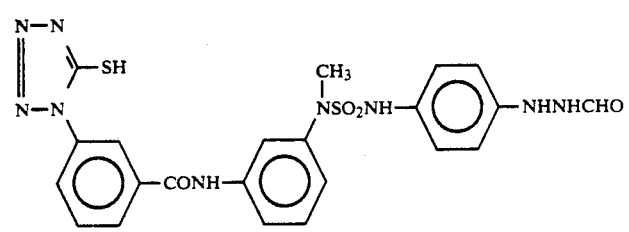

-continued
(V-52)
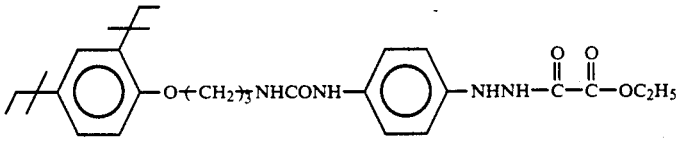
(V-53)
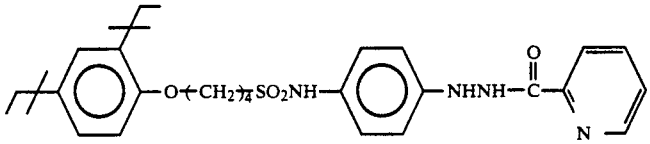
(V-54)
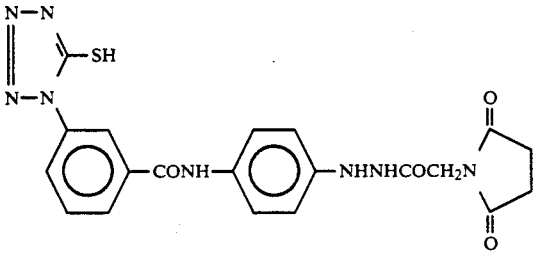
(V-55)
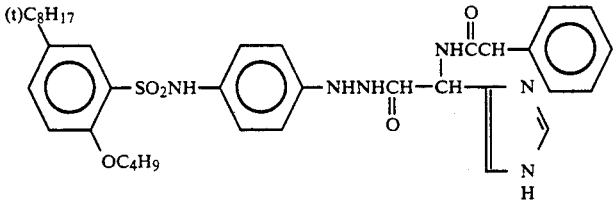
(V-56)
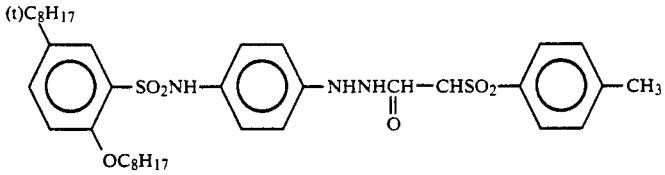
(V-57)
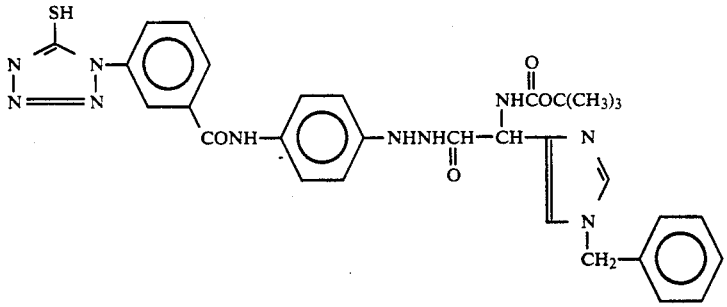
(V-58)
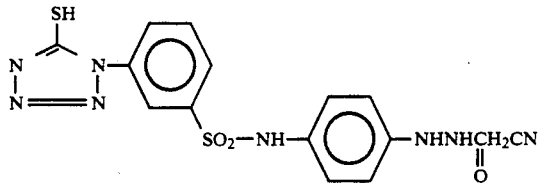
(V-59)
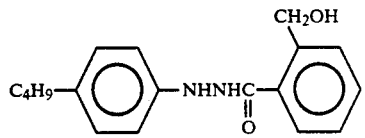

-continued

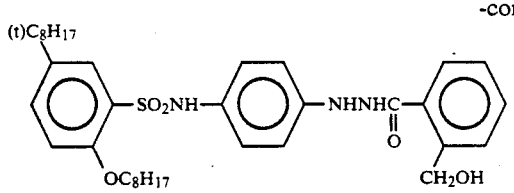

(V-60)

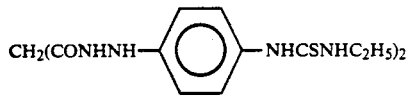

(V-61)

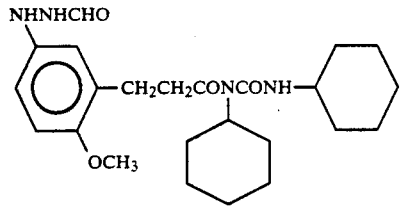

(V-62)

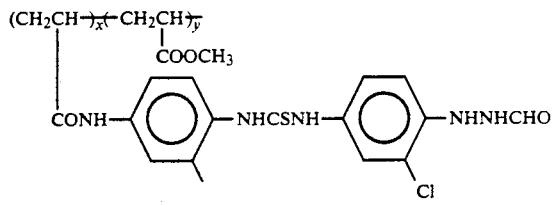

(V-63)

x:y = 3:97
$\overline{M} \simeq 100{,}000$

In addition to the above-described hydrazine derivatives, it is also possible to use those hydrazines described in *Research Disclosure,* No. 23516 (November, 1983), page 346 and in the references cited therein, and those described in U.S. Pat. Nos. 4,080,207, 4,269,929, 4,276,364, 4,278,748, 4,385,108, 4,459,347, 4,560,638 and 4,478,928, British patent 2,011,391B, JP-A-60-179734, JP-A-62-270948, JP-A-63-29751, JP-A-61-170733, JP-A-61-270744, JP-A-62-948, European Patent 217,310, U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A- 1-276128, JP-A-1-283548, JP-A-1-280747, JP-A-1-283549, JP-A-1-285940, JP-A-2-2541, JP-A-2-77057, Japanese Patent Application Nos. 63-179760, 1-18377, 1-18378, 1-18379, 1-15755, 1-16814, 1-40792, 1-42615, 1-42616, 1-123693 and 1-126284.

The amount of the hydrazine derivative employed in the present invention is preferably from $1\times10^{-6}$ mol to $5\times10^{-2}$ mol, and particularly preferably from $1\times10^{-5}$ mol to $2\times10^{-2}$ mol, per mol of silver halide.

The compound represented by formula (I) can be employed in the present invention to form a negative image having a high contrast by using it in combination with the hydrazine derivative represented by formula (V) and a negative type emulsion. Further, the compound can be used in combination with an internal latent image type silver halide emulsion. It is preferred for the compound represented by formula (I) to be employed in combination with the hydrazine derivative represented by formula (V) and a negative type emulsion to form a negative image having a high contrast.

When the compound is used to form a negative image having a high contrast, it is preferred for the silver halide used to have an average grain size in the range of fine grains (e.g., 0.7 μm or less, particularly preferably 0.5 μm or less). Although there is no limitation with regard to the grain size distribution, a monodispersed emulsion is preferred. The term "monodispersed" as used herein means that at least 95% (by weight or in terms of the number of grains) of the grains comprise grains having a grain size within ±40% of the average grain size.

The silver halide grains in the photographic emulsion may have a regular crystal form such as that of a cube, octahedron, rhombic dodecahedron or tetradecahedron, an irregular crystal form such as that of sphere or a tabular form or a composite form of these crystal forms.

The interior and surface layer of the silver halide grain may be composed of a uniform phase or of different phases.

A cadmium salt, sulfite, lead salt, thallium salt, rhodium salt or its complex salt, or iridium salt or its complex salt may be present during the formation of the silver halide grains or during the physical ripening in the preparation of the silver halide emulsion used in the present invention.

Of the silver halides used in the present invention, silver haloiodide which is prepared in the presence of from $10^{-8}$ to $10^{-5}$ mol of an iridium salt or its complex salt per mol of silver and which has a higher silver iodide content at the grain surface than the average silver iodide content of grain is preferred. By using an emulsion containing such a silver haloiodide, a higher sensitivity and higher gamma photographic performance can be achieved.

The silver halide emulsion used in the present invention may or may not be subjected to chemical sensitization. Methods for chemical sensitization of silver halide emulsions induce sulfur sensitization, reduction sensitization and noble metal sensitization. These methods may be used either alone or in combination to carry out chemical sensitization of the silver halide emulsion.

Typical noble metal sensitization methods include a gold sensitization method using gold compounds, mainly gold complex salts. Noble metals such as complex salts of platinum, palladium and rhodium other than gold may also be present. Specific examples thereof are described, for example, in U.S. Pat. No. 2,448,060 and British patent 618,016. Various sulfur compounds such as thiosulfates, thioureas, thiazoles and rhodanines in addition to sulfur compounds present in gelatin can be used as sulfur sensitizing agents.

It is preferred for an iridium salt or rhodium salt to be used before the completion of physical ripening, particularly during the formation of the grains, in the preparation of the silver halide emulsion.

It is preferred from the viewpoint of increasing the maximum density ($D_{max}$) that the silver halide emulsion layer used in the present invention contains two kinds of monodispersed emulsions having different average grain sizes as is described in JP-A-60-223734 and JP-A-62-90646. It is preferred for smaller-size monodispersed grains to be chemically sensitized. Sulfur sensitization is most preferred as the chemical sensitization. Larger-size monodispersed grains need not be chemically sensitized. However, the grains may be chemically sensitized. Since larger-size monodispersed grains tend to form black peppers, the grains are generally not chemically sensitized. However, when chemical sensitization is carried out, it is particularly preferred for the chemical sensitization to be conducted only to such a slight extent that black peppers are not formed. The term "slight extent" as used herein means that chemical sensitization is carried out by shortening the chemical sensitization time, reducing the temperature of the chemical sensitization or reducing the amount of chemical sensitizing agents to be added in comparison with the chemical sensitization of smaller-size grains. Although there is no particular limitation with regard to the difference in sensitivity between a larger-size monodispersed emulsion and a smaller-size monodispersed emulsion, the difference is preferably from 0.1 to 1.0, more preferably from 0.2 to 0.7 in terms of $\Delta$logE. It is preferred that the larger-size monodispersed emulsion has higher sensitivity than that of the smaller-size monodispersed emulsion. The sensitivity of each emulsion is the sensitivity obtained by coating a support with the emulsion containing the hydrazine derivative and processing it with a developing solution having a pH of 10.5 to 12.3 and containing a sulfite ion at a concentration of at least 0.15 mol/l. The average grain size of small-size monodispersed grains is not larger than 90%, preferably not larger than 80%, of that of larger-size monodispersed grains. The average grain size of silver halide emulsion grains is preferably from 0.02 to 1.0 $\mu$m, more preferably from 0.1 to 0.5 $\mu$m. It is preferred that the average grain sizes of both the smaller-size and larger-size grains are in the range described above.

When two or more emulsions having different grain sizes are used in the present invention, the coating weight (in terms of silver) of the smaller-size monodispersed emulsion is preferably from 40 to 90 wt %, more preferably from 50 to 80 wt %, based on the total coating weight of silver.

In the present invention, monodispersed emulsions having different grain sizes may be present in the same emulsion layer or in separate layers. When they are present in separate layers, it is preferred that the larger-size emulsion is present in the upper layer and the smaller-size emulsion is present in the lower layer.

The total coating weight of silver is preferably from 1 g/m$^2$ to 8 g/m$^2$.

Sensitizing dyes (e.g., cyanine dyes, or merocyanine dyes) as described in JP-A-55-52050 (pages 45 to 53) can be added to the photographic material of the present invention in order to increase sensitivity. These sensitizing dyes may be used either alone or in combination. Combinations of sensitizing dyes are often used for the purpose of supersensitization in particular. In addition to the sensitizing dye, the emulsion may contain a dye which itself does not provide a spectral sensitization effect but does exhibit supersensitizing activity, or a material which does not substantially absorb visible light but does exhibit supersensitizing activity. Useful sensitizing dyes, combinations of dyes for the purpose of supersensitization and materials exhibiting supersensitization are described in *Research Disclosure,* Vol. 176, No. 17643 (December, 1978), page 23, item IV-J.

The photographic material of the present invention may contain various compounds for the purpose of preventing the occurrence of fog during the manufacture storage or photographic processing of the photographic material or for the purpose of stabilizing the photographic performance. Namely, many compounds known as antifogging agents or stabilizers such as azoles, for example, benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketo compounds, for example, oxazolinethione; azaindenes, for example, triazaindenes, tetraazaindenes (particularly, 4-hydroxy-substituted (1,3,3a,7)tetraazaindenes), pentaazaindenes; and various compounds known as antifoggant or stabilizer, such as benzenethiosulfonic acid, benzenesulfinic acid, benzenesulfonamide can be employed. Of these compounds, benzotriazoles (e.g., 5-methyl benzotriazole) and nitroindazoles (e.g., 5-nitroindazole) are preferred. Alternatively, these compounds may be incorporated into a processing solution.

Suitable development accelerators or accelerators for nucleating infectious development which can be used in the present invention are compounds as described, for example, in JP-A-53-77616, JP-A-54-37732, JP-A-53-137133, JP-A-60-140340 and JP-A-60-14959 and nitrogen- or sulfur-containing compounds can be effectively used.

The optimum amount of these accelerators varies depending on the type of compound, but they are generally use in an amount of from $1.0\times10^{-3}$ to 0.5 g/m$^2$, preferably from $5.0\times10^{-3}$ to 0.1 g/m$^2$.

The photographic emulsion layer and other hydrophilic colloid layers of the photographic material of the present invention may contain a desensitizer.

Organic desensitizers which can be used in the present invention are determined by the polarographic half wave potential (namely, oxidation-reduction potential determined by polarography) and are those where the sum of the polarographic anode potential and cathode potential is positive. A method for measuring oxidation-reduction potential by polarography is described, for example, in U.S. Pat. No. 3,501,307. It is preferred that the organic desensitizers have at least one water-soluble group such as a sulfonic acid group or a carboxyl group. The group may form a salt with an organic base (e.g., ammonia, pyridine, triethylamine, piperidine, or morpholine) or an alkali metal (e.g., sodium, or potassium).

Preferred organic desensitizers which can be used in the present invention include compounds represented by formulae (III) to (V) described in JP-A-63-133145.

The organic desensitizer is present in an amount of from $1.0\times10^{-8}$ to $1.0\times10^{-4}$ mol/m$^2$, particularly preferably from $1.0\times10^{-7}$ to $1.0\times10^{-5}$ mol/m$^2$, in the silver halide emulsion layer of the present invention.

The emulsion layer and other hydrophilic colloid layers of the present invention may contain water-soluble dyes as filter dyes or for the purpose of irradiation prevention or other various purposes. Examples of filter dyes are dyes for reducing photographic sensitivity, preferably ultraviolet light absorbers having a spectral absorption maximum in the region of sensitivity inherent in silver halide or dyes having substantial light absorption in the region of mainly 380 nm to 600 nm to enhance safety to a safelight in handling the photographic material in a light room.

Preferably, these dyes are added to the emulsion layer, or these dyes together with a mordant are added to the area above the silver halide emulsion layer and fixed therein. In other words, the dyes and the mordant are added to the light-insensitive hydrophilic colloid layer which is farther away from the support than the silver halide emulsion layer.

The amount of the ultraviolet light absorber which can be used varies depending on the molar absorption coefficient of the ultraviolet light absorber, but the dye is generally used in an amount of from $10^{-2}$ to 1 g/m$^2$, preferably from 50 to 500 mg/m$^2$.

The above-described ultraviolet light absorber is dissolved in an appropriate solvent [e.g., water, alcohol (e.g., methanol, ethanol, or propanol), acetone, methyl Cellosolve, or a mixture thereof] and are then added to a coating solution.

Suitable ultraviolet light absorbers which can be used are aryl group-substituted benzotriazole compounds, 4-thiazolidone compounds, benzophenone compounds, cinnamic ester compounds, butadiene compounds, benzoxazole compounds and ultraviolet light absorbing polymers.

Specific examples of suitable ultraviolet light absorbers are described, for example, in U.S. Pat. Nos. 3,533,794, 3,314,794 and 3,352,681, JP-A-46-2784, U.S. Pat. Nos. 3,705,805, 3,707,375, 4,045,229, 3,700,455 and 3,499,762 and West German Patent Publication No. 1,547,863.

Suitable examples of the filter dyes include oxonol dyes, hemioxonol dyes, styryl dyes, merocyanine dyes, cyanine dyes and azo dyes. Water-soluble dyes or dyes which can be decolorized by alkali or sulfite ion are preferred from the viewpoint of reducing the formation of residual color after development processing.

Specific examples of suitable dyes include pyrazolone oxonol dyes as described in U.S. Pat. No. 2,274,782; diaryl azo dyes as described in U.S. Pat. No. 2,956,879; styryl dyes and butadienyl dyes as described in U.S. Pat. Nos. 3,423,207 and 3,384,487; merocyanine dyes as described in U.S. Pat. No. 2,527,583; merocyanine dyes and oxonol dyes as described in U.S. Pat. Nos. 3,486,897, 3,652,284 and 3,718,472; enaminohemioxonol dyes as described in U.S. Pat. No. 3,976,661; and dyes as described in British patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

The dyes are dissolved in an appropriate solvent [e.g., water, alcohol (e.g., methanol, ethanol, or propanol), acetone, methyl Cellosolve, or a mixture thereof] and are then added to a coating solution for a light-insensitive hydrophilic colloid layer used in the present invention.

Specifically, the dye is used in an amount of generally from $10^{-3}$ to 1 g/m$^2$, particularly preferably from $10^{-3}$ to 0.5 g/m$^2$ of the photographic material The photographic emulsion layer and other hydrophilic colloid layers of the photographic material of the present invention may contain inorganic or organic hardening agents such as chromium salts, aldehydes (e.g., formaldehyde, or glutaraldehyde), N-methylol compounds (e.g., dimethylol urea), active vinyl compounds (e.g., 1,3,5-triacryloyl-hexahydro-s-triazine, or 1,3-vinylsulfonyl-2-propanol), active halogen compounds (e.g., 2,4-dichloro-6-hydroxy-s-triazine), or mucohalic acids. These compounds may be used either alone or in combination.

The photographic emulsion layer or other hydrophilic colloid layers of the photographic material of the present invention may contain surfactants as a coating aid or for antistatic properties, improve sliding properties and emulsified dispersion properties, prevent adhesion or improve photographic characteristics (e.g., development acceleration, sensitization, or high contrast). Particularly preferred examples of surfactants which can be used in the present invention are polyalkylene oxides having a molecular weight of 600 or more which are described in JP-B-58-9412. When the surfactants are to be used as antistatic agents, fluorine-containing surfactants (described in detail in U.S. Pat. No. 4,201,586, JP-A-60-80849, JP-A-59-74554) are particularly preferred.

The photographic emulsion layer and other hydrophilic colloid layers of the photographic material of the present invention may contain a matting agent such as silica, magnesium oxide, polymethyl methacrylate to prevent adhesion.

The photographic emulsion of the present invention may contain a dispersion of a water-insoluble or sparingly water-soluble synthetic polymer to improve dimensional stability. For example, polymers of alkyl (meth)acrylates, alkoxyalkyl (meth)acrylates, or glycidyl (meth)acrylates, singly or a mixture thereof, or copolymers thereof with a monomer component such as acrylic acid or methacrylic acid can be used for this purpose.

It is preferred that the silver halide emulsion layer and other layers of the photographic material of the present invention contain a compound having an acid group. Examples of compounds having an acid group include organic acids such as salicylic acid, acetic acid or ascorbic acid and polymers having a repeating unit of an acid monomer such as acrylic acid, maleic acid, or phthalic acid or copolymers containing these monomers. These compounds are described in JP-A-61-223834, JP-A-61-228437, JP-A-62-25745 and JP-A-62-55642. A particularly preferred low-molecular weight compound is ascorbic acid. Water-dispersible latexes of copolymers of an acid monomer such as acrylic acid with a crosslinking monomer having two or more unsaturated groups such as divinyl benzene are particularly preferred as high-molecular weight compounds.

A stable developing solution can be used to obtain superhigh-contrast, high-sensitive photographic characteristics by using the silver halide photographic material of the present invention without using a conventional infectious developing solution or a highly alkaline developing solution having a pH near 13 as described in U.S. Pat. No. 2,419,975.

The silver halide photographic material of the present invention provides a sufficiently superhigh-contrast negative image by using a developing solution having a pH of from 10.5 to 12.3, particularly from 11.0 to 12.0 and containing sulfite ion as a preservative at a concentration of not less than 0.15 mol/l.

Although there is no particular limitation with respect to developing agents which can be used in the developing solution of the present invention, it is preferred from the viewpoint of easily obtaining halftone dots of good quality that dihydroxybenzenes are present. Combinations of dihydroxybenzenes and 1-phenyl-3-pyrazolidones or combinations of dihydroxybenzenes and p-aminophenols can also be used. The developing agent is used in an amount of preferably from 0.05 to 0.8 mol/l. When combinations of dihydroxybenzenes and 1-phenyl-3-pyrazolidones or p-aminophenols are used, the former is used in an amount of from 0.05 to 0.5 mol/l and the latter is used in an amount of preferably from not more than 0.06 mol/l.

Sulfite preservatives which are used in the present invention include sodium sulfite, potassium sulfite, lithium sulfite, ammonium sulfite, sodium bisulfite, potassium metabisulfite and formaldehydesodium bisulfite. The sulfite is used in an amount of not less than 0.4 mol/l, particularly preferably not less than 0.5 mol/l.

Compounds as described in JP-A-56-24347 can be used as silver stain inhibitors in the developing solution used in the present invention. The compounds as described in JP-A-61-267759 can be used as dissolution aids in the developing solution. The compounds as described in JP-A-60-93433 and JP-A-62-186259 can be used as pH buffer agents to be used in the developing solution.

The compound represented by formula (I) can be used in combination with a negative type emulsion to provide high-contrast photographic materials as described above. In addition, the compound of the general formula (I) can be used in combination with an internal latent image type silver halide emulsion, and embodiments therefor are illustrated below. It is preferred that the compound represented by formula (I) is incorporated in the internal latent image type silver halide emulsion layer. However, the compound may be incorporated into a hydrophilic colloid layer adjacent the internal latent image type silver halide emulsion layer. Such a layer includes a coloring material layer, an intermediate layer, a filter layer, a protective layer and an antihalation layer. The layer may be a layer having any function, so long as the diffusion of the nucleating agent to silver halide grains is not inhibited.

The content of the compound represented by formula (I) in the layer can vary depending on the characteristic of the silver halide emulsion to be used, the chemical structure of the nucleating agent and developing conditions. Hence, a suitable amount may vary widely, but the amount of the compound is generally in the range of from about 0.005 mg to 500 mg per mol of silver in the internal latent image type silver halide emulsion, preferably in the range of from about 0.01 mg to about 100 mg per mol of silver. When the compound is to be incorporated into the hydrophilic colloid layer adjacent the emulsion layer, the same amount as that described above in connection with the amount of silver present in the same area as that of the internal latent image type emulsion layer may be used. The definition of an internal latent image type silver halide emulsion is described in JP-A-61-170733 (page 10, upper column) and British Patent 2,089,057 (pages 18 to 20).

Preferred internal latent image type emulsions which can be used in the present invention are described in JP-A-63-108336 and preferred silver halide grains are described in JP-A-63-108336.

The internal latent image type emulsion used in the photographic material of the present invention may be spectral-sensitized to relatively long-wave blue light, green light, red light or infrared light using sensitizing dyes. Examples of suitable sensitizing dyes which can be used include cyanine dyes, merocyanine dyes, complex cyanine dyes, complex merocyanine dyes, holopolar cyanine dues, styryl dyes, hemicyanine dyes, oxonol dyes and hemioxonol dyes. Cyanine dyes and merocyanine dyes as described in JP-A-59-40638, JP-A-59-40636 and JP-A-59-38739 are included within these sensitizing dyes.

Developing agents such as hydroxybenzenes (e.g., hydroquinone), aminophenols or 3-pyrazolidones may be incorporated into the emulsion layer of the photographic material in the present invention.

The photographic emulsion which is used in the present invention can be used in combination with a dye image providing compound (coloring material) for the color diffusion transfer process, where this compound is capable of releasing a diffusing dye corresponding to the development of silver halide, to obtain a desired transferred image on an image receiving layer after appropriate development processing. Many coloring materials for the color diffusion transfer process are known. Preferred coloring materials (hereinafter referred to as DRR compound) are those which are initially nondiffusible, but are cleaved by the oxidation-reduction reaction with the oxidation product of developing agent (or electron transfer agent) to release a diffusing dye. Of these compounds, DRR compounds having an N-substituted sulfamoyl group are preferred. Particularly preferred DRR compounds suitable for use in combination with the nucleating agent of the present invention are DRR compounds having an o-hydroxyarylsulfamoyl group as described, for example, in U.S. Pat. Nos. 4,055,428, 4,053,312 and 4,336,322 and DRR compounds having a redox patent nucleus as described in JP-A-53-149328. When used in combination with such DRR compounds, temperature dependence during processing in particular is remarkably low.

Specific examples of DRR compounds in addition to those described in the above-mentioned patent specifications include magenta dye image forming materials such as 1-hydroxy-2-tetramethylenesulfamoyl-4-[3'-methyl-4'-(2''-hydroxy-4''-methyl-5''-hexadecyloxyphenylsulfamoyl)phenylazo]naphthalene and yellow dye image forming materials such as 1-phenyl-3-cyano-4-(2''',4'''-di-tert-pentylphenoxyacetamino)phenylsulfamoyl]phenylazo)-5-pyrazolone.

It is preferred that after the photographic material of the present invention is imagewise exposed, a direct positive color image is formed by carrying out color development with a surface developing solution having a pH of 11.5 or less and containing an aromatic primary amine color developing agent after or while a fogging treatment is carried out by light or a nucleating agent, and conducting bleaching and fixing treatments. It is more preferred for the pH of the developing solution to be in the range of 10.0 to 11.0.

The fogging treatment used in the present invention may be carried out by a so-called light fogging method wherein a second exposure is applied to the entire surface of the light-sensitive layer or by a so-called chemical fogging method wherein development is carried out in the presence of a nucleating agent. If desired, development may be conducted in the presence of a nucleating agent and fogging light, or a photographic material containing a nucleating agent may be subjected to a fogging exposure.

The light fogging method is described in JP-A-63-108336 (page 47 line 4 to page 49 line 5). Nucleating agents which can be used in the present invention are described in JP-A-63-108336 (page 49 line 6 to page 67 line 2). The compounds represented by the general formulae [N-1] and [N-2] are particularly preferred. Specific examples of these compounds are Compounds [N-I-1] to [N-I-10] described on pages 56 to 58 and Compounds [N-II-1) to [N-II-12] described on pages 63 to 66 of JP-A-63-108336.

Nucleation accelerating agents which can be used in the present invention are described in JP-A-63-108336 (page 68, line 11 to page 71, line 3). Preferred examples thereof are the compounds represented by (A-1) to (A-13) described in JP-A-63-108336 (pages 69 to 70). Color developing solutions which can be used in development processing of the photographic material of the present invention are described in JP-A63-108336 (page 71, line 4 to page 72, line 9). Particularly preferred examples of aromatic primary amine color developing agents include p-phenylenediamine compounds. Typical examples of p-phenylenediamine compounds include 3-methyl-4-amino-N-ethyl-N-(β-methanesulfonamidoethyl)-aniline, 3-methyl-4-amino-N-ethyl-N-(β-hydroxyethyl)-aniline, 3-methyl-4-amino-N-ethyl-N-methoxyethylaniline and salts thereof such as sulfate and hydrochloride.

In addition to the above described color developing agents, black-and-white developing agents such as phenidone derivatives can be used to form direct positive color images by a color diffusion transfer process using the photographic material of the present invention.

After color development, the photographic emulsion layer is generally bleached. Bleaching and fixing may be carried out simultaneously with one bath for bleaching-fixing, or they may be separately carried out. After bleaching, a bleaching-fixing may be conducted to expedite processing. After fixing, a bleaching-fixing may be carried out. Generally, iron complex salts of aminopolycarboxylic acids are used as bleaching agents for the bleaching solution or bleaching-fixing solution of the present invention. The bleaching solution or bleaching-fixing solution of the present invention may contain various additives. For example, the compounds as described in JP-A-62-215272 can be used as additives. After desilverization (bleaching-fixing or fixing), water washing and/or stabilizing are/is carried out. Preferably, a water softening treatment is used for the washing water or the stabilizing solution. Examples of methods for softening water include methods using ion exchange resins or reverse osmosis as described in JP-A-62-288838. Specifically, these methods are preferably carried our according to the methods described in JP-A-62-288838.

Various compounds as described in JP-A-62-215272 (pages 30 to 36) can be used as additives for the water washing stage and the stabilizing stage.

It is preferred for the amount of replenisher in each processing stage to be as small as possible. The amount of the replenisher per unit area of photographic material is preferably from 0.1 to 50 times, more preferably from 3 to 30 times, the amount carried over from the previous bath.

The application of the present invention to color photographic light-sensitive materials are described in greater detail below.

The color photographic light-sensitive material according to the present invention may have at least one blue-sensitive silver halide emulsion layer, at least one green-sensitive silver halide emulsion layer and at least one red-sensitive silver halide emulsion layer on a support. The number of silver halide emulsion layers and light-insensitive layers and the order thereof are not particularly restricted. One typical example is a silver halide photographic material comprising a support having thereon at least one light-sensitive layer group composed of a plurality of silver halide emulsion layers which have substantially the same spectral sensitivity but different speeds. The light-sensitive layer group can be a unit light-sensitive layer having a spectral sensitivity to any of blue light, green light and red light. In a multilayer silver halide color photographic material, unit light-sensitive layers are generally provided in the order of a red-sensitive layer, a green-sensitive layer and a blue-sensitive layer from the support side on the support. The order of these layers can be varied depending on the purpose. Further, a layer structure wherein a light-sensitive layer having a different spectral sensitivity is sandwiched between two layers having the same spectral sensitivity may be used.

Between the above described silver halide light-sensitive layers or as the uppermost layer or the undermost layer, various light-insensitive layers can be present as an intermediate layer can be provided.

Couplers and DIR compounds as described, for example, in JP-A-61-43748, JP-A-59-113438, JP-A-59-113440, JP-A-61-20037 and JP-A-61-20038 may be incorporated into such an intermediate layer. Further, the intermediate layer may contain color mixing preventing agents conventionally employed.

The plurality of silver halide emulsion layers which form the unit light-sensitive layer preferably have a two layer construction comprising a high speed emulsion layer and a low speed emulsion layer as described, for example, in West German Patent 1,121,470 and British Patent 923,045. It is preferred that these layers be disposed in order of increasing speed from the support. Further, a light-insensitive layer may be provided between the silver halide emulsion layers. Moreover, a low speed emulsion layer may be provided further away from the support and a high speed emulsion layer may be provided on the side closest to the support as described, for example, in JP-A-57-112751, JP-A-62-200350, JP-A-62-206541 and JP-A-62-206543.

Specific examples of layer constructions which can be used include an order of a low speed blue-sensitive layer (BL)/a high speed blue-sensitive layer (BH)/a high speed green-sensitive layer (GH)/a low speed green-sensitive layer (GL)/a high speed red-sensitive layer (RH)/a low speed red-sensitive layer (RL) from the farthest from the support, an order of BH/BL/GL/GH/RH/RL, or an order of BH/BL/GH/GL/RL/RH.

Further, the order of a blue-sensitive layer/GH/RH/GL/RL from the farthest from the support as described in JP-B-55-34932 may be employed. Moreover, the order of a blue-sensitive layer/GL/RL/GH/RH from the farthest from the support as described in JP-A-56-25738 and JP-A-62-63936 may also employed.

Furthermore, a layer construction of three layers having different speeds comprising an upper silver halide emulsion layer having the highest speed, an intermediate silver halide emulsion layer having lower speed than that of the upper layer, and an under silver halide emulsion layer having lower speed than that of the intermediate layer in order of increasing speed from the support as described in JP-B-49-15495 can also be employed. In the case wherein the unit light-sensitive layer of the same spectral sensitivity is composed of three layers having different speeds, the order of an intermediate speed emulsion layer/a high speed emulsion layer/a low speed emulsion layer from the farthest from the support may be employed as described in JP-A-59-202464.

In addition, the order of a high speed emulsion layer/a low speed emulsion layer/an intermediate speed emulsion layer, or the order of a low speed emulsion layer/an intermediate speed emulsion layer/a high speed emulsion layer may be employed.

Where four layers or more are employed, the order can be varied as described above.

In order to improve color reproducibility, it is preferred that a donor layer (CL) providing an interimage effect having a spectral sensitivity distribution different from that of the main light-sensitive layer such as BL, GL or RL is provided adjacent or close to the main layer as described, for example, in U.S. Pat. Nos. 4,663,271, 4,705,744 and 4,707,436, JP-A-62-160448 and JP-A-63-89580.

As described above, various layer constructions and dispositions may be appropriately selected depending on the purpose of the photographic light-sensitive material.

Where the color photographic light-sensitive material of the present invention is a color negative film or a color reversal film, the silver halide preferably employed in the photographic emulsion layers thereof is silver iodobromide, silver iodochloride or silver iodochlorobromide each containing about 30 mol % or less of silver iodide. Silver iodobromide or silver iodochlorobromide each containing from about 2 mol % to about 25 mol % of silver iodide is particularly preferred.

Where the color photographic light-sensitive material of the present invention is a color printing paper, the silver halide preferably employed in the photographic emulsion layers thereof is silver chlorobromide or silver chloride each containing substantially no silver iodide. The terminology "containing substantially no silver iodide" as used herein means that the silver iodide content of the emulsion is not more than 1 mol %, preferably not more than 0.2 mol %.

With respect to the halogen composition of the silver chlorobromide emulsion, any silver bromide/silver chloride ratio may be employed. The ratio may vary widely depending on the purpose, but emulsions having a silver chloride content of 2 mol % or more are preferably employed.

A so-called high silver chloride content emulsion which has a high silver chloride content ratio is preferably used in photographic light-sensitive materials suitable for rapid processing. The silver chloride content in such a high silver chloride content emulsion is preferably 90 mol % or more, more preferably 95 mol % or more.

Further, for the purpose of reducing the amount of replenisher for the developing solution, an almost pure silver chloride emulsion such as one wherein the silver chloride content is from 98 mol % to 99.9 mol % is preferably employed.

The silver halide grains in the silver halide emulsion may have a regular crystal structure, for example, a cubic, octahedral or tetradecahedral structure, an irregular crystal structure, for example, a spherical or tabular structure, a crystal defect, for example, a twin plane, or a composite structure thereof.

The particle size of the silver halide may vary and may range from fine grains having a size of about 0.2 micron or less to large size grains having a size of about 10 microns as a diameter of the projected area of the grains. Further, a polydispersed emulsion and a monodispersed emulsion may be used.

The silver halide photographic emulsion which can be used in the present invention can be prepared using known methods, for example, those as described in *Research Disclosure,* No. 17643 (December, 1978), pages 22 to 23, "I. Emulsion Preparation and Types" and ibid., No. 18716 (November, 1979), page 648, P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964).

Monodispersed emulsions as described, for example, in U.S. Pat. Nos. 3,574,628 and 3,655,394, and British Patent 1,413,748 are preferably used in the present invention.

Further, tabular silver halide grains having an aspect ratio of about 5 or more can be employed in the present invention. The tabular grains may be easily prepared by the method as described, for example, in Gutoff, *Photographic Science and Engineering,* Vol. 14, pages 248 to 257 (1970), U.S. Pat. Nos. 4,434,226, 4,414,310, 4,433,048 and 4,439,520, and British Patent 2,112,157.

The crystal structure of the silver halide grains may be uniform, composed of different halide compositions between the inner portion and the outer portion, or may have a stratified structure.

Further, the silver halide emulsions in which silver halide grains having different compositions are connected at epitaxial junctions or silver halide emulsions in which silver halide grains are connected with compounds other than silver halide, such as silver thiocyanate, or lead oxide, may also be employed.

Moreover, a mixture of grains having a different crystal structure may be used.

The silver halide emulsions used in the present invention are usually physically ripened, chemically ripened and spectral sensitized. Various kinds of additives which can be employed in these steps are described in *Research Disclosure,* No. 17643, (December, 1978) and ibid., No. 18716 (November, 1979) and information as to these additives are summarized in the table shown below.

In the present invention, it is preferred to employ a light-insensitive fine grain silver halide. The terminology "light-insensitive fine grain silver halide" means silver halide fine grains which are not sensitive to light at the time of imagewise exposure for obtaining dye images and are not substantially developed on development processing. These silver halide fine grains are preferably those previously not fogged.

The fine grain silver halide has a silver bromide content of from 0 to 100 mol %, and may contain silver chloride and/or silver iodide, if desired. Preferred silver halides are those containing from 0.5 to 10 mol % of silver iodide.

The fine grain silver halide has preferably an average grain size (the average value of the diameter corresponding to a circle of the projected area) of from 0.01 to 0.5 μm, more preferably from 0.02 to 0.2 μm.

The fine grain silver halide can be prepared by the same methods as those for conventional light-sensitive silver halide. The surface of the silver halide grain does not need to b optically sensitized. Spectral sensitization is also not needed. However, it is preferred to add previously a known stabilizer, for example, a traizole compound, an azaindene compound, a benzothiazolium compound, a mercapto compound, or a zinc compound to the fine grain silver halide before it is added to the coating solution.

Further, known photographic additives which can be used in the present invention are also described in the above mentioned literature and information relative thereof are summarized in the table below.

| Kind of Additives | RD 17643 | RD 18716 |
|---|---|---|
| 1. Chemical Sensitizers | Page 23 | Page 648, right column |
| 2. Sensitivity Increasing Agents | | Page 648, right column |
| 3. Spectral Sensitizers and Supersensitizers | Pages 23 to 24 | Page 648, right column to page 649, right column |
| 4. Whitening Agents | Page 24 | |
| 5. Antifoggants and Stabilizers | Pages 24 to 25 | Page 649, right column |
| 6. Light-Absorbers, Filter Dyes and Ultraviolet Ray Absorbers | Pages 25 to 26 | Page 649, right column to page 650, left column |
| 7. Antistaining Agents | Page 25, right column | Page 650, left column to right column |
| 8. Dye Image Stabilizers | Page 25 | |
| 9. Hardeners | Page 26 | Page 651, left column |
| 10. Binders | Page 26 | Page 651, left column |
| 11. Plasticizers and Lubricants | Page 27 | Page 650, right column |
| 12. Coating Aids and Surfactants | Pages 26 to 27 | Page 650, right column |
| 13. Antistatic Agents | Page 27 | Page 650, right column |

Further, in order to prevent degradation of the photographic properties due to formaldehyde gas, it is preferred to add a compound capable of reacting with formaldehyde as described in U.S. Pat. Nos. 4,411,987 and 4,435,503 to the photographic light-sensitive material.

Various color couplers can be employed in the present invention, and specific examples thereof are described in the patents cited in *Research Disclosure,* No. 17643, "VII-C" to "VII-G".

Suitable preferred yellow couplers which can be used in the present invention, for example, are those as described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A.

Suitable preferred magenta couplers, which can be used in the present invention are 5-pyrazolone type and pyrazoloazole type compounds. The magenta couplers as described, for example, in U.S Pat. Nos. 4,310,619 and 4,351,897, European Patent 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, and U.S. Pat. Nos. 4,500,630, 4,540,654 and 4,556,630, and WO(PCT) 88/04795 are particularly preferred.

Examples of cyan couplers which can be used in the present invention are phenol type and naphthol type couplers. Cyan couplers as described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred.

Colored couplers for correcting undesirable absorption of dyes formed are those as described, for example, in *Research Disclosure,* No. 17643, "VII-G", U.S. Pat. No. 4,163,670, JP-B-57-39413, U.S. Pat. Nos. 4,004,929 and 4,138,258, and British Patent 1,146,368 are preferably employed. It is also preferred to use couplers for correcting undesirable absorption of dyes formed by a fluorescent dye released upon coupling as described, for example, in U.S. Pat. No. 4,774,181, or couplers having a dye precursor group capable of forming a dye upon a reaction with a developing agent, as a releasing group, as described, for example, in U.S. Pat. No. 4,777,120.

Examples of couplers capable of forming appropriately diffusible dyes are those as described, for example, in U.S. Pat. No. 4,366,237, British Patent 2,125,570, European Patent 96,570, and West German Patent Application (OLS) No. 3,234,533 and these are preferred.

Typical examples of polymerized dye forming couplers are described, for example, in U.S. Pat. Nos. 3,451,820, 4,080,211, 4,367,282, 4,409,320 and 4,576,910, and British Patent 2,102,173.

Couplers capable of releasing a photographically useful moiety during the course of coupling can be also employed advantageously in the present invention. Preferred DIR couplers capable of releasing a development inhibitor are those as described, for example, in the patents cited in *Research Disclosure,* No. 17643, "VII-F"0 described above, JP-A-57-151944, JP-A-57-154234, JP-A-60-184248, JP-A-63-37346, JP-A-63-37350, and U.S. Pat. Nos. 4,248,962 and 4,782,012.

Preferred couplers which release imagewise a nucleating agent or a development accelerator at the time of development those as described, for example, in British Patents 2,097,140 and 2,131,188, JP-A-59-157638, and JP-A-59-170840.

Furthermore, competing couplers such as those described, for example, in U.S. Pat. No. 4,130,427; polyequivalent couplers such as those described, for example, in U.S. Pat. Nos. 4,283,472, 4,338,393 and 4,310,618; DIR redox compounds or DIR coupler releasing couplers or DIR couplers or DIR redox compounds releasing redox compounds such as those described, for example, in JP-A-60-185950 and JP-A-62-24252; couplers capable of releasing a dye which becomes colored after being released such as those described, for example, in European Patents 173,302A and 313,308A; bleach accelerator releasing couplers such as those described, for example, in *Research Disclosure,* No. 11449, ibid, No. 24241 and JP-A 61-201247; ligand releasing couplers such as those described, for example, in U.S. Pat. No. 4,555,477; couplers capable of releasing a leuco dye such as those described, for example, in JP-A-63-75747; and couplers capable of releasing a fluorescent dye such as those described, for example, in U.S. Pat. No. 4,774,181 may be employed in the photographic light-sensitive material of the present invention.

The couplers which can be used in the present invention can be introduced into the photographic light-sensitive material using various known dispersion methods.

Suitable examples of organic solvents having a high boiling point which can be employed in an oil droplet-in-water type dispersion method are described, for example, in U.S. Pat. No. 2,322,027.

Specific examples of organic solvents having a high boiling point of 175° C. or above at normal pressure and can be employed in the oil droplet-in-water type dispersion method include phthalic acid esters (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl) isophthalate, or bis(1,1-diethylpropyl)phthalate, phosphonic acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, or di-2-ethylhexyl phenylphosphonate), benzoic acid esters (for example, 2-ethylhexyl benzoate, dodecyl benzoate, or 2-ethylhexyl-p-hydroxybenzoate), amides (for example, N,N-diethyldodecanamide, N,N-diethyllaurylamide, or N-tetradecylpyrrolidone), alcohols or phenols (for example, isostearyl alcohol, or 2,4-di-tert-amylphenol), aliphatic carboxylic acid esters (for example, bis(2-ethylhexyl)-sebacate, dioctyl azelate, gycerol tributyrate, isostearyl lactate, or trioctyl citrate), aniline derivatives (for example, N,N-dibutyl-2-butoxy-5-tert-octylaniline), and hydrocarbons (for example, paraffin, dodecylbenzene, or diisopropylnaphthalene).

Further, an organic solvent having a boiling point at least about 30° C. and preferably having a boiling point above 50° C. but below about 160° C. can be used as an auxiliary solvent. Typical examples of auxiliary solvents include ethyl acetate, butyl acetate, ethyl propionate, methyl ethyl ketone, cyclohexanone, 2-ethoxyethyl acetate, or dimethylformamide.

The processes and effects of latex dispersing methods and specific examples of latexes for loading are described, for example, in U.S. Pat. No. 4,199, West German Patent Application (OLS) Nos. 2,541,274 and 2,541,230.

Further, these couplers can be emulsified and dispersed in an aqueous solution of a hydrophilic colloid by loading them into a loadable latex polymer (such as those described in U.S. Pat. No. 4,203,716) in the presence of or in the absence of the above described organic solvent having a high boiling point, or dissolving them in a water-insoluble and organic solvent-soluble polymer.

Suitable examples of these polymers include homopolymers and copolymers as described in International Laid Open No. WO 88/00723, pages 12 to 30. Particularly, acrylamide polymers are preferably used in view of the improved color image stability obtained.

It is preferred to add various kinds of antiseptics or antimolds, for example, 1,2-benzisothiazolin-3-one, n-butyl p-hydroxybenzoate, phenol, 4-chloro-3,5-dimethylphenol, 2-phenoxyethanol, or 2-(4-thiazolyl) benzimidazole, as described, for example, in JP-A-63-257747, JP-A-62-272248 and JP-A-1-80941 to the color photographic light-sensitive material of the present invention.

The present invention can be applied to various color photographic light-sensitive materials, and typical examples thereof include color negative films for general use or cinematography, color reversal films for slides or television, color papers, color positive films, and color reversal papers.

Suitable supports which can be used in the present invention are described, for example, in *Research Disclosure,* No. 17643, page 28 and ibid., No. 18716, page 647, right column to page 648, left column, as mentioned above.

It is preferred for the total layer thickness of all of the hydrophilic colloid layers provided on the emulsion layer side of the photographic light-sensitive material according to the present invention to be 28 μm or less, more preferably 23 μm or less, further more preferably 18 μm or less, and particularly preferably 16 μm or less. Also, a layer swelling rate of $T_{\frac{1}{2}}$ is preferably 30 seconds or less, more preferably 20 seconds or less. The layer thickness is the thickness of the layer measured after storage under conditions of 25° C. and a relative humidity of 55% for 2 days. The layer swelling rate of $T_{\frac{1}{2}}$ is determined using a well known methods in this field. For instance, the degree of swelling can be measured using a swellometer of the type described in A. Green, *Photogr. Sci. Eng.,* Vol. 19, No 2, page 124 to 129, and $T_{\frac{1}{2}}$ is defined as the time necessary for the layer thickness to reach a saturated layer thickness which is 90% of the maximum swelling layer thickness obtained when treated in a color developing solution at 30° C. for 3 minutes and 15 seconds.

The layer swelling rate of $T_{\frac{1}{2}}$ can be controlled by adding a hardening agent to a gelatin binder or changing the aging conditions after coating.

The rate of swelling is preferably from 150% to 400%. The rate of swelling factor can be calculated by the formula (maximum swelling layer thickness − layer thickness)/layer thickness wherein the maximum swelling layer thickness has the same meaning as defined above.

The color photographic light-sensitive material according to the present invention can be development processed in a conventional manner as described in *Research Disclosure,* No. 17643, pages 28 to 29 and ibid., No. 18716, page 615, left column to right column, as mentioned above.

The color developing solution which can be used in the development processing of the color photographic light-sensitive material according to the present invention is an alkaline aqueous solution containing preferably an aromatic primary amine type color developing agent as a main component. While an aminophenol type compound is useful, as the color developing agent, a p-phenylenediamine type compound is preferably employed. Typical examples of p-phenylenediamine type compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, or sulfate, hydrochloride or p-toluenesulfonate thereof. Of these compounds, 3-methyl-4-amino-N-ethyl-N-β-hydroxyethylaniline sulfate is particularly preferred.

Two or more kinds of color developing agents may be employed in a combination thereof, if desired, depending on the purpose.

The color developing solution ordinarily contains pH buffering agents, such as carbonates, borates or phosphates of alkali metals; and development inhibitors or anti-fogging agents such as chlorides, bromides, iodides, benzimidazoles, benzothiazoles, or mercapto compounds. Further, if desired, the color developing solution may contain various preservatives, for example, hydroxylamine, diethylhydroxylamine, sulfites, hydrazines such as N,N-biscarboxymethylhydrazine, phenylsemicarbazides, triethanolamine, or catechol sulfonic acids; organic solvents such as ethyleneglycol, or diethylene glycol; development accelerators such as benzyl alcohol, polyethylene glycol, quarternary ammonium salts, or amines; dye forming couplers; competing couplers; auxiliary developing agents such as 1 phenyl-3-pyrazolidone; viscosity imparting agents; and various chelating agents representatively illustrated by aminopolycarboxylic acids, aminopolyphosphonic acids, alkylphosphonic acids, or phosphonocarboxylic acids. Representative examples of chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and the salts thereof.

In conducting reversal processing, color development is usually conducted after black-and-white development. Known black-and-white developing agents, for example, dihydroxybenzenes such as hydroquinone, 3-pyrazolidones such as 1-pheyl-3-pyrazolidone, or aminophenols such as N-methyl-p-aminophenol may be employed individually or in combination in a black-and-white developing solution.

The pH of the color developing solution or the black-and-white developing solution is usually 9 to 12. Further, the amount of replenishment for the developing solution can be varied depending on the color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In reducing the amount of replenishment, it is preferred to prevent evaporation and aerial oxidation of the processing solution by reducing the area of the processing tank which is contact with the air.

The contact area of the photographic processing solution with air in the processing tank can be represented by an opening rate defined as below.

$$\text{Opening Rate} = \frac{\text{Contact area of processing solution with the air (cm}^2\text{)}}{\text{Volume of processing solution (cm}^3\text{)}}$$

The opening rate described above is preferably not more than 0.1, more preferably from 0.001 to 0.05. Means for reducing the opening rate include a method using a movable cover as described in JP-A-1-82033, a slit development processing method as described in JP-A-63-216050, in addition to a method wherein a floating cover is provided on the surface of the photographic processing solution in a processing tank. It is preferred to reduce the opening rate not only for the steps of color development and black-and-white development but also to all other subsequent steps, for example, bleaching, bleach-fixing, fixing, washing with water and stabilizing.

Further, the amount of replenishment can be reduced using means which restrain accumulation of bromide ion in the developing solution.

The processing time for color development is usually in a range from 2 minutes to 5 minutes. However, it is possible to further reduce the processing time by performing the color development at high temperature and at high pH using a high concentration of color developing agent.

After color development, the photographic emulsion layers are usually subjected to a bleach processing. The bleach processing can be performed simultaneously with a fix processing (bleach-fix processing), or it can be performed independently from the fix processing. Further, for the purpose of rapid processing, a processing method wherein, after a bleach processing, a bleach-fix processing is conducted may be employed. Moreover, depending on the purpose to the process a continuous two tank bleach-fixing bath, fix processing before bleach-fix processing, or to conduct bleach processing after bleach-fix processing can be the approach used.

Examples of bleaching agents which can be employed in the bleach processing or bleach-fix processing include compounds of a multivalent metal such as iron(III); peracids; quinones; or nitro compounds. Representative examples of bleaching agents include organic complex salts of iron(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts with organic acids (such as citric acid, tartaric acid, or malic acid). Of these compounds, iron(III) complex salts of aminopolycarboxylic acids, illustrated by the iron(III) complex salt of ethylenediaminetetraacetic acid and iron(III) complex salt of 1,3-diaminopropanetetraacetic acid, are preferred for rapid processing and less environmental pollution. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of an aminopolycarboxylic acid is usually in a range from 4.0 to 8. For the purpose of rapid processing, it is possible to process at a pH lower than the above described range.

A bleach accelerating agent can be used, if desired, in the bleaching solution, the bleach-fixing solution or a prebath thereof. Specific examples of suitable bleach accelerating agents include compounds having a mercapto group or a disulfide bond as described, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure,* No. 17129 (July 1978); thiazolidine derivatives as described, for example, in JP-A-50-140129; thiourea derivatives as described, for example, in JP-B-45-8506, JP-A-52-20832, JP-A-53-32735 and U.S. Pat. No. 3,706,561; iodides as described, for example, in West German Patent 1,127,715 and JP-A-58-16235; polyoxyethylene compounds as described, for example, in West German Patents 966,410 and 2,748,430; polyamine compounds as described, for example, in JP-B-45-8836; compounds as described, for example, in JP-A-49-40943, JP-A-49-59644, JP-A-53-94927, JP-A-54-35727, JP-A-55-26506, and JP A-58-163940; and bromide ions. Of these compounds, compounds having a mercapto group or a disulfide bond are preferred in view of their high bleach accelerating effects. Particularly, the compounds as described in U.S. Pat. No. 3,893,858, West German Patent 1,290,812 and JP-A-53-95630 are preferred. Further, the compounds as described in U.S. Pat. No. 4,552,834 are also preferred. These bleach accelerating agents may be incorporated also into the color photographic light-sensitive material. These bleach accelerating agents are particularly effectively employed when color photographic light sensitive materials for photographing are subjected to bleach-fix processing.

An organic acid is preferably incorporated in for the bleaching solution or bleach-fixing solution, the purpose of preventing bleach stain. Particularly preferred organic acids are compounds having an acid dessociation constant (pKa) from 2 to 5 and include specifically, for example, acetic acid and propionic acid.

Thiosulfates, thiocyanates, thioether compounds, thioureas, or a large amount of iodide can be employed as fixing agents in the fixing solution or bleach-fixing solution. Of these compounds, thiosulfates are generally employed. Particularly, ammonium thiosulfate is most widely employed. Combinations of thiosulfates with either thiocyanates, thioether compounds or thioureas are also preferably employed. It is preferred to use sulfites, bisulfites, carbonylbisulfite adducts or sulfinic acid compounds as described in European Patent 294,769A as preservatives in the fixing solution or bleach-fixing solution. Moreover, it is preferred to add various aminopolycarboxylic acids and organic phosphonic acids to the fixing or bleach-fixing solution for the purpose of stabilization of the solution.

The shorter is the total time required for the desilvering step the more preferable so long as inferior desilvering does not occur. Thus, the processing time for the desilvering step is preferably from 1 minute to 3 minutes, more preferably from 1 minute to 2 minutes. The processing temperature is from 25° to 50° C., preferably 35° to 45° C. The desilvering rate increases and the occurrence of stain after processing is effectively prevented in the preferred processing temperature range.

It is preferred to perform stirring as strong as possible in the desilvering step.

Specific examples of methods for improving the stirring include a method wherein a jet of the processing solution is allowed to stribe the emulsion surface of the light-sensitive material as described in JP-A-62-183460, a method for increasing stirring effect using a rotating means as described in JP-A-62-183461, a method for increasing the stirring effect by transferring the light-sensitive material while bringing the emulsion surface thereof into contact with a wiper blade provided in the solution to form a turbulent flow at the emulsion surface, and a method of increasing the circulation flux of the total processing solution. These means for increasing the stirring are effective in any of the bleaching solution, bleach-fixing solution and fixing solution. It is believed that improvement in stirring promotes the supply of the bleaching agent and the fixing agent to the emulsion layer, resulting in an increase in the desilvering rate.

Further, the above-described means for strengthening stirring are more effective in using a bleach accelerating agent and are to remarkably increase its accelerating effect or to eliminate fixing hindrance functions due to the bleach accelerating agent.

The automatic developing machine which can used for the processing of photographic light-sensitive material of the present invention is preferably provided with a transport means for the light-sensitive material of described in JP-A-60-191257, JP-A-60-191258 and JP-A-60-191259. As described in JP-A-60-191257, such a transport means can greatly reduce the amount of processing solution carried over from the preceding bath to a later bath and degradation of the processing solution is effectively prevented. This effect is particularly useful for reducing the processing time of each step and reducing the replenishment amount of the processing solution of each step.

After the desilvering step, the silver halide color photographic material according to the present invention is generally subjected to a water washing step and/or a stabilizing step.

The amount of water required for the water washing step may vary widely depending on the characteristics of the photographic light-sensitive materials (i.e.) the elements used therein, for example, couplers), the uses thereof, the temperature of the washing water, the number of water washing tanks (stages), the replenishment system such as countercurrent or direct current, or other various conditions. The relationship between the number of water washing tanks and the amount of water in a multi-stage countercurrent system can be determined using the method as described in *Journal of the Society of Mothion Picture and Television Engineers,* Vol. 64, pages 248 to 253 (May, 1955).

According to the multi-stage countercurrent system described above, the amount o water for washing can be significantly reduced. However, an increase in the residence time of the water in the tank cause a propagation of bacteria and problems occur such as adhesion of scum formed on the photographic materials. In the method of processing the silver halide color photographic material according to the present invention, a method for reducing the amount of calcium ions and magnesium ions as described in JP-A-62-288838 can be particularly effectively employed in order to solve these problems. Further, sterilizers, for example, isothiazolone compounds as described in JP-A-57-8542, thiabendazoles, chlorine type sterilizers such as sodium chloroisocyanurate, benzotriazoles, sterilizers as described in Hiroshi Horiguchi, *Bokin-Bobai No Kagaku* (Sankyo Shuppan, 1986), *Biseibutsu No Mekkin-, Sakkin-, Bobai-Gijutsu,* edited by Eiseigijutsu Kai (1982), and *Bokin-Bobaizai Jiten,* edited by Nippon Bokin-Bobai Gakkai (1986) can be employed.

The pH of the washing water used in the processing of the photographic light-sensitive materials according to the present invention is usually from 4 to 9, preferably from 5 to 8. The temperature of washing water and the time for water washing can vary widely depending on the characteristics of or uses of the photographic light-sensitive materials. However, it is generally in a range of from 15° C. to 45° C. for a period from 20 sec. to 10 min. and preferably in a range of from 25° C. to 40° C. for a period from 30 sec. to 5 min.

The photographic light-sensitive material of the present invention can also be directly processed with a stabilizing solution in place of the above-described water washing step. Any of known methods as described, for example, in JP-A-57-8543, JP-A-58-14834 and JP-A-60-220345 can be employed as such a stabilizing process.

Further, it is possible to conduct the stabilizing process subsequent to the above-described water washing process. One example thereof is a stabilizing bath containing a dye stabilizer and a surface active agent, which is employed as a final bath in the processing of color photographic light-sensitive materials for photography. Examples of dye stabilizers include aldehydes such as formaldehyde or glutaraldehyde, N-methylol compounds, hexamethylenetetramine, and aldehyde sulfite adducts. Various chelating agents and antimolds may also be added to these stabilizing bath.

Overflow solutions resulted from replenishment of the above-described washing water and/or stabilizing solution may be reused in other steps such as in a desilvering step.

In processing using an automatic developing machine, the processing solution at each step tends to become more consentrated due to evaporation. In order to compensate for the concentration of the processing solution, it is preferred to add an appropriate amount of water as replenisher.

A color developing agent may be incorporated into the silver halide color photographic material according to the present invention for the purpose of simplification and acceleration of processing. In order to incorporate the color developing agent, it is preferred to employ various precursors of color developing agents. Suitable examples of precursors of developing agents include indoaniline type compounds as described in U.S. Pat. Nos. 3,342,597, Schiff's base type compounds as described in U.S. Pat. No. 3,342,599 and *Research Disclosure,* No. 14850 and ibid., No. 15159, aldol compounds as described in *Research Disclosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development.

The compound according to the present invention can be employed also in heat-developable light-sensitive materials. Suitable examples of heat-developable light-sensitive materials are described, for example, in U.S. Pat. Nos. 4,463,079, 4,474,867, 4,478,927, 4,507,380, 4,500,626 and 4,483,914, JP-A-58-149046, JP-A-58-149047, JP-A-59-152440, JP-A-59-154445, JP-A-59-165054, JP-A-59-180548, JP-A-59-168439, JP-A-59-174832, JP-A-59-174833, JP-A-59-174834, JP-A-59-174835, JP-A-61-232451, JP-A-62-65038, JP-A-62-253159, JP-A-63-316848, JP-A-64-13546, and European Patent Application (OPI) Nos. 210,660A2 and 220,746A2.

The heat-developable light-sensitive material described above comprises basically a support having thereon a light-sensitive silver halide, a binder, a dye providing compound, and a reducing agent (in some cases the dye providing compound may also act as the reducing agent), and in addition, an organic silver salt and other appropriate additives, if desired.

The heat-developable light-sensitive material can provide a negative image or a positive image upon imagewise exposure. In order to provide a positive image, a process using a direct positive emulsion (including both a process using a nucleating agent and a process using a light fogging method) as a silver halide emulsion and a process using a dye providing compound capable of releasing a diffusible dye in a positive pattern can be utilized.

Various processes for transfer of diffusible dyes are also known and any known process can be employed. For instance, a method of transferring a dye to a dye fixing layer using an image forming solvent such as water, a method of transferring a dye to a dye fixing layer using an organic solvent having a high boiling point, a method of transferring a dye to a dye fixing layer using a hydrophilic thermal solvent, and a method of transferring a dye to a dye fixing layer containing a dye accepting polymer utilizing heat-diffusion or sublimation of diffusible dye can be employed.

The image forming solvent described above includes, for example, water which includes not only pure water but also water in its broadly used meaning sense. Also, a mixed solvent of water and a solvent having a low boiling point such as methanol, dimethyl formamide (DMF), acetone, or diisobutyl ketone can be employed. Further, a solution containing an appropriate additive, for example, an image formation accelerator, an antifoggant, a development stopping agent, or hydrophilic thermal solvent may be employed.

The present invention is explained in greater detail by reference to the following examples, but the present invention should not be construed as being limited thereto.

EXAMPLE 1

An aqueous solution of silver nitrate and an aqueous solution of a halide were added over a period of 60 minutes to an aqueous solution of gelatin which was maintained at 50° C. by a controlled double jet method in the presence of ammonia to prepare a cubic monodispersed silver iodobromide emulsion having an average grain size of 0.32 mμ (coefficient of variation: 12%, silver iodide: 0.5 mol %, uniform iodide distribution). During the preparation of the emulsion, 30 minutes after the beginning of the addition $5\times10^{-7}$ mol per mol Ag of $K_3IrCl_6$ was added to the reaction mixture. After desalting the emulsion by flocculation, $5\times10^{-4}$ mol per mol of silver of the compound described below as a sensitizing dye and an aqueous solution of $10^{-3}$ mol per mol of silver of potassium iodide were added to the emulsion while maintaining the emulsion at 50° C., aged for 15 minutes and then 4-hydroxy-6-methyl-1,3,3a,7-tetraazaindene was added, followed by decreasing the temperature. The emulsion prepared was designated Emulsion A.

Sensitizing Dye

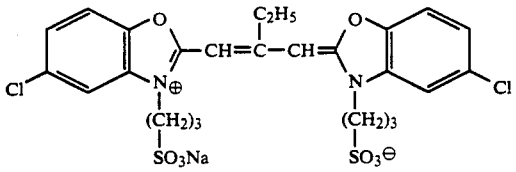

To the emulsion were added $2\times10^{-4}$ mol/mol Ag of a hydrazine compound, i.e., Compound (a) described below and $8.6\times10^{-3}$ mol/mol Ag of a nucleation accelerating agent, i.e., Compound (b) described below.

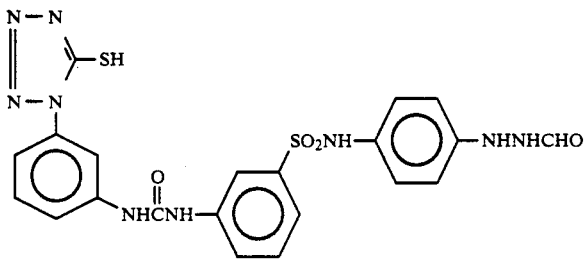

Compound (a)

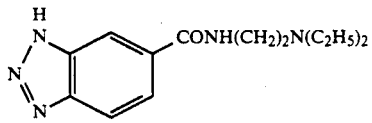

Compound (b)

Further, $2.0\times10^{-5}$ mol/m$^2$ of a comparative compound or a compound according to the present invention as shown in Table 1 below, as well as polyethyl acrylate and 1,3-divinylsulfonyl-2-propanol as a hardener were added thereto, and the mixture was coated on a polyethylene terephthalate film in a coating amount of 4.0 g/m$^2$ in terms of silver. A layer containing 1.2 g/m$^2$ of gelatin, 40 mg/m$^2$ of amorphous $SiO_4$ having a grain size of about 3 μm as a matting agent, 0.1 g/m$^2$ of Methanol Silica (a trade name of a product from Dupont) and a fluorine type surfactant described below and sodium dodecylbenzenesulfonate as coating aids was simultaneously coated on the emulsion layer as a protective layer.

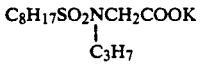

These samples were exposed through an optical wedge of a contact screen (150L chain dot type, manufactured by Fuji Photo Film Co., Ltd.) and an optical wedge using tungsten light of color temperature 3200° K. Then they were developed for 30 seconds at 34° C. in the developing solution described below, fixed, washed with water and dried.

| Developing Solution: | |
|---|---|
| Hydroquinone | 54 g |
| 4-Methyl-4-hydroxymethyl-1-phenyl-3-pyrazolidone | 0.42 g |
| Potassium Sulfite | 90 g |
| Disodium Ethylenediaminetetraacetate | 2.8 g |
| Potassium Bromide | 5 g |
| 2-Mercaptobenzimidazole-5-sulfonic Acid | 0.5 g |
| Boric Acid | 10 g |
| (pH was adjusted to 10.6 by adding potassium hydroxide) | |
| Water to make | 1 l |

The photographic performance obtained is shown in Table 1 below. In Table 1, gradation ($\overline{G}$) means the slope of the line formed by connecting the point with a density of 0.3 and that with a density of 3.0 in the characteristics curve. The larger the value, the harder the contrast.

$D_{max}$ means the density obtained by the exposure amount ($0.4+\log E_0$) which is larger by 0.4 as $\log E_0$ than the exposure amount ($\log E_0$) providing a density of 1.5.

The dot gradation was expressed by the following equation:

Dot Gradation ($\Delta\log E$) = Exposure Amount Providing a Dot Area Ratio of 95% ($\log E_{95\%}$) − Exposure Amount Providing a Dot Area Ratio of 5% ($\log E_{5\%}$)

The dot quality was visually evaluated with five grades, with "5" meaning the best, and "1" meaning the worst. A grade of "5" or "4" indicates that the sample is useful practically as a dot image original for a photomechanical process; a grade of "3" indicates that the sample is at the limit for practical use; and the grade "2" or "1" indicates that the sample is not suitable for practical use.

TABLE 1

| No. | Sample | Compound | Photographic Performance $\overline{G}$ | $D_{max}$ | Dot Gradation | Dot Quality |
|---|---|---|---|---|---|---|
| 1 | Comparative Sample 1-1 | — | 11.5 | 4.6 | 1.31 | 3.0 |
| 2 | Comparative Sample 1-2 | Comparative Compound (a) | 10.7 | 4.0 | 1.30 | 3.0 |
| 3 | Comparative Sample 1-3 | Comparative Compound (b) | 9.5 | 4.2 | 1.35 | 3.5 |

TABLE 1-continued

| No. | Sample | Compound | Photographic Performance | | | |
|---|---|---|---|---|---|---|
| | | | $\bar{G}$ | $D_{max}$ | Dot Gradation | Dot Quality |
| 4 | Sample of Invention 1-1 | Compound I-1 | 9.6 | 4.0 | 1.46 | 4.0 |
| 5 | Sample of Invention 1-2 | Compound I-4 | 9.9 | 4.0 | 1.43 | 4.0 |
| 6 | Sample of Invention 1-3 | Compound I-13 | 10.8 | 4.3 | 1.47 | 4.5 |
| 7 | Sample of Invention 1-4 | Compound I-15 | 10.5 | 4.3 | 1.45 | 4.5 |
| 8 | Sample of Invention 1-5 | Compound I-18 | 10.2 | 4.2 | 1.42 | 4.0 |

Comparative Compound (a)

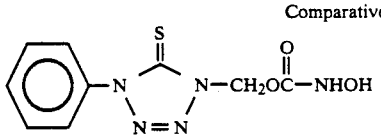

(described in JP-A-1-269936)

Comparative Compound (b)

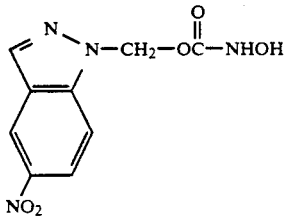

(described in JP-A-1-269936)

From the results shown in Table 1, it can be seen that with the samples according to the present invention, the decreases in $\bar{G}$ and $D_{max}$ are small and broad dot gradation and high dot quality are obtained.

EXAMPLE 2

Preparation of Light-Sensitive Emulsion

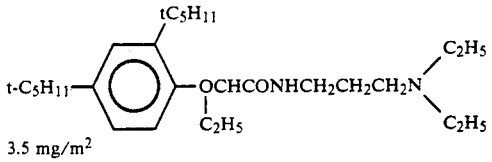

3.5 mg/m²

Compound (c)

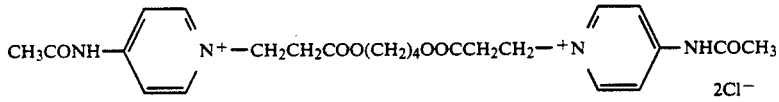

15.0 mg/m²

Compound (d)

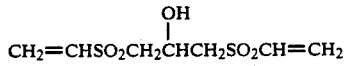

2.0 wt % with respect to gelatin

Compound (e)

An aqueous solution of silver nitrate and an aqueous solution of potassium iodide and potassium bromide were added simultaneously over a period of 60 minutes to an aqueous gelatin solution which was maintained at 50° C. in the presence of $4\times10^{-7}$ mol per mol of silver of potassium hexachloroiridium(III) and ammonia while maintaining the pAg at 7.8. A cubic monodispersed emulsion having an average grain size of 0.28 μm and an average silver iodide content of 0.3 mol % was obtained. After desalting the emulsion using flocculation, 40 grams of inert gelatin was added per mol of silver. Then, to the emulsion was added 5,5'-dichloro-9-ethyl-3,3'-bis(3-sulfopropyl)oxacarbocyanine as a sensitizing dye and a solution of $10^{-3}$ mol per mol of silver of potassium iodide while maintaining the emulsion at 50° C., and the temperature was decreased after aging for 15 minutes.

Coating of Light-Sensitive Emulsion Layer

The emulsion prepared above was re-melted, and the hydrazine derivative described below and 0.02 mol/mol Ag of methylhydroquinone were added thereto at 40° C.

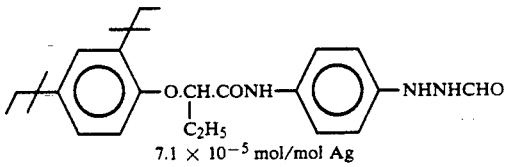

$7.1\times10^{-5}$ mol/mol Ag

Further, 5-methylbenzotriazole, 4-hydroxy-1,3,3a,7-tetraazaindene, Compounds (c) and (d) described below, 30 wt % with respect to gelatin of polyethyl acrylate and Compound (c) described below as a gelatin hardener were added, and the mixture was coated in an amount of 3.4 g/m² in terms of silver on a polyethylene terephthalate film (thickness: 150 μm) having a subbing layer (thickness: 0.5 μm) composed of a vinylidene chloride copolymer.

Coating of Intermediate Layer

A layer containing 1.0 g/m² of gelatin was coated.

Coating of Layer Containing Compound of Formula (I) of Present Invention

A layer containing $4.5\times10^{-5}$ mol/m² of a compound represented by formula (I) according to the present invention as shown in Table 2 below and the light-sensitive emulsion described above in a coating amount of 0.4 g/m² in terms of silver was coated. The coating amount of gelatin was 0.4 g/m².

Coating of Protective Layer

A protective layer comprising 1.5 g/m² of gelatin, 0.3 g/m² of polymethyl methacrylate particles (average particle size: 2.5 μm) and 2.0 wt % with respect to gelatin of Gelatin Hardener (e) shown above were coated on the layer using the surfactants described below. Thus, samples were prepared.

| Surfactants | |
|---|---|
| 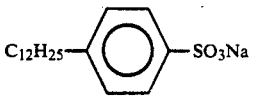 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2NCH_2COOK$<br>\|<br>$C_3H_7$ | 2.5 mg/m² |

The samples were exposed in the same manner as described in Example 1 and subjected to development processing using a developing solution having the composition shown below.

| Developing Solution | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)benzene-Sulfonate | 0.2 g |
| N-n-Butyldiethanolamine | 15.0 g |
| Sodium Toluenesulfonate | 8.0 g |
| Water to make | 1 l |
| pH adjusted to 11.6 (by adding potassium hydroxide) | pH 11.6 |

The results obtained are shown in Table 2 below. From the results shown in Table 2 above, it can be seen that with the samples according to the present invention, the decreases in $\overline{G}$ and $D_{max}$ are small and broad dot gradation and high dot quality are obtained.

TABLE 2

| No. | Sample | Compound | Photographic Performance $\overline{G}$ | $D_{max}$ | Dot Gradation | Dot Quality |
|---|---|---|---|---|---|---|
| 1 | Comparative Sample 2-1 | — | 16.3 | 5.3 | 1.19 | 4.0 |
| 2 | Comparative Sample 2-2 | Comparative Compound (b) | 13.0 | 4.5 | 1.28 | 4.5 |
| 3 | Sample of Invention 2-1 | Compound I-5 | 12.8 | 4.8 | 1.37 | 5.0 |
| 4 | Sample of Invention 2-2 | Compound I-9 | 13.4 | 4.7 | 1.35 | 5.0 |
| 5 | Sample of Invention 2-3 | Compound I-10 | 12.5 | 4.5 | 1.39 | 5.0 |
| 6 | Sample of Invention 2-4 | Compound I-13 | 13.0 | 4.9 | 1.41 | 5.0 |
| 7 | Sample of Invention 2-5 | Compound I-16 | 13.3 | 4.6 | 1.37 | 5.0 |
| 8 | Sample of Invention 2-6 | Compound I-18 | 13.0 | 4.5 | 1.35 | 4.5 |

EXAMPLE 3

On a cellulose triacetate film support provided with a subbing layer was coated each layer having the composition set forth below to prepare a multilayer color light-sensitive material, which was designated Sample 301.

With respect to the compositions of the layers, the coated amounts are shown in units of g/m², the coated amounts of silver halide and colloidal silver are shown as the silver coated amount in units of g/m², and those of the sensitizing dyes are shown as a molar amount per mol of silver halide present in the same layer.

| | |
|---|---|
| First Layer: Antihalation Layer | |
| Black Colloidal Silver | 0.18 (as silver) |
| Gelatin | 0.40 |
| Second Layer: Intermediate Layer | |
| 2,5-Di-tert-pentadecylhydroquinone | 0.18 |
| EX-1 | 0.07 |
| EX-3 | 0.02 |
| EX-12 | 0.002 |
| U-1 | 0.06 |
| U-2 | 0.08 |
| U-3 | 0.10 |
| HBS-1 | 0.10 |
| HBS-2 | 0.02 |
| Gelatin | 0.80 |
| Third Layer: First Red-Sensitive Emulsion Layer | |
| Monodispersed silver iodobromide emulsion (silver iodide: 6 mol %, average particle diameter: 0.6 μm, coefficient of variation on particle diameter: 0.15) | 0.55 (as silver) |
| Sensitizing Dye I | $6.9 \times 10^{-5}$ |
| Sensitizing Dye II | $1.8 \times 10^{-5}$ |
| Sensitizing Dye III | $3.1 \times 10^{-4}$ |
| Sensitizing Dye IV | $4.0 \times 10^{-5}$ |
| EX-2 | 0.350 |
| EX-3 | 0.015 |
| EX-10 | 0.020 |
| Comparative Compound (a) | 0.030 |
| Gelatin | 0.80 |
| Fourth Layer: Second Red-Sensitive Emulsion Layer | |
| Tabular silver iodobromide emulsion (silver iodide: 10 mol %, average particle diameter: 0.7 μm, average aspect ratio: 5.5, average thickness: 0.2 μm) | 1.0 (as silver) |
| Sensitizing Dye IX | $5.1 \times 10^{-5}$ |
| Sensitizing Dye II | $1.4 \times 10^{-5}$ |
| Sensitizing Dye III | $2.3 \times 10^{-4}$ |
| Sensitizing Dye IV | $3.0 \times 10^{-5}$ |
| EX-2 | 0.400 |
| EX-3 | 0.050 |
| Comparative Compound (a) | 0.025 |
| EX-10 | 0.015 |
| Gelatin | 0.90 |
| Fifth Layer: Third Red-Sensitive Emulsion Layer | |
| Silver iodobromide emulsion (silver iodide: 16 mol %, average particle diameter: 1.1 μm) | 1.60 (as silver) |
| Sensitizing Dye IX | $5.4 \times 10^{-5}$ |
| Sensitizing Dye II | $1.4 \times 10^{-5}$ |
| Sensitizing Dye III | $2.4 \times 10^{-4}$ |
| Sensitizing Dye IV | $3.1 \times 10^{-5}$ |
| EX-10 | 0.007 |
| EX-3 | 0.240 |
| EX-4 | 0.120 |

-continued

| | |
|---|---|
| Comparative Compound (a) | 0.010 |
| HBS-1 | 0.10 |
| HBS-2 | 0.10 |
| Gelatin | 0.95 |
| Sixth Layer: Intermediate Layer | |
| EX-5 | 0.040 |
| HBS-1 | 0.020 |
| Gelatin | 0.80 |
| Seventh Layer: First Green-Sensitive Emulsion Layer | |
| Tabular silver iodobromide emulsion (silver iodide: 6 mol %, average particle diameter: 0.6 μm, average aspect ratio: 6.0, average thickness: 0.15 μm) | 0.40 (as silver) |
| Sensitizing Dye V | $3.0 \times 10^{-5}$ |
| Sensitizing Dye VI | $1.0 \times 10^{-4}$ |
| Sensit1z1ng Dye VII | $3.8 \times 10^{-4}$ |
| EX-6 | 0.260 |
| EX-1 | 0.021 |
| EX-7 | 0.030 |
| Comparative Compound (a) | 0.005 |
| EX-8 | 0.025 |
| HBS-1 | 0.100 |
| HBS-11 | 0.010 |
| Gelatin | 0.75 |
| Eighth Layer: Second Green-Sensitive Emulsion Layer | |
| Monodispersed silver iodobromide emulsion (silver iodide: 12 mol %, average particle diameter: 0.8 μm, coefficient of variation on particle diameter: 0.16) | 0.80 (as silver) |
| Sensitizing Dye V | $2.1 \times 10^{-5}$ |
| Sensitizing Dye VI | $7.0 \times 10^{-5}$ |
| Sensitizing Dye VII | $2.6 \times 10^{-4}$ |
| EX-6 | 0.180 |
| Comparative Compound (a) | 0.010 |
| EX-8 | 0.010 |
| EX-1 | 0.008 |
| EX-7 | 0.012 |
| HBS-1 | 0.160 |
| HBS-11 | 0.008 |
| Gelatin | 0.85 |
| Ninth Layer: Third Green-Sensitive Emulsion Layer | |
| Silver iodobromide emulsion (silver iodide: 18 mol %, average particle diameter: 1.0 μm) | 1.2 (as silver) |
| Sensitizing Dye V | $3.5 \times 10^{-5}$ |
| Sensitizing Dye VI | $8.0 \times 10^{-5}$ |
| Sensitizing Dye VII | $3.0 \times 10^{-4}$ |
| EX-6 | 0.065 |
| EX-11 | 0.030 |
| EX-1 | 0.025 |
| HBS-1 | 0.25 |
| Comparative Compound (a) | 0.005 |
| Gelatin | 1.00 |
| Tenth Layer: Yellow Filter Layer | |
| Yellow Colloidal Silver | 0.05 (as silver) |
| EX-5 | 0.08 |
| HBS-1 | 0.03 |
| Gelatin | 0.60 |
| Eleventh Layer: First Blue-Sensitive Emulsion Layer | |
| Tabular silver iodobromide emulsion (silver iodide: 4 mol %, average particle diameter: 0.6 μm, average aspect ratio: 7.3, average thickness: 0.14 μm) | 0.24 (as silver) |
| Sensitizing Dye VIII | $3.5 \times 10^{-4}$ |
| EX-9 | 0.85 |
| EX-8 | 0.059 |
| HBS-1 | 0.28 |
| Gelatin | 1.40 |
| Twelfth Layer: Second Blue-Sensitive Emulsion Layer | |
| Monodispersed silver iodobromide emulsion (silver iodide: 8 mol %, average particle diameter: 0.8 μm, coefficient of variation on particle diameter: 0.18) | 0.45 (as silver) |
| Sensitizing Dye VIII | $2.1 \times 10^{-4}$ |
| EX-9 | 0.20 |
| EX-10 | 0.015 |
| HBS-1 | 0.03 |
| Gelatin | 0.30 |
| Thirteenth Layer: Third Blue-Sensitive Emulsion Layer | |
| Silver iodobromide emulsion (silver iodide: 14 mol %, average particle diameter: 1.3 μm) | 0.77 (as silver) |
| Sensitizing Dye VIII | $2.2 \times 10^{-4}$ |
| EX-9 | 0.20 |
| HBS-1 | 0.07 |
| Gelatin | 0.69 |
| Fourteenth Layer: First Protective Layer | |
| Silver iodobromide emulsion (silver iodide: 1 mol %, average particle diameter: 0.07 μm) | 0.5 (as silver) |
| U-4 | 0.11 |
| U-5 | 0.17 |
| HBS-1 | 0.90 |
| Gelatin | 0.80 |
| Fifteenth Layer: Second Protective Layer | |
| Polymethyl Acrylate Particles (diameter: about 1.5 μm) | 0.54 |
| S-1 | 0.15 |
| S-2 | 0.05 |
| Gelatin | 0.60 |

Gelatin Hardener H-1 and a surface active agent were added to each of the layers in addition to the above described components.

Samples 302 and 303 were prepared in the same manner as described for Sample 301 except for using the equimolar amount of Compounds I-30 and I-24 according to the present invention in place of Comparative Compound (a), which was the same compound as described in Example 1, used in the Third, Fourth and Fifth Layers of Sample 301, respectively.

Sample 304 was prepared in the same manner as described for Sample 303 except for using an equimolar amount of Compound I-24 according to the present invention in place of Comparative Compound (a) used in the Seventh, Eighth and Ninth Layers of Sample 303.

These samples were exposed to white light through a pattern for measurement of MTF, subjected to the color development processing described below and the MTF values of the magenta image were measured. The measurement of the MTF value was conducted according to the method as described in Mees, *The Theory of the Photographic Process,* Third Edition (Macmillan Co.).

Further, these samples were exposed through a pattern for measurement of RMS graininess using an aperture having a diameter of 48 μm and subjected to development processing whereby the RMS graininess was determined.

Moreover, these samples were imagewise exposed to red light and subjected to development processing and the color turbidity of these samples were evaluated. The color turbidity was determined by the following equation:

(Magenta density obtained at an exposure amount necessary, for obtaining a cyan density of fog+0.2)−(Magenta density at the unexposed area)

The color development processing was conducted using the steps described below at 38° C. with an automatic developing machine.

| Processing Step | Processing Time |
|---|---|
| Color Development | 3 min. 15 sec. |
| Bleaching | 1 min. |
| Bleach-Fixing | 3 min. 15 sec. |
| Washing with Water (1) | 40 sec. |
| Washing with Water (2) | 1 min. |
| Stabilizing | 40 sec. |
| Drying (at 50° C.) | 1 min. 15 sec. |

The washing with water steps were conducted using a countercurrent washing with washing with water (2) passed to washing with water (1). The amount of replenishment of the color developing solution was 1,200 ml per $m^2$ of color light-sensitive material and for the amounts the other processing steps including the washing with water step were 800 ml per $m^2$ of color light-sensitive material, respectively. The amount carried over from the preceding bath to the washing with water step was 50 ml per $m^2$ of color light-sensitive material.

The composition of each processing solution used is illustrated below.

| Bleaching Solution: | |
|---|---|
| Ammonium Fe(III) Ethylenediamine-tetraacetate | 120.0 g |
| Disodium Ethylenediaminetetraacetate | 10.0 g |
| Ammonium Bromide | 100.0 g |
| Ammonium Nitrate | 10.0 g |
| Bleach Accelerating Agent: | $5 \times 10^{-3}$ mol |

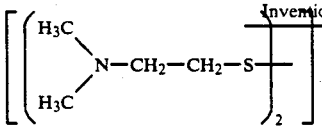

| | |
|---|---|
| Aqueous ammonia to adjust pH to 6.3 | |
| Water to make | 1.0 l |

Bleach-Fixing Solution: (bath tank solution and replenisher)

-continued

| | |
|---|---|
| Ammonium Iron(III) Ethylenediamine-tetraacetate | 50.0 g |
| Disodium Ethylenediaminetetraacetate | 5.0 g |
| Sodium Sulfite | 12.0 g |
| Ammonium Thiosulfate (70% aq. soln.) | 240 ml |
| Aqueous ammonia to adjust pH to 7.3 | |
| Water to make | 1.0 l |

Washing Water

City water containing 32 mg per liter of calcium ions and 7.3 mg per liter of magnesium ions was passed through a column filled with an H type strong acidic cation exchange resin and an OH type strong basic anion exchange resin to obtain water containing 1.2 mg per liter of calcium ions and 0.4 mg per liter of magnesium ions, and then sodium dichloroisocyanurate was added in an amount of 20 mg per liter thereto.

| Stabilizing Solution: (bath tank solution and replenisher) | |
|---|---|
| Formalin (37 w/v %) | 2.0 ml |
| Polyoxyethylene-p-monononyl Phenyl Ether (average degree of polymerization: | 0.3 g |
| Disodium Ethylenediaminetetraacetate | 0.05 g |
| Water to make | 1.0 l |
| pH | 5.8 |

Drying

The temperature for drying was 50° C.

The results obtained are shown in Table 3 below.

TABLE 3

| Sample | Compound used in Third, Fourth and Fifth Layers | Compound used in Seventh, Eighth and Ninth Layers | MTF Value | RMS Value (× 100) | Color Turbidity |
|---|---|---|---|---|---|
| 301 (Comparison) | Comparative Compound (a) | Comparative Compound (a) | 0.50 | 25.6 | 0.05 |
| 302 (Present Invention) | Compound I-30 | Comparative Compound (a) | 0.55 | 23.5 | 0.03 |
| 303 (Present Invention) | Compound I-24 | Comparative Compound (a) | 0.55 | 23.6 | 0.02 |
| 304 (Present Invention) | Compound I-24 | Compound I-24 | 0.56 | 23.2 | 0.02 |

From the results shown in Table 3 above, it is apparent that the sample using the compound according to the present invention has excellent sharpness represented by the MTF value, graininess represented by the RMS value, and color reproducibility represented by color turbidity.

The compounds employed in the preparation of the samples in Example 3 are shown below.

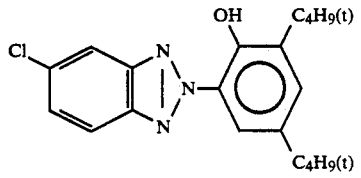

U-1

-continued
U-2
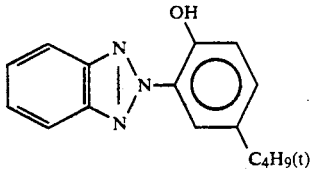
U-3
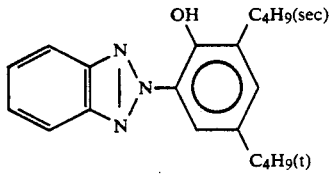
U-4
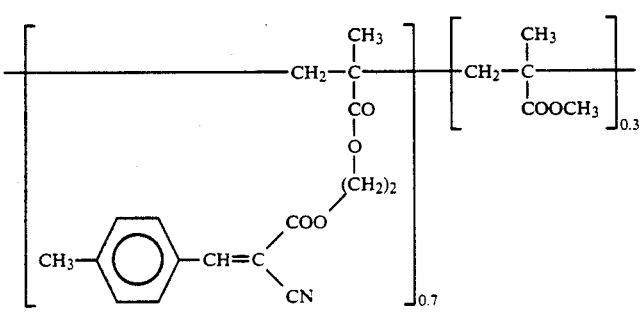
U-5
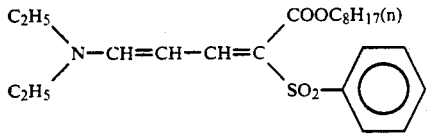
EX-4
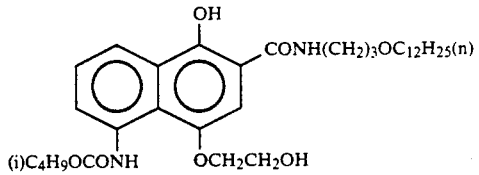
EX-5
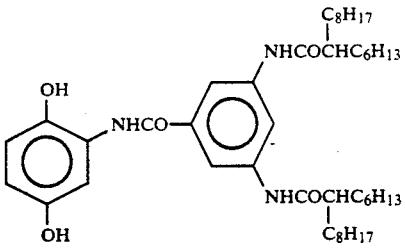
EX-6
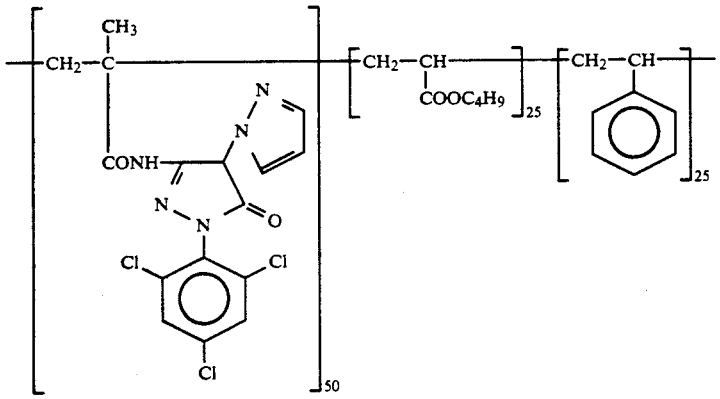

-continued
Average molecular weight 30,000
EX-7
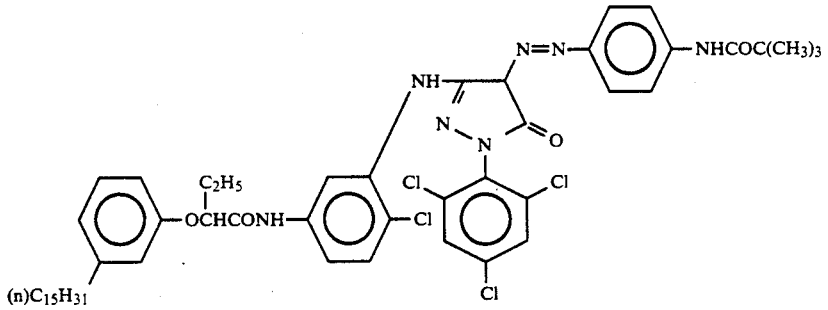
EX-8
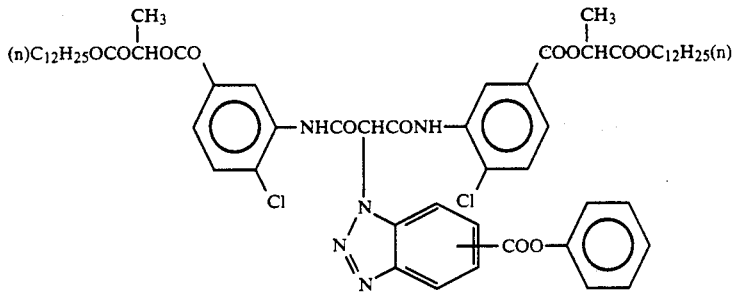
EX-9
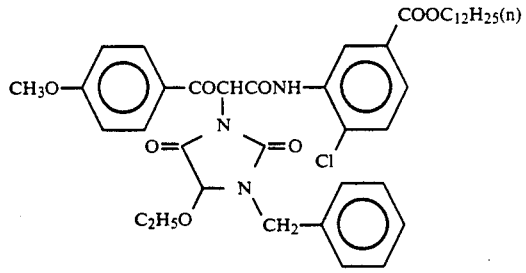
EX-10
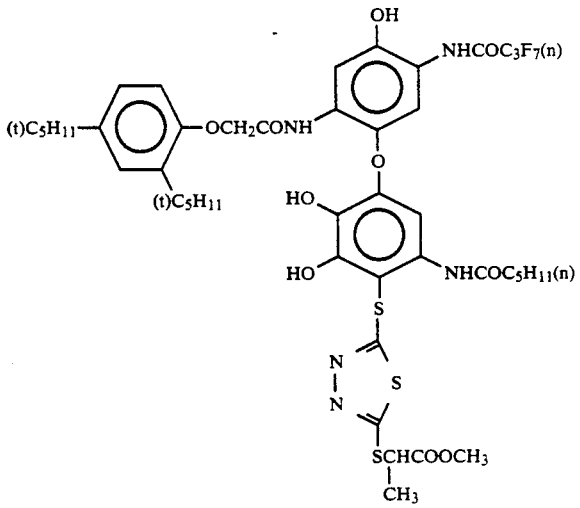

-continued
EX-11
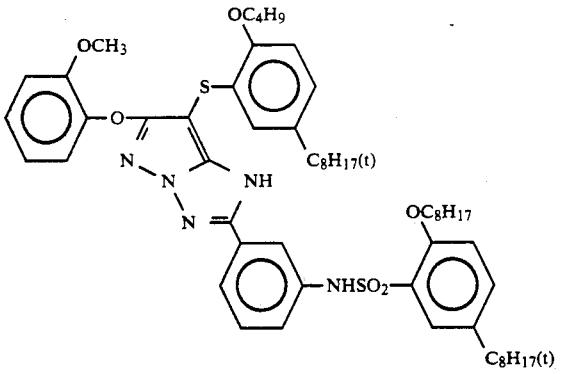
Tricresyl Phosphate — HBS-1
Dibutyl Phthalate — HBS 2
HBS-11
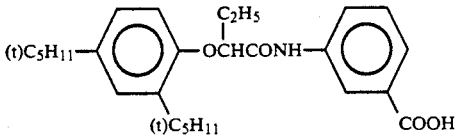
EX-12
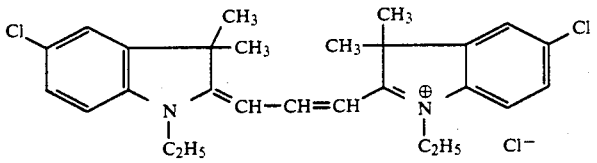
S-1
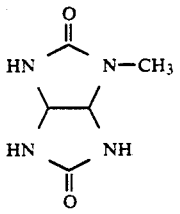
S-2
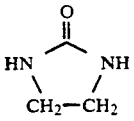
H-1
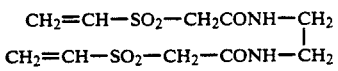
Sensitizing Dye I
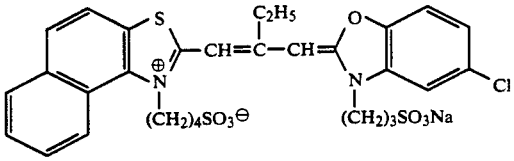
Sensitizing Dye II
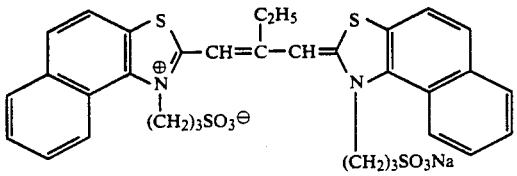

-continued

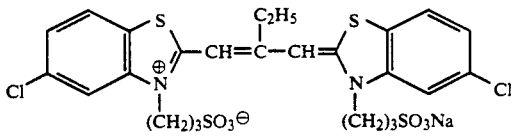

Sensitizing Dye III

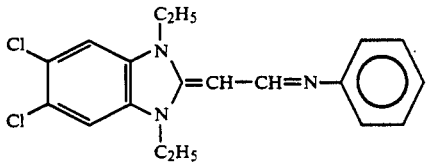

Sensitizing Dye IV

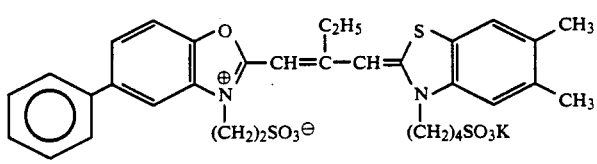

Sensitizing Dye V

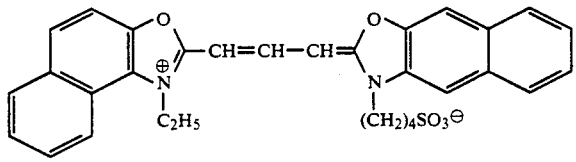

Sensitizing Dye VI

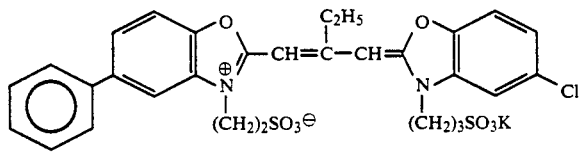

Sensitizing Dye VII

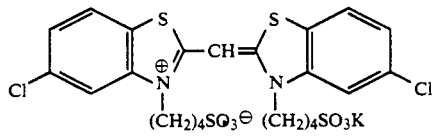

Sensitizing Dye VIII

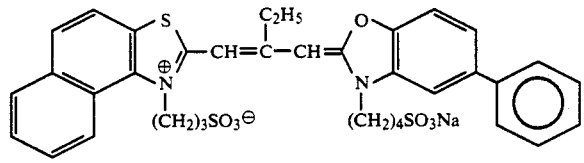

Sensitizing Dye IX

EXAMPLE 4

A cellulose triacetate film support (thickness: 127$\mu$) having a subbing layer was coated with layers having the compositions set forth below to prepare a multilayer color photographic light-sensitive material which was designated Sample 401. The amounts added were per $m^2$. It should be noted that the effects of the compounds added are not limited to the uses described.

| First Layer: Antihalation Layer | |
|---|---|
| Black Colloidal Silver | 0.25 g |
| Gelatin | 1.9 g |
| Ultraviolet Light Absorbing Agent U-1 | 0.04 g |
| Ultraviolet Light Absorbing Agent U-2 | 0.1 g |
| Ultraviolet Light Absorbing Agent U-3 | 0.1 g |
| Ultraviolet Light Absorbing Agent U-6 | 0.1 g |
| Organic Solvent having a high boiling point Oil-1 | 0.1 g |

-continued

| Second Layer: Intermediate Layer | |
|---|---|
| Gelatin | 0.40 g |
| Compound Cpd-D | 10 mg |
| Organic Solvent having a high boiling point Oil-3 | 40 mg |
| **Third Layer: Intermediate Layer** | |
| Fogged fine grain silver iodobromide emulsion (average grain size: 0.06 $\mu$m, AgI content: 1 mol %) | 0.05 g (as silver) |
| Gelatin | 0.4 g |
| **Fourth Layer: Low-Speed Red-Sensitive Emulsion Layer** | |
| Silver iodobromide emulsion [a 1:1 mixture of monodispersed cubic emulsion (average grain size: 0.4 $\mu$m, AgI content: 4.5 mol %) and monodispersed cubic emulsion (average grain size: 0.3 $\mu$m, AgI content: 4.5 mol %)] spectrally sensitized with | 0.7 g (in terms of Ag) |

-continued

| | |
|---|---|
| Sensitizing Dyes S-1 and S-2 | |
| Gelatin | 0.8 g |
| Coupler C-1 | 0.20 g |
| Coupler C-9 | 0.05 g |
| Compound Cpd-D | 10 mg |
| Organic Solvent having a high boiling point Oil-2 | 0.1 g |
| Fifth Layer: Medium-Speed Red-Sensitive Emulsion Layer | |
| Silver iodobromide emulsion (monodispersed cubic grain, average grain size: 0.5 μm, AgI content: 4 mol %) spectrally sensitized with Sensitizing Dyes S-1 and S-2 | 0.5 g (as silver) |
| Gelatin | 0.8 g |
| Coupler C-1 | 0.2 g |
| Coupler C-2 | 0.05 g |
| Coupler C-3 | 0.2 g |
| Organic Solvent having a high boiling point Oil-2 | 0.1 g |
| Sixth Layer: High-Speed Red-Sensitive Emulsion Layer | |
| Silver iodobromide emulsion (monodispersed twin grains, average grain size: 0.7 μm, AgI content: 2 mol %) spectrally sensitized with Sensitizing Dyes S-1 and S-2 | 0.5 g (as silver) |
| Gelatin | 1.1 g |
| Coupler C-3 | 0.7 g |
| Coupler C-1 | 0.3 g |
| Organic Solvent having a high boiling point | |
| Seventh Layer: Intermediate Layer | |
| Gelatin | 0.6 g |
| Dye D-1 | 0.02 g |
| Eighth Layer: Intermediate Layer | |
| Fogged silver iodobromide emulsion (average grain size: 0.06 μm, AgI content: 0.3 mol %) | 0.02 g |
| Gelatin | 1.0 g |
| Color Mixing Preventing Agent Cpd-A | 0.2 g |
| Ninth Layer: Low-Speed Green-Sensitive Emulsion Layer | |
| Silver iodobromide emulsion [a 1:1 mixture of emulsion (monodispersed cubic grain, average grain size: 0.4 μm, AgI content: 4.5 mol %) and emulsion (monodispersed cubic grain, average grain size: 0.2 μm, AgI content: 4.5 mol %) ]spectrally sensitized with Sensitizing Dyes ES-3 and ES-4 | 0.5 g (as silver) |
| Gelatin | 0.5 g |
| Coupler C-4 | 0.10 g |
| Coupler C-7 | 0.10 g |
| Coupler C-8 | 0.10 g |
| Compound Cpd-B | 0.03 g |
| Compound Cpd-E | 0.02 g |
| Compound Cpd-F | 0.02 g |
| Compound Cpd-G | 0.02 g |
| Compound Cpd-H | 0.02 g |
| Compound Cpd-D | 10 mg |
| Organic Solvent having a high boiling point Oil-1 | 0.1 g |
| Organic Solvent having a high boiling point Oil-2 | 0.1 g |
| Tenth Layer: Medium-Speed Green-Sensitive Emulsion Layer | |
| Silver iodobromide emulsion (monodispersed cubic grain, average grain size: 0.5 μm, AgI content: 3 mol %) spectrally sensitized with Sensitizing Dyes S-3 and S-4 | 0.4 g (as silver) |
| Gelatin | 0.6 g |
| Coupler C-4 | 0.1 g |
| Coupler C-7 | 0.1 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |

-continued

| | |
|---|---|
| Organic Solvent having a high boiling point Oil-2 | 0.01 g |
| Eleventh Layer: High-Speed Green-Sensitive Emulsion Layer | |
| Silver iodobromide emulsion [monodispersed tabular grain, average value of diameter/thickness of 7, average grain size (in terms of sphere): 0.6 μm, AgI content: 1.3 mol %] spectrally sensitized with Sensitizing Dyes S-3 and S-4 | 0.8 g (as silver) |
| Gelatin | 1.0 g |
| Coupler C-4 | 0.4 g |
| Coupler C-7 | 0.2 g |
| Coupler C-8 | 0.2 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| Organic Solvent having a high-boiling point Oil-1 | 0.02 g |
| Organic Solvent having a high-boiling point Oil-2 | 0.02 g |
| Twelfth Layer: Intermediate Layer | |
| Gelatin | 0.6 g |
| Dye D-2 | 0.05 g |
| Thirteenth Layer: Yellow Filter Layer | |
| Yellow Colloidal Silver | 0.1 g (as silver) |
| Gelatin | 1.1 g |
| Color Mixing Preventing Agent Cpd-A | 0.01 g |
| Organic Solvent having a high-boiling point Oil-1 | 0.01 g |
| Fourteenth Layer: Intermediate Layer | |
| Gelatin | 0.6 g |
| Fifteenth Layer: Low-Speed Blue-Sensitive Emulsion Layer | |
| Silver iodobromide emulsion [a 1:1 mixture of monodispersed cubic emulsion (average grain size: 0.4 μm, AgI content: 3 mol %) and monodispersed cubic emulsion (average grain size: 0.2 μm, AgI content: 3 mol %)] sensitized with Sensitizing Dyes S-5 and S-6 | 0.6 g (as silver) |
| Gelatin | 0.8 g |
| Coupler C-5 | 0.6 g |
| Organic Solvent having a high-boiling point Oil-2 | 0.02 g |
| Sixteenth Layer: Medium-Speed Blue-Sensitive Emulsion Layer | |
| Silver iodobromide emulsion (monodispersed cubic grain, average grain size: 0.5 μm, AgI content: 2 mol %) sensitized with Sensitizing Dyes S-5 and S-6 | 0.3 g (as silver) |
| Gelatin | 0.9 g |
| Coupler C-5 | 0.3 g |
| Coupler C-6 | 0.3 g |
| Organic Solvent having a high-boiling point Oil-2 | 0.02 g |
| Seventeenth Layer: High-Speed Blue-Sensitive Emulsion Layer | |
| Silver iodobromide emulsion (tabular grains, average value of diameter/thickness of 7, average grain size of 0.7 μm in terms of sphere, AgI content: 1.5 mol %) sensitized with Sensitizing Dyes S-5 and S-6 | 0.5 g (as silver) |
| Gelatin | 1.2 g |
| Coupler C-6 | 0.7 g |
| Eighteenth Layer: First Protective Layer | |
| Gelatin | 0.7 g |
| Ultraviolet Light Absorbing Agent U-1 | 0.04 g |
| Ultraviolet Light Absorbing Agent U-3 | 0.03 g |
| Ultraviolet Light Absorbing Agent U-4 | 0.03 g |
| Ultraviolet Light Absorbing Agent U-5 | 0.05 g |
| Ultraviolet Light Absorbing Agent U-6 | 0.05 g |
| Organic Solvent having a high-boiling | 0.02 g |

-continued

| | |
|---|---|
| point Oil-1 | |
| Formaldehyde Scavenger Cpd-C | 0.8 g |
| Dye D-3 | 0.05 g |
| Nineteenth Layer: Second Protective Layer | |
| Fogged fine grain silver iodobromide emulsion (average grain size: 0.06 μm, AgI content: 1 mol %) | 0.1 g (as silver) |
| Gelatin | 0.4 g |
| Twentieth Layer: Third Protective Layer | |
| Gelatin | 0.4 g |
| Polymethyl Methacrylate (average particle size: 1.5 μm) | 0.1 g |
| Methyl Methacrylate-Acrylic Acid (4:6) Copolymer (average particle size: 1.5 μm) | 0.1 g |
| Silicone Oil | 0.03 g |
| Surfactant W-1 | 3.0 mg |

In addition to the above-described composition, Gelatin Hardener H-1 and surfactants for coating and emulsification were added to each layer.

The term "monodispersed emulsion" as used above means an emulsion having a coefficient of variation of grain size of not more than 20%.

The compounds used in the above-described layers are shown below.

Coupler C-1

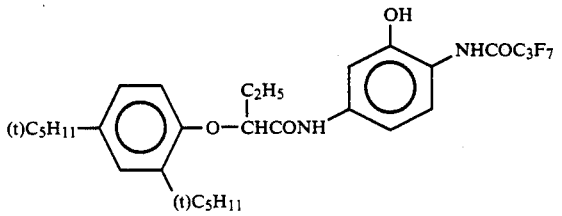

Coupler C-2

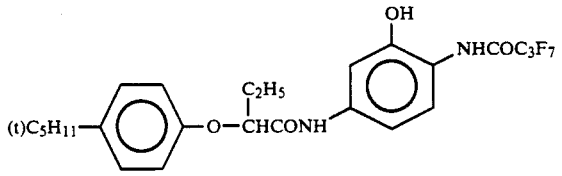

Coupler C-3

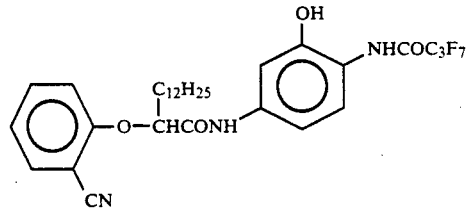

Coupler C-4

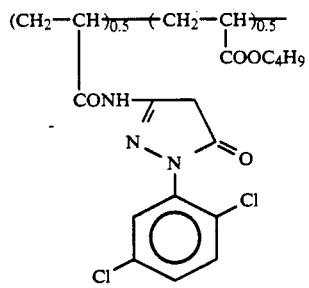

Coupler C-5

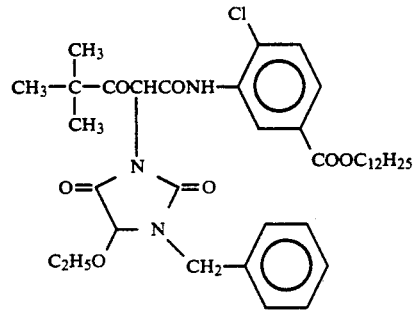

-continued
Coupler C-6
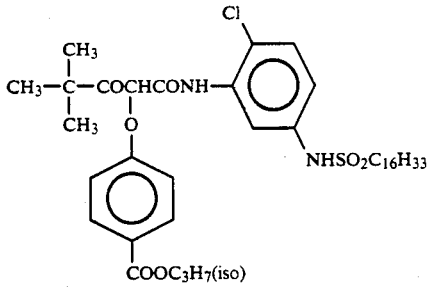
Coupler C-7
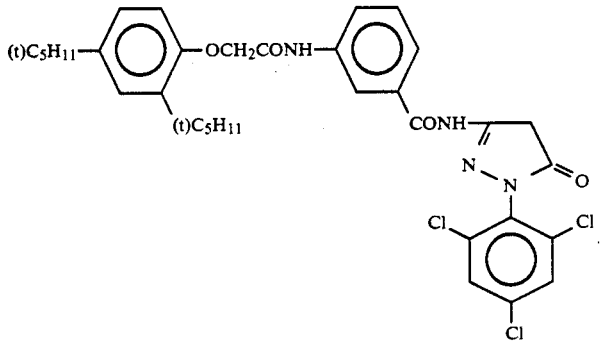
Coupler C-8
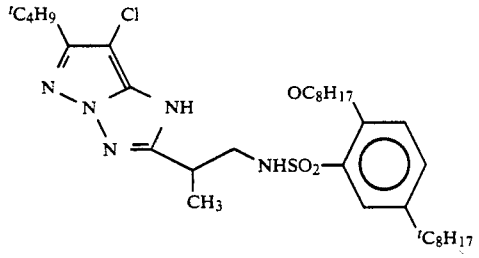
Coupler C-9
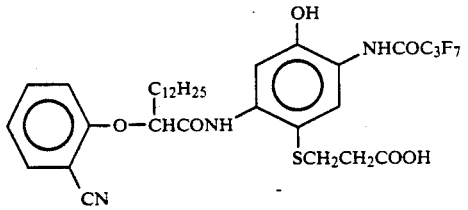
Dibutyl phtalate — Oil-1
Tricresyl phosphate — Oil-2
Oil-3
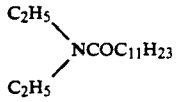
Cpd-A
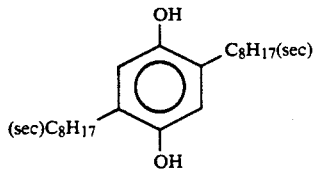

-continued
Cpd-B
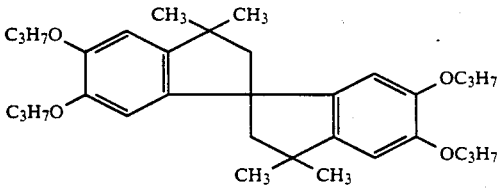
Cpd-C
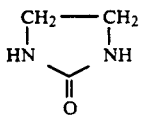
Cpd-D
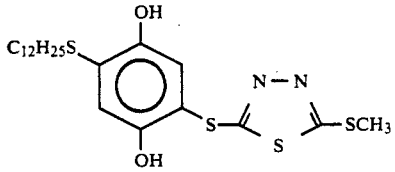
Cpd-E
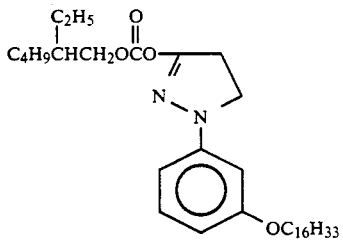
Cpd-F
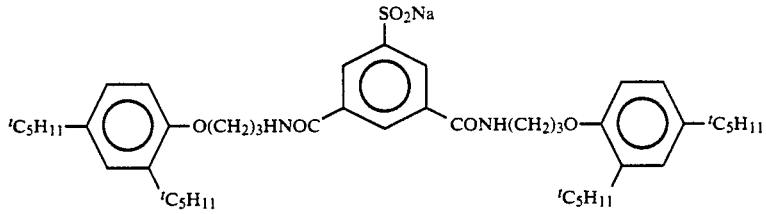
Cpd-G
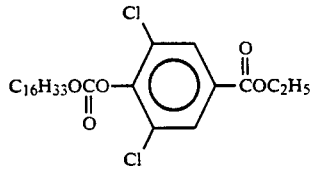
Cpd-H
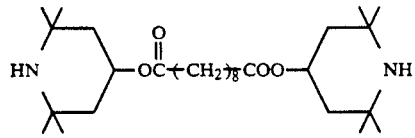
U-1
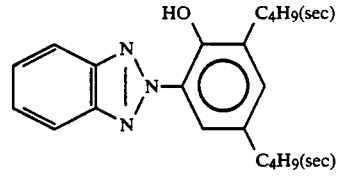
U-2
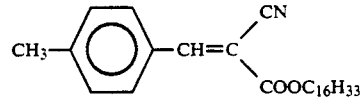

-continued
U-3
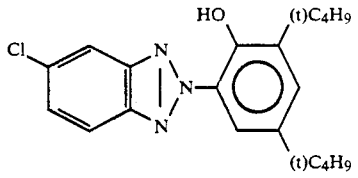
U-4
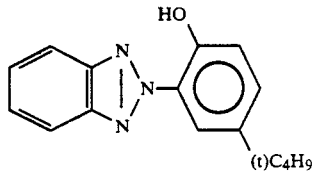
U-5
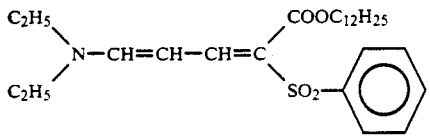
U-6
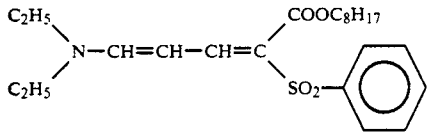
S-1
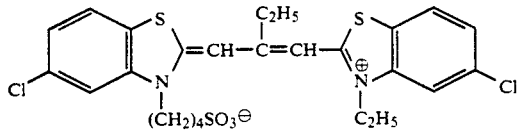
S-2
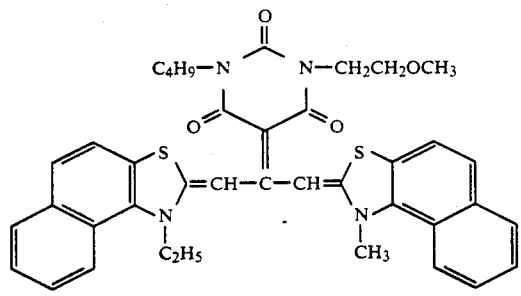
S-3
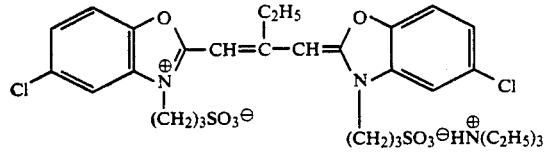
S-4
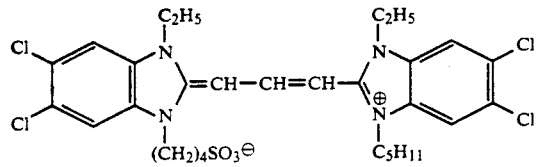

-continued

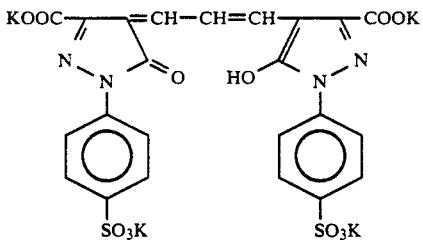

D-2

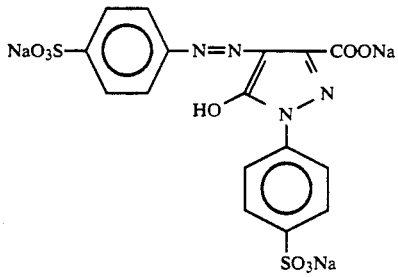

D-3

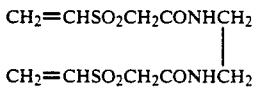

H-1

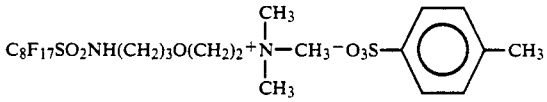

W-1

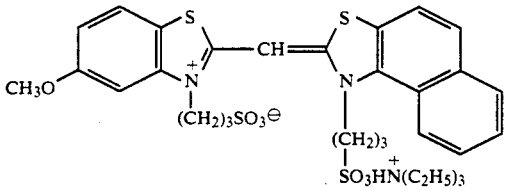

S-5

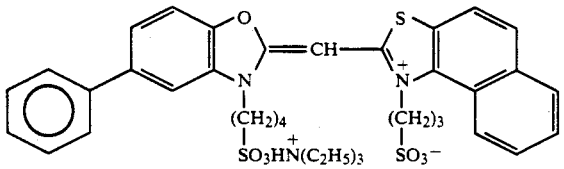

S-6

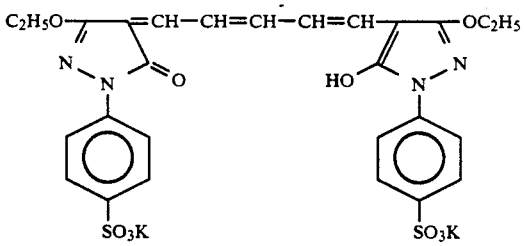

D-1

Samples 402 to 406 were prepared in the same manner as described above for Sample 401 except for using the compounds as shown in Table 3 below in place of Cpd D used in the Second, Fourth and Ninth Layers of Sample 401, respectively.

TABLE 3

| Sample | Compound | Amount Added (mg) |
|---|---|---|
| 401 | Cpd D | 10 |

TABLE 3-continued

| Sample | Compound | Amount Added (mg) |
|---|---|---|
| (Comparison) 402 | Cpd I | 15 |
| (Comparison) 403 | Compound I-7 | 15 |
| (Present Invention) 404 | Compound I-23 | 15 |

TABLE 3-continued

| Sample | Compound | Amount Added (mg) |
|---|---|---|
| (Present Invention) | | |
| 405 (Present Invention) | Compound I-25 | 15 |
| 406 (Present Invention) | Compound I-25 | 18 |

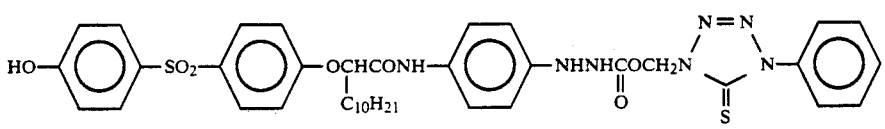

Compound I

The silver halide color photographic materials thus prepared were exposed and then processed according to the steps described below while the specific amount of replenisher per unit area of photographic material to be processed was supplied in each step.

| Processing Step | Time | Temperature (°C.) | Tank Capacity (l) | Amount of Replenisher (l/m²) |
|---|---|---|---|---|
| Black-and-White Development | 6 min. | 38 | 12 | 2.2 |
| First Washing with Water | 2 min. | " | 4 | 7.5 |
| Reversal | 2 min. | " | 4 | 1.1 |
| Color Development | 6 min. | " | 12 | 2.2 |
| Conditioning | 2 min. | " | 4 | 1.1 |
| Bleaching | 6 min. | " | 12 | 0.22 |
| Fixing | 4 min. | " | 8 | 1.1 |
| Second Washing with Water | 4 min. | " | 8 | 7.5 |
| Stabilizing | 1 min. | 25 | 2 | 1.1 |

Each processing solution had the following composition.

| Black-and-White Development Solution: | Tank Solution | Replenisher |
|---|---|---|
| Pentasodium Salt of Nitrilo-N,N,N-trimethylenephosphonic Acid | 2.0 g | 2.0 g |
| Sodium Sulfite | 30 g | 30 g |
| Potassium Hydroquinonemonosulfonate | 20 g | 20 g |
| Potassium Carbonate | 33 g | 33 g |
| 1-Phenyl-4-methyl-4-hydroxymethyl-3-pyrazolidone | 2.0 g | 2.0 g |
| Potassium Bromide | 2.5 g | 1.4 g |
| Potassium Thiocyanate | 1.2 g | 1.2 g |
| Potassium Iodide | 2.0 mg | — |
| Water to make | 1000 ml | 1000 ml |
| pH | 9.60 | 9.60 |

The pH was adjusted with hydrochloric acid or potassium hydroxide.

| Reversal Solution: (both tank solution and replenisher) | |
|---|---|
| Pentasodium Salt of Nitrilo-N,N,N-trimethylenephosphonic Acid | 3.0 g |
| Stannous Chloride (dihydrate) | 1.0 g |
| p-Aminophenol | 0.1 g |
| Sodium Hydroxide | 8 g |
| Glacial Acetic Acid | 15 ml |
| Water to make | 1000 ml |

-continued

| Reversal Solution: (both tank solution and replenisher) | |
|---|---|
| pH | 6.00 |

The pH was adjusted with hydrochloric acid or sodium hydroxide.

| Color Developing Solution: | Tank Solution | Replenisher |
|---|---|---|
| Pentasodium Salt of Nitrilo-N,N,N-trimethylenephosphonic Acid | 2.0 g | 2.0 g |
| Sodium Sulfite | 7.0 g | 7.0 g |
| Sodium Tertiary Phosphate (dodecahydrate) | 36 g | 36 g |
| Potassium Bromide | 1.0 | — |
| Potassium Iodide | 90 mg | — |
| Sodium Hydroxide | 3.0 g | 3.0 g |
| Citrazinic Acid | 1.5 g | 1.5 g |
| N-Ethyl-N-(β-methanesulfonamidoethyl)-3-methyl-4-aminoaniline sulfate | 11 g | 11 g |
| 3,6-Dithiaoctane-1,8-diol | 1.0 g | 1.0 g |
| Water to make | 1000 ml | 1000 ml |
| pH | 11.80 | 12.00 |

The pH was adjusted with hydrochloric acid or potassium hydroxide.

| Conditioning Solution: (both tank solution and replenisher) | |
|---|---|
| Disodium Ethylenediaminetetraacetate (dihydrate) | 8.0 g |
| Sodium Sulfite | 12 g |
| 1-Thioglycerin | 0.4 ml |
| Sorbitan Ester* | 0.1 g |
| Water to make | 1000 ml |
| pH | 6.20 |

*Sorbitan Ester:

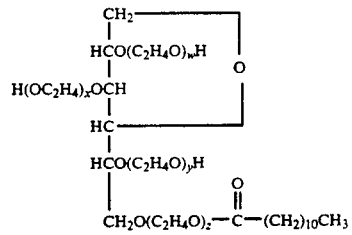

(w + x + y + z = 20)

The pH was adjusted with hydrochloric acid or sodium hydroxide.

| Bleaching Solution: | Tank Solution | Replenisher |
|---|---|---|
| Disodium Ethylenediaminetetra Acetate (dihydrate) | 2.0 g | 4.0 g |
| Ammonium Iron(III) Ethylenediaminetetraacetate (dihydrate) | 120 g | 240 g |
| Potassium Bromide | 100 g | 200 g |
| Ammonium Nitrate | 10 g | 20 g |
| Water to make | 1000 ml | 1000 ml |

-continued

| Bleaching Solution: | Tank Solution | Replenisher |
|---|---|---|
| pH | 5.70 | 5.50 |

The pH was adjusted with hydrochloric acid or sodium hydroxide.

| Fixing Solution: (both tank solution and replenisher) | |
|---|---|
| Ammonium Thiosulfate | 8.0 g |
| Sodium Sulfite | 5.0 g |
| Sodium Bisulfite | 5.0 g |
| Water to make | 1000 ml |
| pH | 6.60 |

The pH was adjusted with hydrochloric acid or aqueous ammonia.

| Stabilizing Solution: (both tank solution and replenisher) | |
|---|---|
| Formaldehyde (37% aq. soln.) | 5.0 ml |
| Polyoxyethylene-p-monononylphenyl ther (average degree of polymerization: 10) | 0.5 ml |
| Water to make | 1000 ml |
| pH | not adjusted |

The results confirmed that the sample according to the present invention had remarkably improved sharpness and excellent color reproducibility in comparison with the comparative sample.

EXAMPLE 5

The following First layer to Fourteenth layer were coated on the front side of a paper support (having a thickness of 100 μm), both surfaces of which were laminated with polyethylene, and the following Fifteenth Layer to Sixteenth Layer were coated on the back side of the paper support to prepare a color photographic light sensitive material which was designated Sample 501. The polyethylene laminated on the First Layer side of the support contained titanium dioxide (4 g/m$^2$) as a white pigment and a slight amount (0.003 g/m$^2$) of ultramarine as a bluish dye (the chromaticity of the surface of the support was 88.0, −0.20 and −0.75 in the L*, a* and b* system).

Layer Construction

The composition of each layer is shown below. The coating amounts of the components are described in units of g/m$^2$. With respect to silver halide, the coating amount is indicated in terms of the silver coating amount. The emulsion used in each layer was prepared according to the method for preparation of Emulsion EM1 described below. The emulsion used in the Fourteenth Layer was a Lippmann emulsion which had not been chemically sensitized at the surfaces of grains.

| | |
|---|---|
| First Layer: Antihalation Layer | |
| Black Colloidal Silver | 0.10 |
| Gelatin | 0.70 |
| Second Layer: Intermediate Layer | |
| Gelatin | 0.70 |
| Third Layer: Low-Speed Red-Sensitive Layer | |
| Silver bromide emulsion spectrally sensitized with red-sensitizing dyes (ExS-1, 2, 3) (average grain size: 0.25 μm, size distribution (coefficient of variation): 8%, octahedral) | 0.04 |
| Silver chlorobromide emulsion spectrally sensitized with red-sensitizing dyes (ExS-1, 2, 3) (silver chloride: 5 mol %, average grain size: 0.40 μm, size distribution: 10%, octahedral) | 0.08 |
| Gelatin | 1.00 |
| Cyan Coupler (ExC-1, 2, 3, mixing ratio: 1/1/0.2) | 0.30 |
| Color Fading Preventing Agent (Cpd-1, 2, 3, mixing ratio: 1/1/1) | 0.18 |
| Stain Preventing Agent (Cpd-5) | 0.003 |
| Coupler Dispersing Medium (Cpd-6) | 0.03 |
| Coupler Solvent (Solv-1, 2, 3, mixing ratio: 1/1/1) | 0.12 |
| Fourth Layer: High-Speed Red-Sensitive Layer | |
| Silver bromide emulsion spectrally sensitized with red-sensitizing dyes (ExS-1, 2, 3) (average grain size: 0.60 μm, size distribution: 15%, octahedral) | 0.14 |
| Gelatin | 1.00 |
| Cyan Coupler (ExC-1, 2, 3, mixing ratio: 1/1/0.2) | 0.30 |
| Color Fading Preventing Agent (Cpd-1, 2, 3, 4, mixing ratio: 1/1/1/1) | 0.18 |
| Coupler Dispersing Medium (Cpd-6) | 0.03 |
| Coupler Solvent (Solv-1, 2, 3, mixing ratio: 1/1/1) | 0.12 |
| Fifth Layer: Intermediate Layer | |
| Gelatin | 1.00 |
| Color Mixing Preventing Agent (Cpd-7) | 0.08 |
| Color Mixing Preventing Agent Solvent (Solv-4, 5, Mixing Ratio: 1/1) | 0.16 |
| Polymer Latex (Cpd-8) | 0.10 |
| Six Layer: Low-Speed Green-Sensitive Layer | |
| Silver bromide emulsion spectrally sensitized with green-sensitizing dye (ExS-4) (average grain size: 0.25 μm, size distribution: 8%, octahedral) | 0.04 |
| Silver chlorobromide emulsion spectrally sensitized with green-sensitizing dye (ExS-4) (silver chloride: 5 mol %, average grain size: 0.40 μm, size distribution: 10%, octahedral) | 0.06 |
| Gelatin | 0.80 |
| Magenta Coupler (ExM-1, 2, 3, mixing ratio: 1/1/1) | 0.11 |
| Color Fading Preventing Agent (Cpd-9, 26, mixing ratio: 1/1) | 0.15 |
| Stain Preventing Agent (Cpd-10, 11, 12, 13, mixing ratio: 10/7/7/1) | 0.025 |
| Coupler Dispersing Medium (Cpd-6) | 0.05 |
| Coupler Solvent (Solv-4, 6, mixing ratio: 1/1) | 0.15 |
| Seventh Layer: High-Speed Green-Sensitive Layer | |
| Silver bromide emulsion spectrally sensitized with green-sensitizing dye (ExS-4) (average grain size: 0.65 μm, size distribution: 16%, octahedral) | 0.10 |
| Gelatin | 0.80 |
| Magenta Coupler (ExM-1, 2, 3, mixing ratio: 1/1/1)) | 0.11 |
| Color Fading Preventing Agent (Cpd-9, 26, mixing ratio: 1/1) | 0.15 |
| Stain Preventing Agent (Cpd-10, 11, 12, 13, mixing ratio: 10/7/7/1) | 0.025 |
| Coupler Dispersing Medium (Cpd-6) | 0.05 |
| Coupler Solvent (Solv-4, 6, mixing ratio: 1/1) | 0.15 |
| Eighth Layer: Intermediate Layer | |
| Same as Fifth Layer | |
| Ninth Layer: Yellow Filter Layer | |
| Yellow Colloidal Silver (average grain size: 100 Å) | 0.12 |
| Gelatin | 0.70 |
| Color Mixing Preventing Agent (Cpd-7) | 0.03 |
| Color Mixing Preventing Agent Solvent (Solv-4, 5, mixing ratio: 1/1) | 0.10 |

-continued

| | |
|---|---|
| Polymer Latex (Cpd-8) | 0.07 |
| Tenth Layer: Intermediate Layer | |
| Same as Fifth Layer | |
| Eleventh Layer: Low-Speed Blue-Sensitive Layer | |
| Silver bromide emulsion spectrally sensitized with blue-sensitizing dyes (ExS-5, 6) (average grain size: 0.40 μm, size distribution: 8%, octahedral) | 0.07 |
| Silver chlorobromide emulsion spectrally sensitized with blue-sensitizing dyes (ExS-5, 6) (silver chloride: 8 mol %, average grain size: 0.60 μm, size distribution: 11%, octahedral) | 0.14 |
| Gelatin | 0.80 |
| Yellow Coupler (ExY-1, 2, mixing ratio: 1/1) | 0.35 |
| Color Fading Preventing Agent (Cpd-14) | 0.10 |
| Stain Preventing Agent (Cpd-5, 15, mixing ratio: 1/5) | 0.007 |
| Coupler Dispersing Medium (Cpd-6) | 0.05 |
| Coupler Solvent (Solv-2) | 0.10 |
| Twelfth Layer: High-Speed Blue-Sensitive Layer | |
| Silver bromide emulsion spectrally sensitized with blue-sensitizing dyes (ExS-5, 6) (average grain size: 0.85 μm, size distribution: 18%, octahedral) | 0.15 |
| Gelatin | 0.60 |
| Yellow Coupler (ExY-1, 2: mixing ratio: 1/1) | 0.30 |
| Color Fading Preventing Agent (Cpd-14) | 0.10 |
| Stain Preventing Agent (Cpd 5, 15, mixing ratio: 1/5) | 0.007 |
| Coupler Dispersing Medium (Cpd-6) | 0.05 |
| Coupler Solvent (Solv-2) | 0.10 |
| Thirteenth Layer: Ultraviolet Light Absorbing Layer | |
| Gelatin | 1.00 |
| Ultraviolet Light Absorbing Agent (Cpd-2, 4, 16, mixing ratio: 1/1/1) | 0.50 |
| Color Mixing Preventing Agent (Cpd-7, 17, mixing ratio: 1/1) | 0.03 |
| Dispersing Medium (Cpd-6) | 0.02 |
| Ultraviolet Light Absorbing Agent Solvent (Solv-2, 7 mixing ratio: 1/1) | 0.08 |
| Irradiation Preventing Dye (Cpd-18, 19, 20, 21, 27, mixing ratio: 10/10/13/15/20) | 0.05 |
| Fourteenth Layer: Protective Layer | |
| Silver chlorobromide fine particles (silver chloride: 97 mol %, average grain size: 0.1 μm) | 0.03 |
| Acryl-Modified Copolymer of Polyvinyl-Alcohol (average molecular weight: 50,000) | 0.01 |
| Polymethyl Methacrylate Particles (average particle size: 2.4 μm) and silicon oxide (average particle size: 5 μm, mixing ratio: 1/1) | 0.05 |
| Gelatin | 1.80 |
| Gelatin Hardener (H-1, 2; mixing ratio: 1/1) | 0.18 |
| Fifteenth Layer: Back Layer | |
| Gelatin | 2.50 |
| Ultraviolet Light Absorbing Agent (Cpd-2, 4, 16, mixing ratio: 1/1/1) | 0.50 |
| Dye (Cpd-18, 19, 20, 21, 27, mixing ratio: 1/1/1/1/1) | 0.06 |
| Sixteenth Layer: Back Protective Layer | |
| Polymethyl Methacrylate Particles (average particle size: 2.4 μm) and silicon oxide (average particle size: 5 μm, mixing ratio: 1/1 | 0.05 |
| Gelatin | 2.00 |
| Gelatin Hardener (H-1, 2, mixing ratio: 1/1) | 0.14 |

Preparation of Emulsion EM-1

An aqueous solution of potassium bromide and an aqueous solution of silver nitrate were added simultaneously to an aqueous gelatin solution at 75° C. over a period of 15 minutes while vigorously stirring, to obtain an octahedral silver bromide emulsion having an average grain diameter of 0.40 μm. At that time, 0.3 g of 3,4-dimethyl-1,3-thiazoline-2-thione per mol of silver was added. Then, 6 mg of sodium thiosulfate and 7 mg of chloroauric acid (tetrahydrate) were added to the emulsion per mol of silver in order and the emulsion was heated to 75° C. for 80 minutes for chemical sensitization. The thus-prepared silver bromide grains were used a cores and were further grown under the same precipitation conditions as described above to obtain finally a monodispersed octahedral core/shell type silver bromide emulsion having an average grain diameter of 0.7 μm. The coefficient of variation of the grain size was about 10%.

1.5 mg of sodium thiosulfate and 1.5 mg of chloroauric acid (tetrahydrate) were added to the emulsion per mol of silver, and the emulsion was heated to 60° C. for 60 minutes for chemical sensitization, thus an internal latent image type silver halide emulsion was obtained.

To each light-sensitive layer, were added as nucleating agents, ExZK-1 in an amount of $10^{-3}$% by weight, and ExZK-2 in an amount of $10^{-2}$, both as shown below, based on silver halide, and as a nucleation accelerating agent, Cpd-22 in an amount of $10^{-2}$% by weight based on silver halide.

Also, to each layer, as emulsifying and dispersing aids, Alkanol XC (manufactured by Du Pont) and sodium alkylbenzenesulfonate, and as coating aids, succinic acid ester and Magefac F-120 (manufactured by Dai Nippon Ink and Chemical Co, Ltd.) were added. Furthermore, to the layers containing silver halide or colloidal silver, (Cpd-23, 24, 25) were added as stabilizers.

The compounds used in this example are illustrated below.

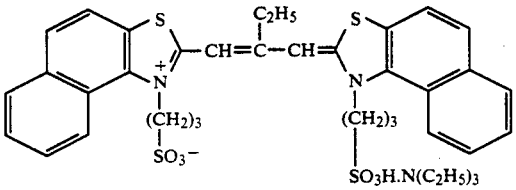

ExS-1

-continued
ExS-2
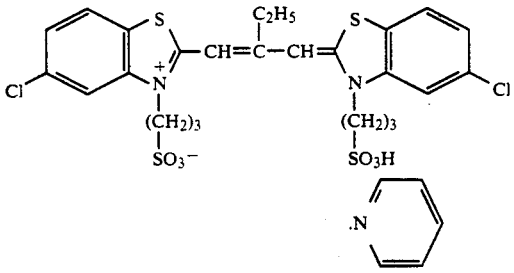
ExS-3
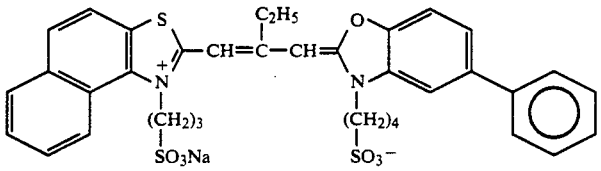
ExS-4
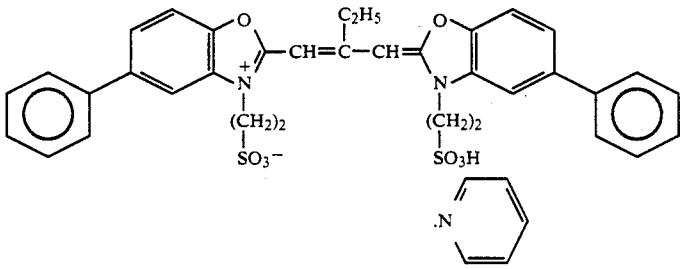
ExS-5
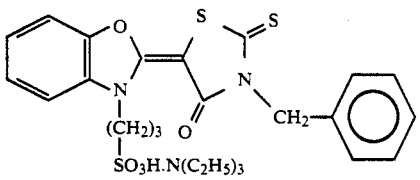
ExS-6
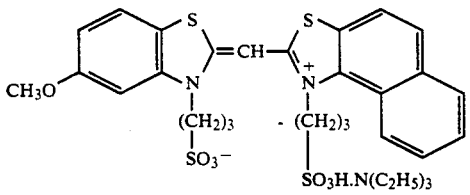
Cpd-1
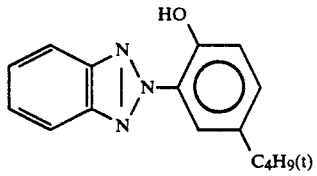
Cpd-2
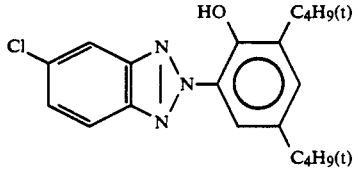

-continued
Cpd-3
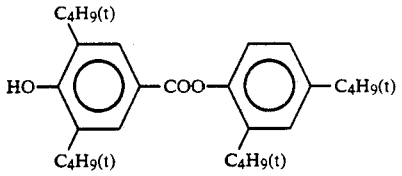
Cpd-4
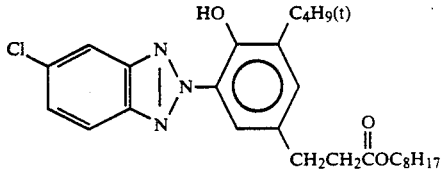
Cpd-5
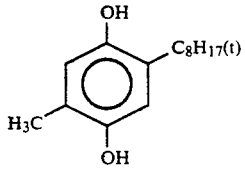
Cpd-6
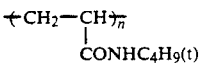
n = 100 ~ 1000
Cpd-7
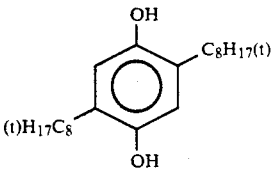
Cpd-8
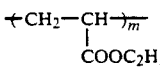
Cpd-9
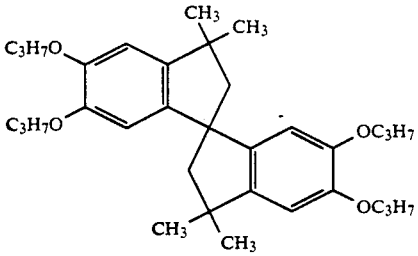
Cpd-10
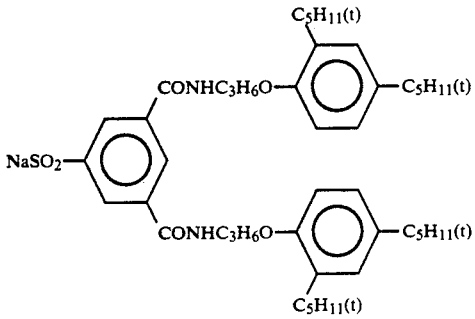

-continued
Cpd-11
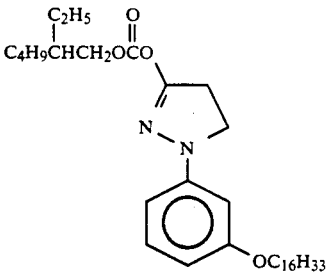
Cpd-12
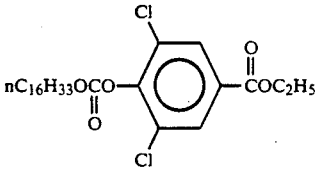
Cpd-13
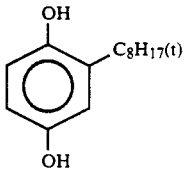
Cpd-14
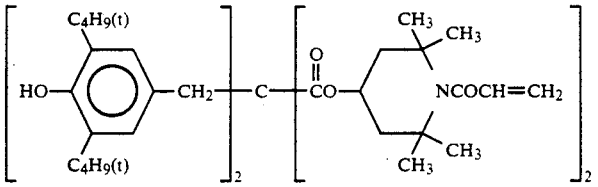
Cpd-15
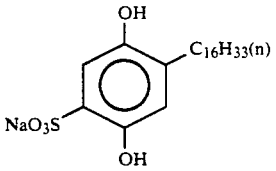
Cpd-16
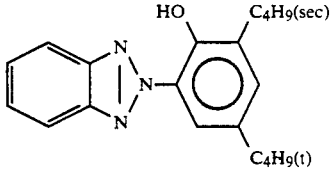
Cpd-17
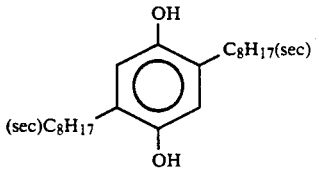
Cpd-18
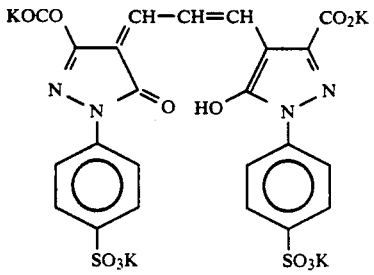

-continued
Cpd-19
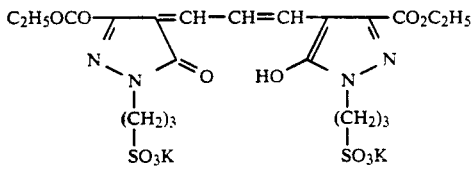
Cpd-20
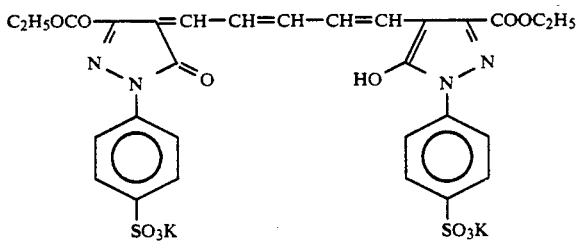
Cpd-21
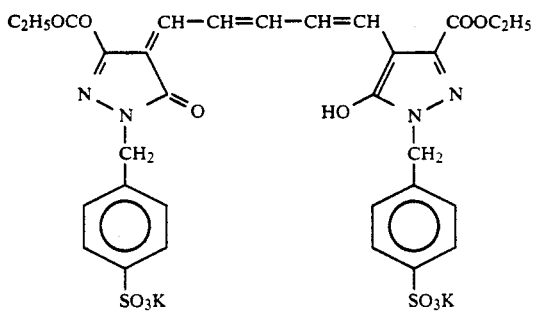
Cpd-22
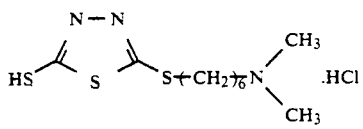
Cpd-23
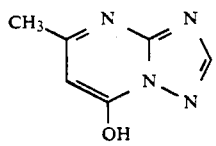
Cpd-24
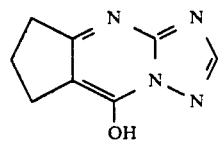
Cpd-25
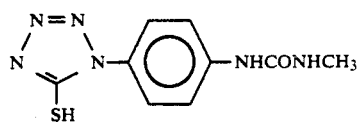
Cpd-26
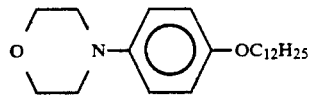
Cpd-27
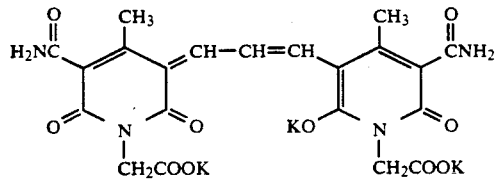

-continued
ExC-1
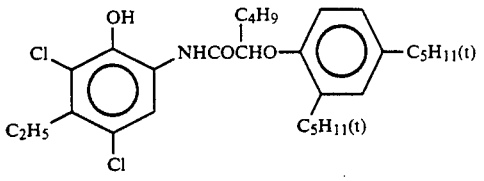
ExC-2
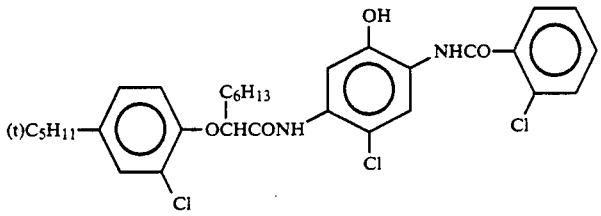
ExC-3
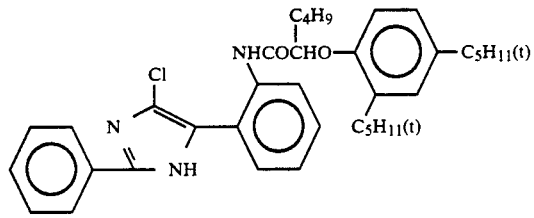
ExM-1
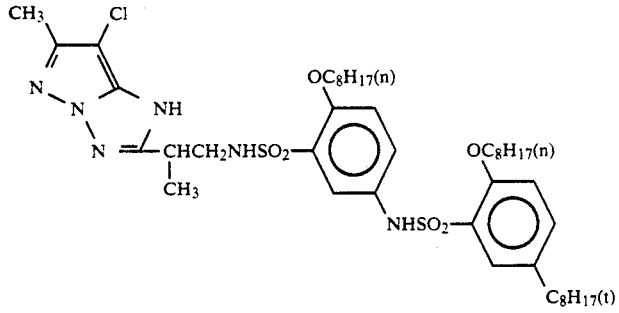
ExM-2
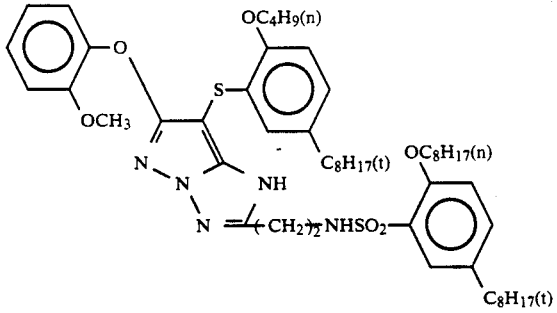
ExM-3
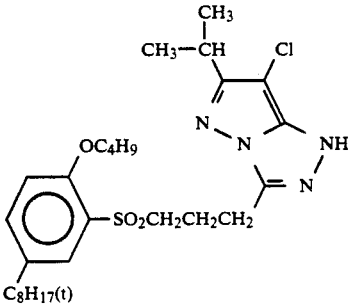

-continued

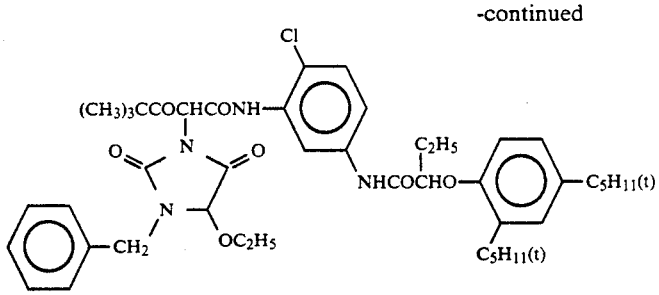

ExY-1

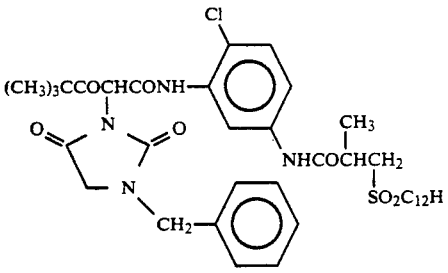

ExY-2

| | |
|---|---|
| Di(2-ethylhexyl) Sebacate | Solv-1 |
| Trinonyl Phosphate | Solv-2 |
| Di(3-methylhexyl) Phthalate | Solv-3 |
| Tricresyl Phosphate | Solv-4 |
| Dibutyl Phthalate | Solv-5 |
| Trioctyl Phosphate | Solv-6 |
| Di(2-ethylhexyl) Phthalate | Solv-7 |
| 1,2-bis(Vinylsulfonylacetamido)ethane | H-1 |
| 4,6-Dichloro-2-hydroxy-1,3,5-triazine Sodium Salt | H-2 |
| 7-(3-Ethoxythiocarbonylaminobenzamido)-9-methyl-10-propargyl-1,2,3,4-tetrahydroacri-dinium Trifluoromethanesulfonate | ExZK-1 |
| 2-[4-{3-[3-{3-[5-{3-[2-Chloro-5-(1-dodecyl-oxycarbonylethoxycarbonyl)-phenylcarbamoyl]-4-hydroxy-1-naphthylthio}tetrazol-1-yl]-phenyl}ureido]-benzenesulfonamido}phenyl]-1-formylhydrazine | ExZK-2 |

Sample 502 was prepared in the same manner as described for Sample 501 except for adding 3 mg/m$^2$ of Compound I-23 according to the present invention to each of the Third, Fourth, Sixth, Seventh, Eleventh and Twelfth Layers of Sample 501.

Sample 503 was prepared in the same manner as described for Sample 502 except for using Compound I-25 according to the present invention in place of Compound I-23 used in Sample 502.

Samples 501 to 503 thus prepared were imagewise exposed and then processed according to the processing method described below using an automatic developing machine.

| Processing Step | Time (sec) | Temperature (°C.) | Capacity (l) | Amount of Replenisher (ml/m$^2$) |
|---|---|---|---|---|
| Color Development | 135 | 38 | 15 | 300 |
| Bleach-Fixing | 40 | 33 | 3 | 300 |
| Washing with Water (1) | 40 | 33 | 3 | — |
| Washing with Water (2) | 40 | 33 | 3 | 320 |
| Drying | 30 | 80 | | |

The replenishment system for the washing water was a countercurrent replenishment system in which replenisher was added to water washing bath (2), and the overflow solution from water washing bath (2) was introduced into water washing bath (1). In the processing method, the amount of the bleach-fixing solution carried over from the bleach-fixing bath together with the photographic material being processed into water washing bath (1) was 35 ml/m$^2$, and the volume of the replenisher of the washing water to the amount of bleach-fixing solution carried over was 9.1 times.

The compositions of the processing solutions used were as follows.

| Color Developing Solution | Tank Solution | Replenisher |
|---|---|---|
| D-Sorbitol | 0.15 g | 0.20 g |
| Sodium Naphthalenesulfonate and Formaldehyde Condensate | 0.15 g | 0.20 g |
| Ethylenediaminetetrakismethylene-phosphonic Acid | 1.5 g | 1.5 g |
| Diethylene Glycol | 12.0 ml | 16.0 ml |
| Benzyl Alcohol | 13.5 ml | 18.0 ml |
| Potassium Bromide | 0.80 g | — |
| Benzotriazole | 0.003 g | 0.004 g |
| Sodium Sulfite | 2.4 g | 3.2 g |
| N,N-bis(Carboxymethyl)hydrazine | 6.0 g | 8.0 g |
| D-Glucose | 2.0 g | 2.4 g |
| Triethanolamine | 6.0 g | 8.0 g |
| N-Ethyl-N-(β-methanesul-fonamidoethyl)-3-methyl-4-aminoaniline sulfate | 6.4 g | 8.5 g |
| Potassium Carbonate | 30.0 g | 25.0 g |
| Fluorescent Whitening Agent (diaminostilbene type) | 1.0 g | 1.2 g |
| Water to make | 1,000 ml | 1,000 ml |
| pH (at 25° C.) | 10.25 | 10.75 |

| Bleach-Fixing solution (both Tank Solution and Replenisher) | |
|---|---|
| Disodium Ethylenediaminetetraacetate Dihydrate | 4.0 g |
| Ammonium Iron(III) Ethylenediamine- | 70.0 g |

-continued

| | |
|---|---|
| Tetraacetate Dihydrate | |
| Ammonium Thiosulfate (700 g/liter) | 180 ml |
| Sodium p-Toluenesulfinate | 20.0 g |
| Sodium Bisulfite | 20.0 g |
| 5-Mercapto-1,3,4-triazole | 0.5 g |
| Ammonium Nitrate | 10.0 g |
| Water to make | 1,000 ml |
| pH (at 25° C.) | 6.20 |

Washing Water (both Tank Solution and Replenisher)

City water was passed through a mixed bed type column filled with an H type strong acidic cation exchange resin (Amberlite IR-120B manufactured by Rohm & Haas Co.) and an OH type anion exchange resin (Amberlite IR-400 manufactured by Rohm & Haas Co.) to obtain water containing not more than 3 mg/liter of each of calcium ion and magnesium ion. To the water thus-treated were added sodium dichloroisocyanurate in an amount of 20 mg/liter and sodium sulfate in an amount of 1.5 g/liter. The pH of the washing water was in the range from 6.5 to 7.5.

The a results, confirmed that Samples 502 and 503 according to the present invention had excellent color reproducibility in comparison with Sample 501 for comparison.

EXAMPLE 6

Samples 601 and 602 were prepared by adding 3 mg/m$^2$ of Compounds I-23 and I-25 according to the present invention to each of the Third, Fourth, Sixth, Seventh, Ninth and Tenth Layers of a sample prepared in accordance with the procedures used to prepare Sample 102 in Example 1 of JP-A-1-112241, respectively.

These samples were exposed and processed in the same manner as described in Example 1 of JP-A-1-112241.

The results confirmed that these samples had excellent color reproducibility.

EXAMPLE 7

A biaxially drawn polyethylene terephthalate film (having a thickness of 175 mμ) was subjected to a corona discharge treatment and thereon was coated a first subbing solution having the composition described below in a coating amount of 5.1 ml/m$^2$ using a wire bar coater, followed by drying at 175° C. for one minute. Then, in the same manner as described above, the first subbing layer was coated on the opposite side of the film.

| First Subbing solution | |
|---|---|
| Butadiene-styrene copolymer latex solution* (solid content: 40%, butadiene/styrene = 31/69 by weight) | 79 ml |
| 2,4-Dichloro-6-hydroxy-2-triazine Sodium Salt (4% aq. soln.) | 20.5 ml |
| Distilled water | 900.5 ml |

*The latex solution contained the following emulsifying dispersing agent in an amount of 0.4% by weight based on the solid content of the latex:

$$\begin{array}{l}(n)C_6H_{13}OOCCH_2\\ \quad\quad\quad\quad\quad\quad | \\ (n)C_6H_{13}OOCCH{-}SO_3H\end{array}$$

On the first subbing layer on each side of the film a second subbing solution having the composition described below was coated in a coating amount of 8.5 ml/m$^2$ and dried to prepare a subbed film.

| Second Subbing Solution | |
|---|---|
| Gelatin | 30 g |
| Dye 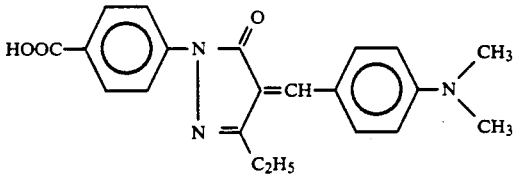 (dispersed in a ball mill for 6 hours) | 0.2 g |
| 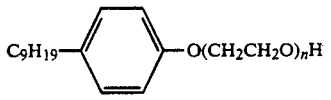 (n = 8.5) | |
| Matting Agent Polymethyl Methacrylate Particles (having an average grain size of 2.5 μm) | 0.3 g |
| 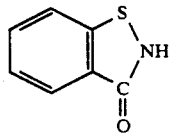 | 0.035 g |
| Water to make | 1 l |

Preparation of Coating Solution for Emulsion Layers

To one liter of water were added 5 g of potassium bromide, 0.05 g of potassium iodide, 30 g of gelatin and 2.5 ml of a 5% aqueous solution of a thioether compound, $(HO(CH_2)_2S(CH_2)_2S(CH_2)_2OH)$. To the resulting solution maintained at 73° C. were added with stirring an aqueous solution containing 8.33 g of silver nitrate and an aqueous solution containing 5.94 g of potassium bromide and 0.726 g of potassium iodide using a double jet method over a period of 45 seconds. The 2.5 g of potassium bromide was added and an aqueous solution containing 8.33 g of silver nitrate was added thereto over a period of 7 minutes and 30 seconds while controlling the flow rate at the end of the addition twice the flow rate at the start of the addition.

Thereafter, an aqueous solution containing 153.34 g of silver nitrate and an aqueous solution containing potassium bromide and potassium iodide were added using a controlled double jet method over a period of 25 minutes while maintaining the pAg of 8.1. The flow rate was increased so that the flow rate at the end of the addition became 8 times the flow rate at the start of the addition. After the completion of the addition, 15 ml of a 2N aqueous potassium thiocyanate solution was added and further 50 ml of a 1% aqueous potassium iodide solution was added over a period of 30 seconds. The temperature of the mixture was decreased to 35° C., and the soluble salts were removed by flocculation. The temperature was increased to 40° C., then 68 g of gelatin, 2 g of phenol and 7.5 g of trimethylol propane were added thereto and the pH and pAg were adjusted to 6.55 and 8.10 using sodium hydroxide and potassium bromide. The temperature of the mixture was increased to 56° C., and 175 mg of 4-hydroxy-6-methyl-1,3,3a,7-tetraazaindene and 625 mg of the sensitizing dye described below were added thereto. After 10 minutes, 5.5 mg of sodium thiosulfate pentahydrate, 163 mg of potassium thiocyanate and 3.6 mg of chloroauric acid were added thereto, followed by rapid cooling after 5 minutes to set. As a result, an emulsion wherein grains having an aspect ratio of not less than 3 occupied 93% of the total projected area of all of the grains, and with respect to all grains having an aspect ratio of not less than 2 an average diameter of the projected area of 0.95 mμ, a standard deviation of 23%, an average thickness of 0.155 μm, and an aspect ratio of 6.1 was obtained.

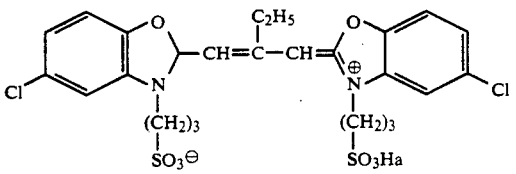

A coating solution was prepared by adding the materials described below to the above described emulsion. The amounts of the materials added are indicated based on mol of silver halide.

| Compound according to the Present Invention (shown in Table 4 below) | |
|---|---|
| 2,6-bis(Hydroxyamino)-4-diethylamino-1,3,5-triazine | 80 mg |
| Sodium Polyacrylate (average molecular weight: 41,000) | 4.0 g |
| 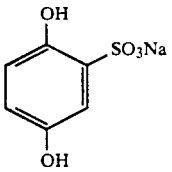 | 9.7 g |
| Plasticizer Copolymer of Ethyl Acrylate/Acrylic Acid/Methacrylic Acid (95/2/3) | 20.0 g |
| Nitron | 50 mg |
| 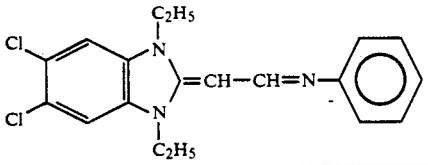 | 5.0 mg |

The coating solution for the emulsion layer was coated simultaneously with a coating solution for a surface protective layer using a co-extrusion method on both surfaces of the support. The coating amounts of the compounds in the silver halide emulsion layer and the surface protective layer were as follows:

| | |
|---|---|
| Emulsion Layer | |
| Silver | 1.9 g/m² |
| Gelatin | 1.5 g/m² |
| Surface Protective Layer | |
| Gelatin | 0.81 g/m² |
| Dextran (average molecular weight: 39,000) | 0.81 g/m² |
| Matting Agent Copolymer of Methyl Methacrylate and Methacrylic Acid (9/1) (average particle size: 3.5 μm) | 0.06 g/m² |
| 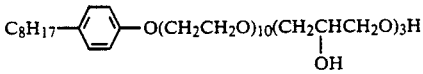 | 60 mg/m² |
| 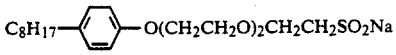 | 20 mg/m² |
| $C_8F_{17}SO_2N(C_3H_7)(CH_2CH_2O)_4(CH_2)_4SO_3Na$ | 2 mg/m² |
| $C_8F_{17}SO_2N(C_3H_7)(CH_2CH_2O)_{15}H$ | 5 mg/m² |
| 4-Hydroxy-6-methyl-1,3,3a,7-tetrazaindene | 15.5 mg/m² |
| Sodium Polyacrylate (average molecular weight: 41,000) | 70 mg/m² |

Further, 56 mg/m² of 1, 2-bis(sulfonylacetamido) ethane was added as a hardening agent to the coating solutions on one side of the support. Thus, photographic materials were prepared.

Evaluation of Photographic Performance

Each of these photographic materials was subjected to X-ray sensitometry using a cassette equipped with a GRENEX ortho screen HR-4 (manufactured by Fuji Photo Film Co., Ltd.). Control of the amount of exposure was conducted by changing the distance between the X-ray tube and the cassette. The exposed materials were subjected to development processing according to the processing steps described below using an automatic developing machine.

| Processing Step | Temperature (°C.) | Time (sec) |
|---|---|---|
| Development | 35 | 9.5 |
| Fixing | 31 | 10 |
| Washing with water | 15 | 6 |
| Squeezing | | 6 |
| Drying | 50 | 12 |

(Processing time of dry to dry: 45 seconds)

The compositions of the processing solutions used were as follows.

| | |
|---|---|
| Developing Solution | |
| Potassium Hydroxide | 29 g |
| Potassium Sulfite | 44.2 g |
| Sodium Hydrogen Carbonate | 7.5 g |
| Boric Acid | 1.0 g |
| Diethylene Glycol | 12 g |
| Ethylenediaminetetraacetic Acid | 1.7 g |
| 5-Methylbenzotriazole | 0.06 g |
| Hydroquinone | 25 g |
| Glacial Acetic Acid | 18 g |
| Triethylene Glycol | 12 g |
| 5-Nitroindazole | 0.25 g |
| 1-Phenyl-3-pyrazolidone | 2.8 g |
| Glutaraldehyde (50 wt/wt %) | 9.86 g |
| Sodium Methabisulfite | 12.6 g |
| Potassium Bromide | 3.7 g |
| Water to make | 1.0 l |
| Fixing Solution | |
| Ammonium Thiosulfate (70 wt/vol %) | 200 ml |
| Disodium Ethylenediaminetetraacetate Dihydtate | 0.02 g |

-continued

| | |
|---|---|
| Sodium Sulfite | 15 g |
| Boric Acid | 10 g |
| Sodium Hydroxide | 6.7 g |
| Glacial Acetic Acid | 15 g |
| Aluminium Sulfate | 10 g |
| Sulfuric Acid (36N) | 3.9 g |
| Water to make | 1 l |
| pH was adjusted to 4.25 | |

The results obtained are shown in Table 4 below.

TABLE 4

| Sample | Compound | Amount Added (mg/mol AgX) | Maximum Density |
|---|---|---|---|
| 701 (Control) | none | — | 3.18 |
| 702 (Present Invention) | I-7 | 360 | 3.41 |
| 703 (Present Invention) | I-23 | 670 | 3.43 |
| 704 (Present Invention) | I-25 | 530 | 3.40 |

From the results shown in Table 4 above, it can be seen that the samples using the compound according to the present invention provide high maximum density and excellent image quality.

EXAMPLE 8

An emulsion of each layer, a dispersion of zinc hydroxide, a dispersion of active carbon, a dispersion of electron transfer agent, dispersions of yellow, magenta and cyan dye providing compounds and a dispersion for an intermediate layer were prepared in the manner as described below, and Light-Sensitive Material 801 was prepared using these components.

Further, an image receiving material as described in Table 6 below was prepared.

The method for preparation of the emulsion for the blue-sensitive layer is described below.

Solutions (I) and (II) described below were simultaneously added to an aqueous solution of gelatin which had been prepared by dissolving 20 g of gelatin, 3 g of potassium bromide, 0.03 g of Compound (A) described below and 0.25 g of $HO(CH_2)_2S(CH_2)_2S(CH_2)_2OH$ in 800 ml of water and kept at a temperature of 50° C., over a period of 30 minutes while the mixture was stirred vigorously. Thereafter, Solutions (III) and (IV) were added thereto simultaneously over a period of 20 minutes. Five minutes after the beginning of the addition of Solutions (III) and (IV), a solution of the dye described below was added thereto over a period of 18 minutes.

After being washed with water and desalted, to the emulsion was added 20 g of lime-processed ossein gelatin, and the pH and pAg thereof were adjusted to 6.2 and 8.5, respectively. The emulsion was subjected to optimum chemical sensitization with sodium thiosulfate, 4-hydroxy-6-methyl-1,3,3a,7-tetraazaindene and chloroauric acid. Thus, 600 g of a monodispersed cubic silver chlorobromide emulsion having an average particle size of 0.40 μm was obtained.

| | Solution (I) | Solution (II) | Solution (III) | Solution (IV) |
|---|---|---|---|---|
| $AgNO_3$ | 30 g | — | 70 g | — |
| KBr | — | 17.8 g | — | 49 g |
| NaCl | — | 1.6 g | — | — |
| | Water to make 180 ml | Water to make 180 ml | Water to make 350 ml | Water to make 350 ml |

Dye Solution

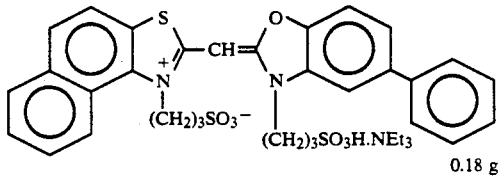

0.18 g and

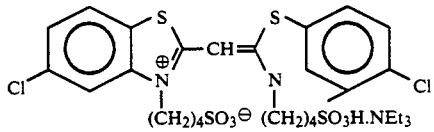

0.06 g dissolved in 160 ml of methanol.

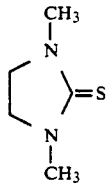

Compound (A)

The method for preparation of the emulsion for the green-sensitive layer is described below.

Solutions (I) and (II) described below were simultaneously added to an aqueous solution of gelatin as described below which was being maintained at 50° C. over a period of 30 minutes while the solution was stirred vigorously. Then, Solutions (III) and (IV) described below were added thereto over a period of 30 minutes. One minute after the completion of the addition a dye solution described below was added.

Gelatin Solution

| | |
|---|---|
| Gelatin | 20 g |
| NaCl | 6 g |
| KBr | 0.3 g |

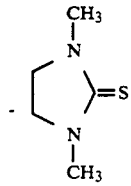

0.015 g $H_2O$ 730 ml

| | Solution (I) | Solution (II) | Solution (III) | Solution (IV) |
|---|---|---|---|---|
| $AgNO_3$ | 50 g | — | 50 g | — |

-continued

| | | | | |
|---|---|---|---|---|
| KBr | — | 21 g | — | 28 g |
| NaCl | — | 6.9 g | — | 3.5 g |
| | Water to make 200 ml | Water to make 200 ml | Water to make 200 ml | Water to make 200 ml |

Dye Solution

A solution containing 0.23 g of

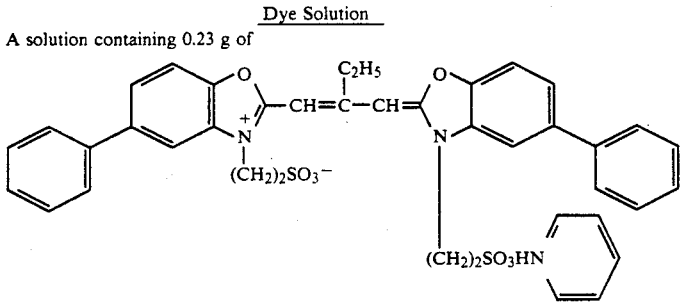

in 154 ml of methanol.

After being washed with water and desalted, 20 g of gelatin was added to the emulsion, and the pH and pAg thereof were adjusted. Then, the emulsion was subjected to optimum chemical sensitization using triethylthiourea, chloroauric acid and 4-hydroxy-6-methyl-1,3,3a,7-tetraazaindene. Thus, 630 g of a monodispersed cubic emulsion having an average particle size of 0.40 μm was obtained.

The method for preparation of the emulsion for the red-sensitive layer is described below.

Solutions (I) and (II) described below were simultaneously added to an aqueous solution of gelatin which had been prepared by dissolving 20 g of gelatin, 0.3 g of potassium bromide, 6 g of sodium chloride and 30 mg of Agent (A) described below in 800 ml of water and kept at a temperature of 50° C., at the same flow rate over a period of 30 minutes while the solution was stirred vigorously. Thereafter, Solutions (III) and (IV) described below were added thereto simultaneously over a period of 30 minutes. Three minutes after the beginning of the addition of Solution (III) and (IV), a solution of the dye described below was added thereto over a period of 20 minutes.

After being washed with water and desalted, to the emulsion was added 22 g of lime-processed ossein gelatin, and the pH and pAg thereof were adjusted to 6.2 and 7.7, respectively. Then, the emulsion was subjected to optimum chemical sensitization while maintaining at 60° C. with sodium thiosulfate, chloroauric acid and 4-hydroxy-6-methyl-1,3,3a,7-tetraazaindene. Thus, 635 g of a monodispersed cubic silver chlorobromide emulsion having an average particle size of 0.38 mμ was obtained.

| | Solution (I) | Solution (II) | Solution (III) | Solution (IV) |
|---|---|---|---|---|
| $AgNO_3$ | 50 g | — | 50 g | — |
| KBr | — | 28.0 g | — | 35.0 g |
| NaCl | — | 3.4 g | — | — |
| | Water to make 200 ml | Water to make 200 ml | Water to make 200 ml | Water to make 200 ml |

Agent A

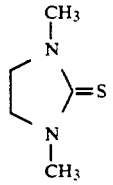

Dye Solution

A solution containing 67 mg of Dye (a) and 133 mg of Dye (b) dissolved in 100 ml of methanol.

Dye (a)

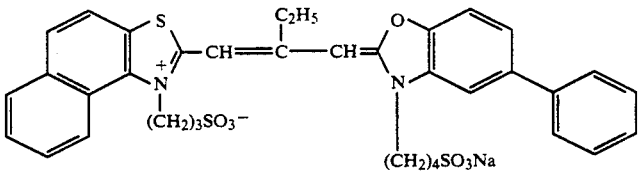

Dye (b)

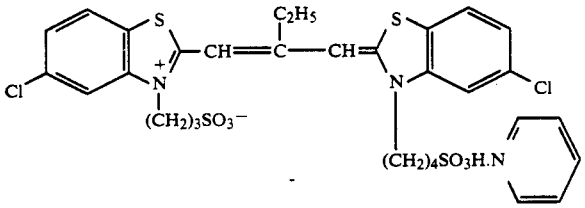

The method for preparation of the dispersion of zinc hydroxide is described below.

To 100 ml of 4% aqueous gelatin were added 12.5 g of zinc hydroxide with an average particle size of 0.2μ and, as dispersants, 1 g of carboxymethyl cellulose and 0.1 g of sodium polyacrylate. The mixture was ground in a mill containing glass beads with an average particle size of 0.75 mm for 30 minutes. After separating the glass beads, a dispersion of zinc hydroxide was obtained.

The method for preparation of the dispersion of active carbon is described below.

A mixture of 2.5 g of active carbon powder (special grade reagent manufactured by Wakojunyaku Co.), 1 g of Demol N (manufactured by Kao Sekken Co.) and 0.25 g of polyethylene glycol nonylphenyl ether as dispersing agents, and 100 ml of a 5% aqueous solution of gelatin was ground in a mill using glass beads having an average particle size of 0.75 mm for 120 minutes. After separating the glass beads, the dispersion of active carbon having an average particle size of 0.5 mμ was obtained.

The method for preparation of a dispersion of an electron transfer agent is described below.

A mixture of 10 g of the electron transfer agent described below, 0.5 g of polyethylene glycol nonylphenyl ether and 0.5 g of the anionic surface active agent described below as dispersing agents, and a 5% aqueous solution of gelatin was ground in a mill using glass beads having an average particle size of 0.75 mm for 60 minutes. After separating the glass beads, a dispersion of an electron transfer agent having an average particle size of 0.3 mμ was obtained.

Electron Transfer Agent:

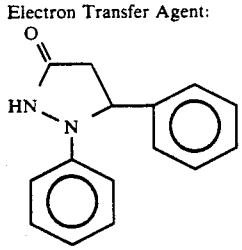

Anionic Surface Active Agent:

$$NaO_3S-\underset{}{\overset{CH_2COOCH_2CH(C_2H_5)C_4H_9}{\overset{|}{CH}}}COOCH_2CH(C_2H_5)C_4H_9$$

The method for preparation of the gelatin dispersion of the dye providing compound is described below.

With yellow, magenta or cyan, 50 ml of ethyl acetate was added to the composition described below and the mixture was heated at about 60° C. to form a uniform solution. The resulting solution was mixed while stirring with 100 g of a 10% aqueous solution of lime-processed gelatin, 0.6 g of sodium dodecylbenzenesulfonate and 50 ml of water, and the mixture was then dispersed using a homogenizer at 10,000 rpm for 10 minutes. The dispersion thus obtained was a gelatin dispersion of the dye providing compound.

| | Yellow | Magenta | Cyan |
|---|---|---|---|
| Dye Providing Compound | (1): 13 g | (2): 15.5 g | (3): 16.6 g |
| Electron Donor (1) | 10.2 g | 8.6 g | 8.1 g |
| High Boiling Solvent (2) | 6.5 g | 7.8 g | 8.3 g |
| Electron Transfer Agent Precursor (3) | 0.4 g | 0.7 g | 0.7 g |
| Compound (A) | 3.9 g | — | — |

Dye Providing Compound (1)

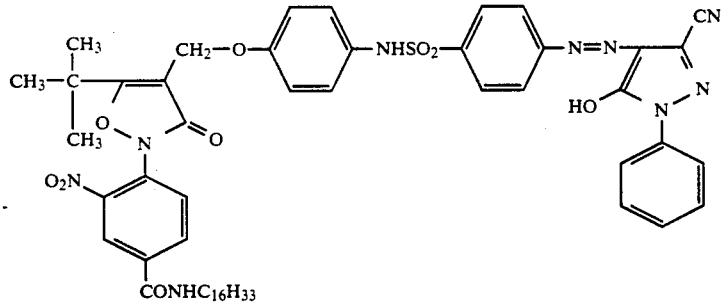

Dye Providing Compound (2)

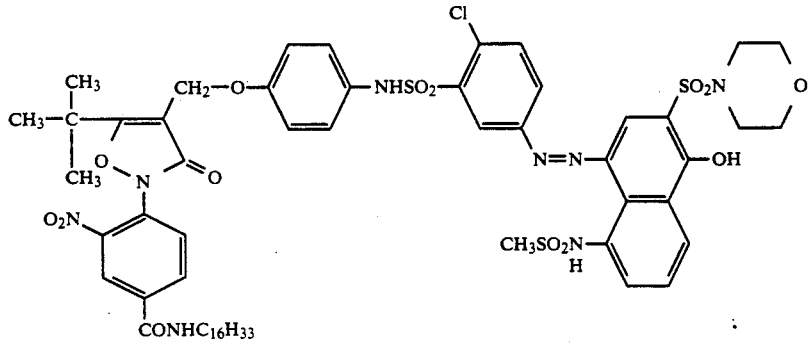

-continued

Dye Providing Compound (3)

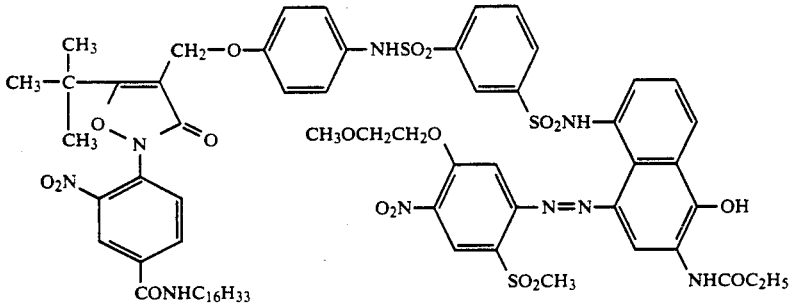

Electron Donor (1)

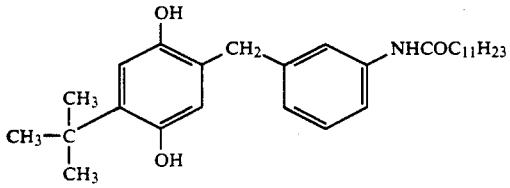

High Boiling Solvent (2)

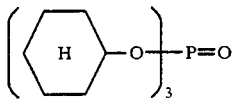

Electron Transfer Agent Precursor (3)

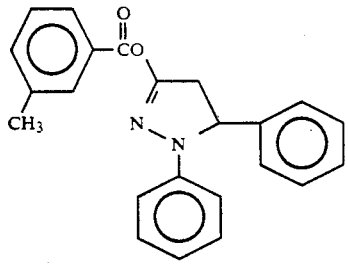

Compound A $CO_2C_{12}H_{25}$
|
$CO_2C_{12}H_{25}$

The method for preparation of the gelatin dispersion of Electron Donor (4) for the intermediate layer is described below.

23.6 g of Electron Donor (4) described below and 8.5 g of High Boiling Solvent (2) described above were added to 30 ml of ethyl acetate to form a uniform solution. The resulting solution was mixed while stirring with 100 g of a 10% aqueous solution of lime-processed gelatin, 0.25 g of sodium hydrogensulfite, 0.3 g of sodium dodecylbenzenesulfonate and 30 ml of water, and the mixture was then dispersed using a homogenizer at 10,000 rpm for 10 minutes. The dispersion thus obtained was designated a gelatin dispersion of Electron Donor (4).

Electron Donor (4)

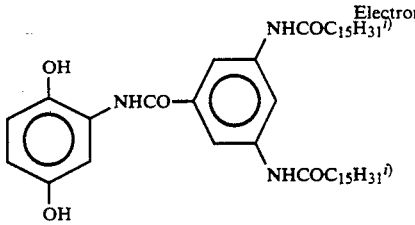

Using the components described above, Light-Sensitive Material 801 shown in Table 5 below was prepared. In the following table, the coating amount of each component is set forth in parentheses.

TABLE 5

Construction of Light-Sensitive Material 801

| No. | Additive | Addition Amount (mg/m²) |
|---|---|---|
| Sixth Layer: Protective Layer | Gelatin | 900 |
| | Silica (size: 4 mμ) | 40 |
| | Zinc Hydroxide | 900 |
| | Surface Active Agent (5)*1 | 130 |
| | Surface Active Agent (6)*2 | 26 |
| | Polyvinyl Alcohol | 63 |
| | Lactose | 155 |
| | Water-soluble Polymer*3 | 8 |
| Fifth Layer: Blue-Sensitive Emulsion Layer | Light-sensitive Silver Halide Emulsion | 380 (as silver) |
| | Antifogging Agent (7)*4 | 0.9 |
| | Gelatin | 560 |
| | Yellow Dye Providing Compound (1) | 400 |
| | Electron Donor (1) | 320 |
| | Electron Transfer Agent Precursor (3) | 25 |
| | Compound A (120 mg/m²), High Boiling Solvent (2) | 200 |
| | Surface Active Agent (8)*5 | 45 |
| | Water-soluble Polymer*3 | 13 |
| Fourth Layer: Intermediate Layer | Gelatin | 555 |
| | Electron Donor (4) | 130 |
| | High Boiling Solvent (2) | 48 |
| | Electron Transfer Agent (10)*7 | 85 |
| | Polyvinyl Alcohol | 30 |
| | Lactose | 155 |
| | Surface Active Agent (6)*2 | 15 |
| | Surface Active Agent (8)*5 | 4 |
| | Surface Active Agent (9)*6 | 30 |
| | Water-soluble Polymer*3 | 19 |
| | Hardening Agent (11)*8 | 37 |
| Third Layer: Green-Sensitive Emulsion Layer | Light-sensitive Silver Halide Emulsion | 220 (as silver) |
| | Antifogging Agent (12)*9 | 0.7 |
| | Gelatin | 370 |
| | Magenta Dye Providing Compound (2) | 350 |
| | Electron Donor (1) | 195 |
| | Electron Transfer Agent Precursor (3) | 33 |
| | High Boiling Solvent (2) | 175 |
| | Surface Active Agent (8)*5 | 47 |
| | Water-Soluble Polymer*3 | 11 |
| Second Layer: Intermediate Layer | Gelatin | 650 |
| | Zinc Hydroxide | 300 |
| | Electron Donor (4) | 130 |
| | High Boiling Solvent (2) | 50 |
| | Surface Active Agent (6)*2 | 11 |
| | Surface Active Agent (8)*5 | 4 |
| | Surface Active Agent (9)*6 | 50 |
| | Polyvinyl Alcohol | 50 |
| | Lactose | 155 |
| | Water-Soluble Polymer*3 | 12 |
| | Active Carbon | 25 |
| First Layer: Red-Sensitive Emulsion Layer | Light-sensitive Silver Halide Emulsion | 230 (as silver) |
| | Antifogging Agent (12)*9 | 0.7 |
| | Gelatin | 330 |
| | Cyan Dye Providing Compound (3) | 340 |
| | Electron Donor (1) | 133 |
| | Electron Transfer Agent Precursor (3) | 30 |
| | High Boiling Solvent (2) | 170 |
| | Surface Active Agent (8)*5 | 40 |

TABLE 5-continued

Construction of Light-Sensitive Material 801

| | Water-Soluble Polymer*3 | 5 |
|---|---|---|

Support

Polyethylene Terephthalate Film (thickness: 96 μm) having a carbon black coating as a back layer. The additives shown in Table 8 above other than those described hereinbefore are illustrated below.

*1Surface Active Agent (5)

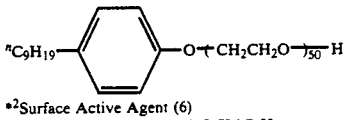

*2Surface Active Agent (6)

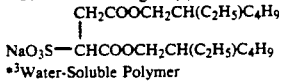

*3Water-Soluble Polymer

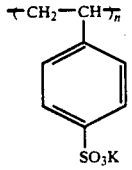

*4Antifogging Agent (7)

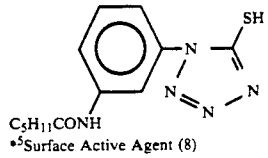

*5Surface Active Agent (8)

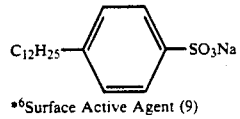

*6Surface Active Agent (9)

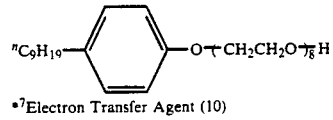

*7Electron Transfer Agent (10)

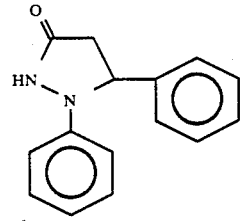

*8Hardening Agent (11)
1,2-bis(Vinylsulfonylacetamido)ethane

*10Antifogging Agent (12)

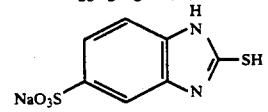

TABLE 6

Construction of Image Receiving Material

| No. | Additive | Addition Amount (g/m²) |
|---|---|---|
| Third Layer | Gelatin | 0.05 |
| | Silicone Oil (1) | 0.04 |
| | Surface Active Agent (1) | 0.001 |
| | Surface Active Agent (2) | 0.02 |
| | Surface Active Agent (3) | 0.10 |
| | Matting Agent (1) | 0.02 |
| | Guanidium Picorate | 0.45 |
| | Water-Soluble Polymer (1) | 0.24 |
| Second Layer | Mordant (1) | 2.35 |
| | Water-Soluble Polymer (1) | 0.20 |
| | Gelatin | 1.40 |

TABLE 6-continued

| | | |
|---|---|---|
| | Water-Soluble Polymer (2) | 0.60 |
| | High Boiling Solvent (1) | 1.40 |
| | Guanidium Picorate | 2.25 |
| | Fluorescent Brightening Agent (1) | 0.05 |
| | Surface Active Agent (5) | 0.15 |
| First Layer | Gelatin | 0.45 |
| | Surface Active Agent (3) | 0.01 |
| | Water-Soluble Polymer (1) | 0.04 |
| | Hardening Agent (1) | 0.30 |
| Support (1) | (shown below) | |
| First Back | Gelatin | 3.25 |
| | Hardening Agent (1) | 0.25 |
| Second Back Layer | Gelatin | 0.44 |
| | Silicone Oil (1) | 0.08 |
| | Surface Active Agent (4) | 0.04 |
| | Surface Active Agent (5) | 0.01 |
| | Matting Agent (2) | 0.03 |

Construction of Support (1)

| Layer | Composition | | Layer Thickness (mμ) |
|---|---|---|---|
| Surface Subbing Layer | Gelatin | | 0.1 |
| Surface PE Layer (glossy) | Low-Density Polyethylene (density: 0.923) | 89.2 parts | 45.0 |
| | Titanium Oxide surface treated | 10.0 parts | |
| | Ultramarine | 0.8 part | |
| Pulp Layer | High-Quality Paper (LBKP:NBKP = 1:1, density: 1.080) | | 92.6 |
| Back Surface PE Layer (mat) | High-Density Polyethylene (density: 0.960) | | 36.0 |
| Back Surface Subbing Layer | Gelatin | | 0.05 |
| | Colloidal Silica | | 0.05 |
| | | Total: | 173.8 |

The additive shown in Table 6 above are illustrated below.

Silicone Oil (1)

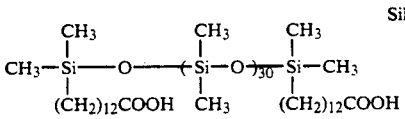

Surface Active Agent (1)

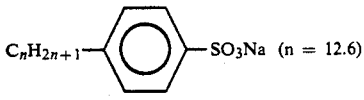

Surface Active Agent (2)

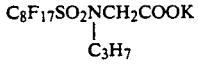

Surface Active Agent (3)

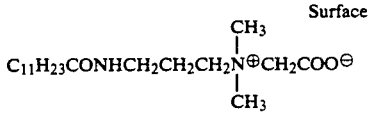

Surface Active Agent (4)

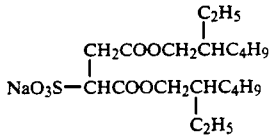

Fluorescent Brightening Agent (1)

2,5-bis(5-tert-Butylbenzoxazolyl-(2))thiophen

Surface Active Agent (5)

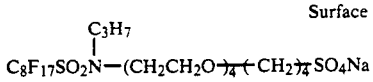

Water-Soluble Polymer (1)

Sumikagel L5-H manufactured by Sumitomo Chemical CO., Ltd.

Water-Soluble Polymer (2)

Dextran (molecular weight: 70,000)

Mordant (1)

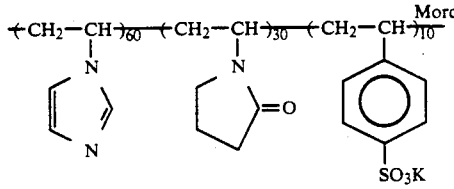

High Boiling Solvent (1)

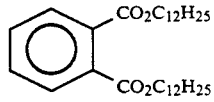

Hardening Agent (1)

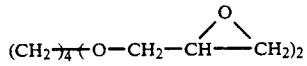

Matting Agent (1)

Silica

Matting Agent (2)

Benzoguanamine resin (average particle size: 15 μm)

Light-Sensitive Materials 802 to 805 were prepared in the same manner as described above for Light-Sensitive Material 801, except for adding a compound according to the present invention as a gelatin dispersion prepared by an oil dispersing method to each of the Second and Fourth Layers of Light-Sensitive Material 801 in an amount of $3\times10^{-5}$ mol/m$^2$ as shown in Table 7 below, respectively.

Light-Sensitive Materials 801 to 805 thus prepared were exposed through a wedge whose density continuously changed at a right angle to the wavelength using a spectrograph.

On the emulsion side surface of the exposed light-sensitive material was supplied water at a rate of 15 ml/m$^2$ by immersing it in warm water at 35° C. for 3 seconds and then the so treated light-sensitive material was superimposed on the image receiving material in such a manner that their coated layers were in contact with each other. These materials were heated for 15 seconds using a heat roller which had been so adjusted that the temperature of the layers absorbing water became 78° C.

Then, the image receiving material was peeled from the light-sensitive material, whereupon a blue, green and red spectrogram corresponding to the wavelength was obtained.

The yellow, magenta and cyan densities of each color were measured using a 310 Model densitometer manufactured by X-rite Co. The results obtained are shown in Table 7 below.

TABLE 7

| | | Light-Sensitive Material | | | | |
|---|---|---|---|---|---|---|
| | | 801 (Comparison) | 802 (Invention) | 803 (Invention) | 804 (Invention) | 805 (Invention) |
| Compound Added to Second and Fourth Layer | | none | I-7 | I-23 | I-25 | I-29 |
| Blue | Yellow | 0.75 | 0.65 | 0.65 | 0.60 | 0.60 |
| Example | Magenta | 2.00 | 2.10 | 2.15 | 2.05 | 2.10 |
| | Cyan | 2.05 | 2.20 | 2.15 | 2.15 | 2.15 |
| Green | Yellow | 1.90 | 2.00 | 2.10 | 2.00 | 2.05 |
| Example | Magenta | 0.70 | 0.65 | 0.60 | 0.60 | 0.55 |
| | Cyan | 2.00 | 2.10 | 2.15 | 2.05 | 2.10 |
| Red | Yellow | 1.90 | 2.00 | 1.95 | 2.00 | 2.00 |
| Example | Magenta | 1.90 | 2.00 | 2.05 | 2.05 | 1.95 |
| | Cyan | 0.40 | 0.35 | 0.35 | 0.30 | 0.30 |

From the results shown in Table 7 above, it can be seen that each of the blue, green and red densities increases and the component of the complementary color decreases, resulting in an increase in color saturation by using a compound according to the present invention. Thus, it can be seen that the compound according to the present invention has the function of improving color reproducibility.

Further, the light-sensitive materials were stored at 30° C. and 70% RH for one month and then subjected to the same processing as described above. As a result, the same results as above were obtained. Thus, this confirmed that the light-sensitive materials containing a compound according to the present invention are stable and their properties are not degraded on storage.

EXAMPLE 9

Cover sheets 901, 902, 903, 904 and 905 were prepared by adding Compounds I-7, I-23, I-25, I-29 and I-32 in an amount of 0.825 mg/m$^2$ to the timing layer of a cover sheet produced as described in Example 1 of JP-A-63-289551, respectively. A light-Sensitive Sheet 102 produced as described in Example 1 of JP-A-63-289551 was superimposed on each of these cover sheets and processed in the same manner as described in Example 1 of JP-A-63-289551. Spreading processing was conducted at a temperature of 10° C., 25° C. or 35° C. As a result, each sample exhibited low dependence on the processing temperature, and good photographic performance with high $D_{max}$ and low $D_{min}$ was obtained.

EXAMPLE 10

A light-sensitive sheet was prepared in the same manner as in the light-sensitive sheet of Example 9 above, except for using an equimolar amount of Compound I-36 according to the present invention in place of the yellow dye releasing redox compound used in the Tenth Layer of the light-sensitive sheet of Example 9.

The resulting light-sensitive sheet was processed at 25° C. in the same manner as described in Example 1 of JP-A-63-289551 in combination with a cover sheet and processing solution prepared as described in Example 1 of JP-A-63-289551.

As a result, it can be seen that the light-sensitive sheet according to the present invention exhibits a high increasing speed of B density and a short time for the completion of the color image formation, resulting in image formation in a short time.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer, wherein the silver halide photographic material contains at least one photographic agent represented by the following formula (I):

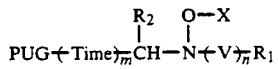

(I)

wherein X represents a hydrogen atom or a group capsule of forming a hydrogen atom upon hydrolysis; Time is selected from the group consisting of

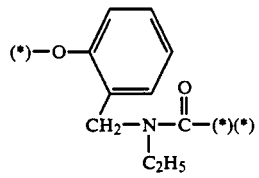

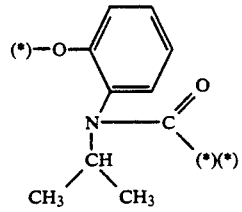

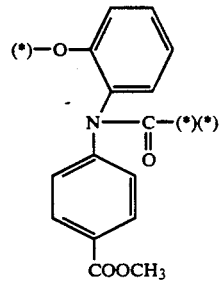

-continued
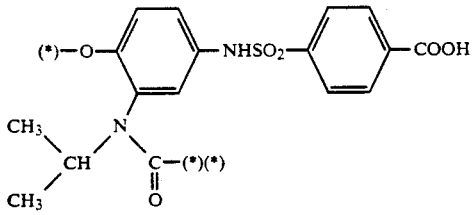
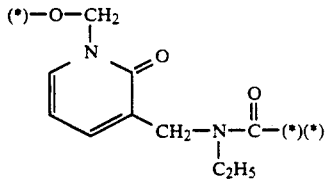
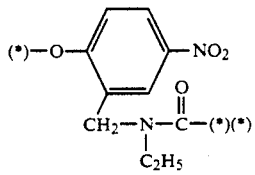
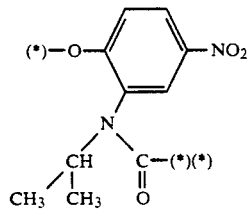
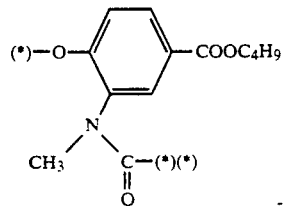
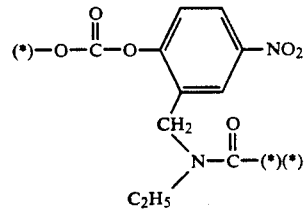
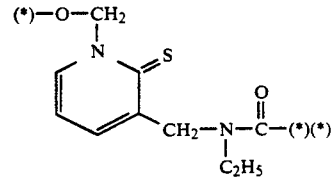
-continued
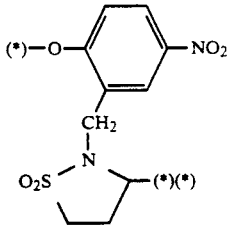
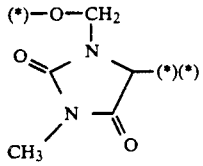
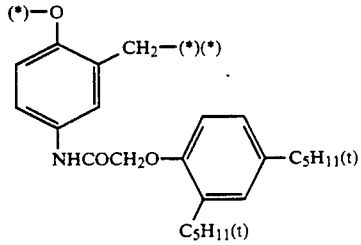
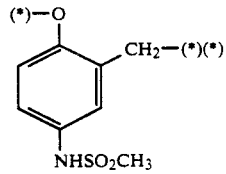
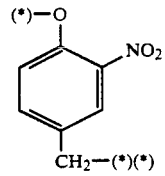
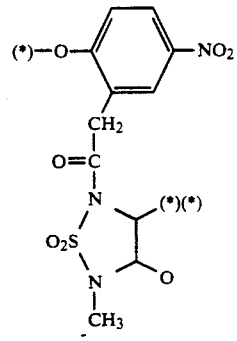
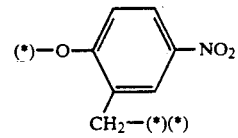

-continued
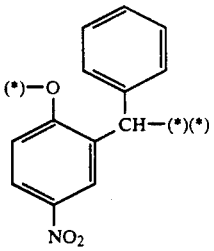
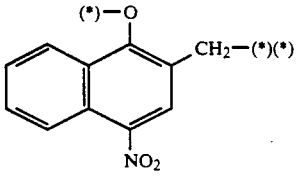
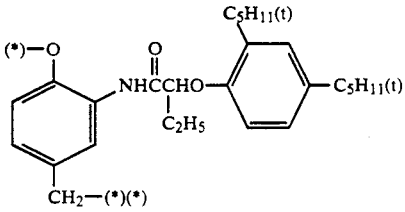
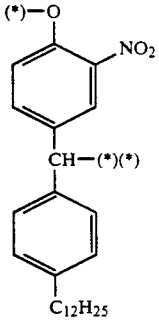
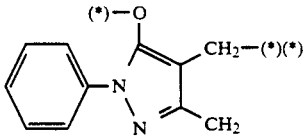
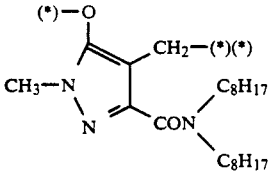
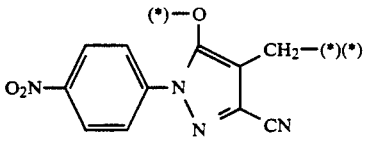
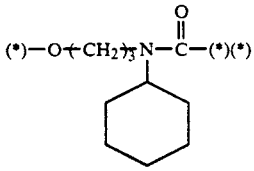
-continued
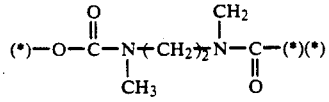
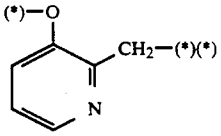
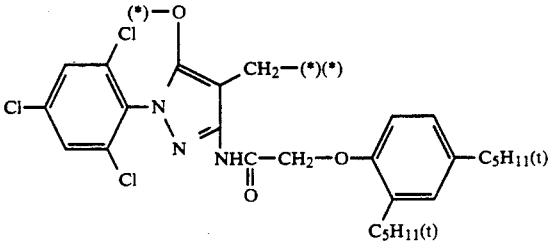
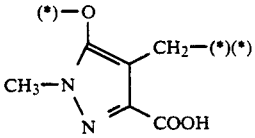
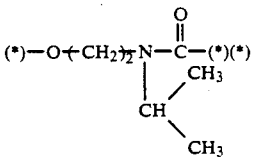
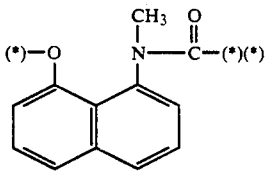
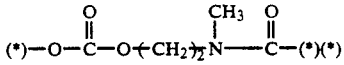
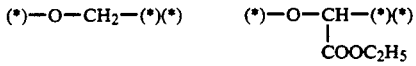
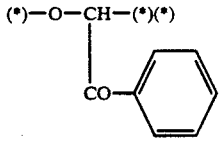
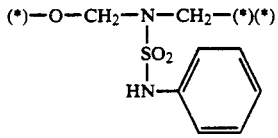

-continued

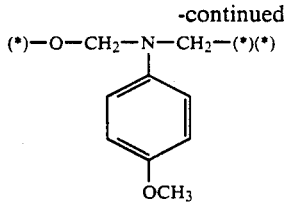

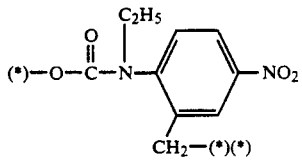

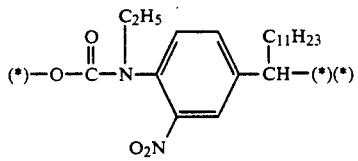

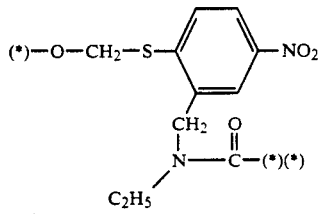

and

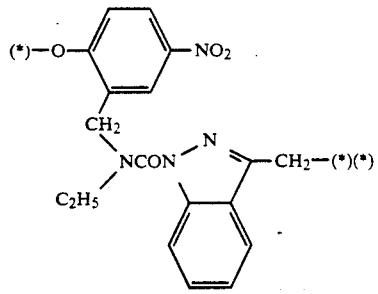

PUG represents a photographically useful group capable of being cleaved upon development; V represents

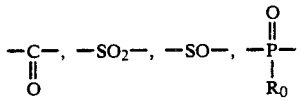

wherein $R_0$ represents an alkoxy group or an aryloxy group,

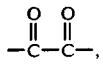

an iminomethylene group or

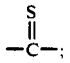

$R_1$ represents a hydrogen atom, an aliphatic group, an aromatic group, a heterocyclic group, an alkoxy group, an aryloxy group, an amino group or —CH-$R_2$-(Time)$_m$PUG; $R_2$ represents a hydrogen atom, an aliphatic group, an aromatic group or a heterocyclic group; m represents 0 or 1; and n represents 0 or 1.

2. A silver halide photographic material as claimed in claim 1, wherein PUG represents a development inhibitor moiety.

3. A silver halide photographic material as claimed in claim 2, wherein the development inhibitor is a mercaptoazole, a mercaptoazaindene, a mercaptopyrimidine, a benzotriazole, an indazole or a benzimidazole.

4. A silver halide photographic material as claimed in claim 2, wherein the of development inhibitor moiety is represented by the following formula (II):

—AF—CCD (II)

wherein AF is represented by one of formulae (P-1) to (P-5), wherein (*)(*)(*) indicates the bonding to Time;

(P-1)

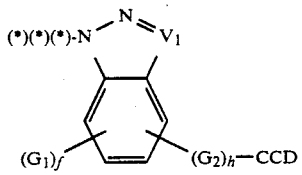

(P-2)

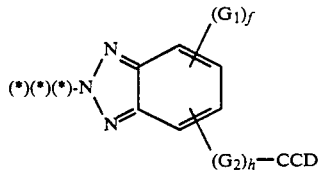

(P-3)

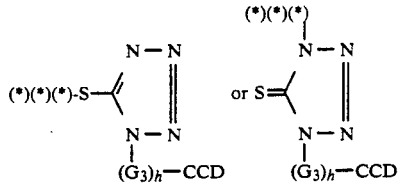

(P-4)

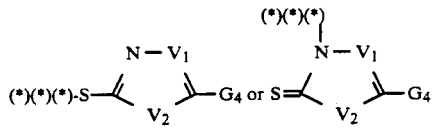

(P-5)

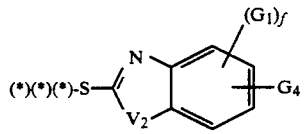

or

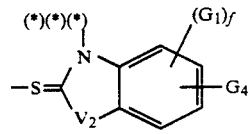

wherein $G_1$ represents a hydrogen atom, a halogen atom, an alkyl group, an acylamino group, an alkoxy group, a sulfonamido group, an aryl group, an alkylthio group, an alkylamino group, an anilino group, an amino group, an alkoxycarbonyl group, an acyloxy group, a nitro group, a cyano group, a sulfonyl group, an aryloxy group, a hydroxy group, a thioamido group, a carbamoyl group, a sulfamoyl group, a carboxy group, a ureido group, or an aryloxycarbonyl group; $G_2$ represents a divalent group selected from the group consisting of an alkyl group, an acylamino group, an alkoxy group, a sulfonamido group, an aryl group, an alkylthio group, an alkylamino group, an anilino group, an amino group, an alkoxycarbonyl group, an acyloxy group, a nitro group, a sulfonyl group, an aryloxy group, a thioamido group, a carbamoyl group, a sulfamoyl group, a carboxyl group, a ureido group, or an aryloxycarbonyl group; $G_3$ represents a substituted or unsubstituted alkylene group or a substituted or unsubstituted arylene group; $V_1$ represents a nitrogen atom or a methine group; $V_2$ represents an oxygen atom, a sulfur atom,

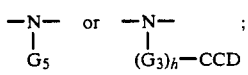

$G_4$ represents a hydrogen atom, a halogen atom, an alkyl group, an acylamino group, an alkoxy group, a sulfonamido group, an aryl group, an alkylthio group, an alkylamino group, an anilino group, an amino group, an alkoxycarbonyl group, an acyloxy group, a nitro group, a cyano group, a sulfonyl group, an aryloxy group, a hydroxyl group, a thioamido group, a carbamoyl group, a sulfamoyl group, a carboxyl group, a ureido group, an aryloxycarbonyl group or $-(G_3)_h-CCD$; $G_5$ represents a hydrogen atom, an alkyl group or an aryl group; f is 1 or 2; and h is 0 or 1; provided that in formulae (P-4) and (P-5) at least one group represented by $V_2$ and $G_4$ is a group containing a —CCD group; and CCD is represented by one of formula (D-1) to (D-16):

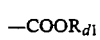

(D-1)

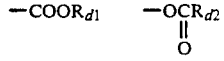

(D-1) (D-2)

wherein $R_{d1}$ and $R_{d2}$ each represents a substituted or unsubstituted alkyl group, a substituted or unsubstituted aryl group or a substituted or unsubstituted aralkyl group;

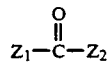

(D-3)

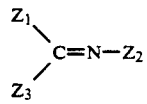

(D-4)

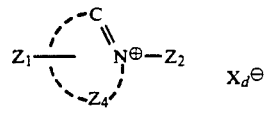

(D-5)

wherein $Z_1$ and $Z_2$ each represents a single bond to AF, a hydrogen atom, an alkylamino group, an alkyl group, an aryl group, an unsubstituted or N-substituted acylamino group, or a 4-membered or 7-membered substituted or unsubstituted heterocyclic group; $Z_3$ represents a hydrogen atom, a halogen atom, an alkyl group, an aryl group, a 4-membered to 7-membered heterocyclic group, an alkoxy group, an acyl group, an N-substituted or unsubstituted carbamoyl group, an N-substituted or unsubstituted sulfamoyl group, a sulfonyl group, an alkoxycarbonyl group, an acylamino group, a sulfonamido group, an alkylthio group, or an N-substituted or unsubstituted ureido group; $Z_4$ represents an atomic group necessary for forming a 5-membered or 6-membered unsaturated heterocyclic ring; $X_d^{\ominus}$ represents an organic sulfonic acid anion; an organic carboxylic acid anion, a halogen ion or an inorganic anion;

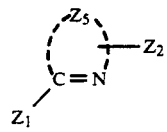

(D-6)

wherein $Z_1$ and $Z_2$ each is as defined in formula (D-3); and $Z_5$ represents an atomic group necessary for forming a non-aromatic 5-membered to 7-membered ring together with

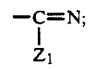

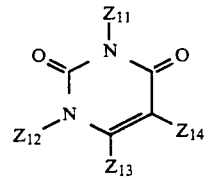

(D-7)

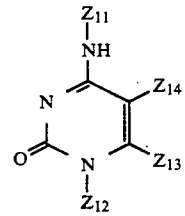

(D-8)

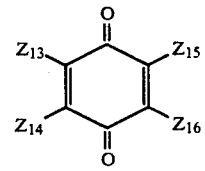

(D-9)

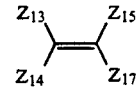

(D-10)

wherein at least one of $Z_{11}$ to $Z_{17}$ represents an AF group or a group containing an AF group; $Z_{11}$ and $Z_{12}$ each represents a hydrogen atom, an alkyl group, an aryl group or an AF group; $Z_{13}$, $Z_{14}$, $Z_{15}$ and $Z_{16}$ each represents a hydrogen atom, an alkyl group, an aryl group, a halogen atom, an alkoxy group, an aryloxy group, an arylthio group, an alkylthio group, an alkoxycarbonyl group, an aryloxycarbonyl group, an alkanesulfonyl group, a sulfamoyl group, a carbamoyl group, a ureido group, an acyl group, an acylamino group, an arylsulfonyl group, a heterocyclic group, an acyloxy group, a nitro group, a cyano group, a carboxy group, a thiocarbamoyl group, a sulfamoylamino group, a diacylamino group, an allylideneamino group or an AF group; and $Z_{17}$ represents a halogen atom, an alkoxycarbonyl group, an aryloxycarbonyl group, an alkanesulfonyl group, a sulfamoyl group, a carbamoyl group, an acyl group, a diacylamino group, an arylsulfonyl group, a heterocyclic group, a nitro group, a cyano group, a carboxyl group or a sulfonamido group;

(D-11)

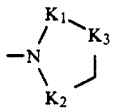

(D-12)

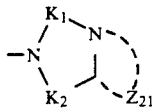

(D-13)

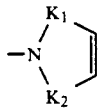

(D-14)

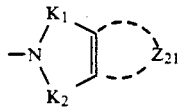

wherein $Z_{21}$ represents an atomic group necessary for forming a saturated or unsaturated 6-membered ring; $K_1$ and $K_2$ each represents an electron withdrawing group; and $K_3$ represents

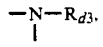

wherein $R_{d3}$ represents an alkyl group;

(D-15)

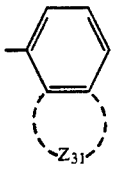

(D-16)

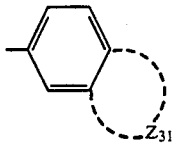

wherein in formulae (P-1) to (P-5), h is 0; and $Z_{31}$ represents an atomic group necessary for forming a 5-membered or 6-membered lactone ring or a 5-membered imidine ring.

5. A silver halide photographic material as claimed in claim 4, wherein in formula (D-5) the heterocyclic group formed by $Z_4$ is a heterocyclic group represented by the formula

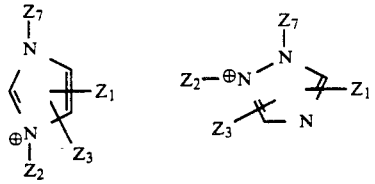

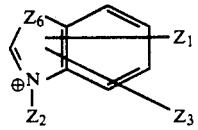

or)

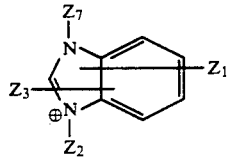

wherein $Z_1$, $Z_2$ and $Z_3$ are each as defined in formula (D-4), $Z_6$ represents an oxygen atom or a sulfur atom; and $Z_7$ represents a single bond to AF, a hydrogen atom, an alkylamino group, an alkyl group, an aryl group, an N-substituted or unsubstituted acylamino group, or a 4-membered to 7-membered substituted or unsubstituted heterocyclic group; and $Z_5$ in formula (D-6) comprises at least one group selected from the group consisting of a substituted or unsubstituted alkylene group, and a substituted or unsubstituted alkenylene group.

6. A silver halide photographic material as claimed in claim 1, wherein PUG represents a diffusible or non-diffusible dye.

7. A silver halide photographic material as claimed in claim 1, wherein PUG represents a development accelerator represented by the following formula (III):

$$(*)(*)(*)-L_1-(L_2)_kA \qquad \text{(III)}$$

wherein (*)(*)(*) indicates the bonding to Time, $L_1$ represents a group capable of being released from Time upon development; $L_2$ represents a divalent linking group; k is 0 or 1; and A represents a group capable of fogging a silver halide emulsion in a developing solution.

8. A silver halide photographic material as claimed in claim 7, wherein $L_1$ represents an aryloxy group, a heterocyclic oxy group, an arylthio group, an alkylthio group, a heterocyclic thio group, or an azolyl group; $L_2$ represents an alkylene group, an alkenylene group, an arylene group, a divalent heterocyclic group, —O—, —S—, an imino group, —COO—, —CONH—, —NHCONH—, —NHCOO—, —$SO_2$NH—, —CO—, —$SO_2$—, —SO—, —NH$SO_2$NH—, or a combination thereof; and A represents a reducing group, a group capable of forming a developable silver sulfide nucleus on silver halide during development; or a quaternary salt.

9. A silver halide photographic material as claimed in claim 8, wherein A is represented by the following formula (IV):

$$\left(L_{00}\right)_l \underset{A_1}{N}-\underset{A_2}{N}-G-R_{00} \quad \text{(IV)}$$

wherein at least one of $A_1$ and $A_2$ represents a hydrogen atom, and the other represents a hydrogen atom, a sulfinic acid group or $$\left(\underset{\underset{O}{\|}}{C}\right)_n R^1{}_{00}$$

wherein $R^1{}_{00}$ represents an alkyl group, an alkenyl group, an aryl group, an alkoxy group or an aryloxy group, and n is 1 or 2; $R_{00}$ represents a hydrogen atom, an alkyl group, an aryl group, an alkoxy group, an aryloxy group, an amino group, an alkoxycarbonyl group, an aryloxycarbonyl group, a carbamoyl group, an azo group or a heterocyclic group; G represents a carbonyl group, a sulfonyl group, a sulfoxy group, an iminomethylene group, or $$-\overset{\overset{O}{\|}}{\underset{\underset{R^2{}_{00}}{|}}{P}}-$$

wherein $R^2{}_{00}$ represents an alkoxy group or an aryloxy group; $L_{00}$ represents an arylene group or a divalent heterocyclic group; and l is 0 or 1.

10. A silver halide photographic material as claimed in claim 1, wherein PUG represents a silver halide solvent.

11. A silver halide photographic material as claimed in claim 1, wherein in formula (I), V represents a carbonyl group.

12. A silver halide photographic material as claimed in claim 1, wherein $R_1$ in formula (I) represents a hydrogen atom, an alkyl group or an aryl group.

13. A silver halide photographic material as claimed in claim 12, wherein $R_1$ represents a hydrogen atom.

14. A silver halide photographic material as claimed in claim 1, wherein the compound represented by formula (I) is present in an amount of from $1\times10^{-7}$ to $1\times10^{-3}$ mol per mol of silver halide in the silver halide emulsion layer.

15. A silver halide photographic material as claimed in claim 2, wherein the compound represented by formula (I) is present in an amount of from $1\times10^{-7}$ to $1\times10^{-1}$ mol per mol of silver halide in the silver halide emulsion layer.

16. A silver halide photographic material as claimed in claim 1, wherein PUG represents a development accelerator, and the compound represented by formula (I) is present in an amount of from $1\times10^{-7}$ to $1\times10^{-1}$ mol per mol of silver halide in the silver halide emulsion layer.

17. A silver halide photographic material as claimed in claim 1, wherein PUG represents an image forming dye, and the compound represented by formula (I) is present in an amount of from $1\times10^{-3}$ to 10 mol per mol of silver halide in the silver halide emulsion layer.

18. A silver halide photographic material as claimed in claim 2, wherein the photographic material further contains a hydrazine derivative represented by the following formula (V):

$$R_{31}-\underset{A_1}{N}-\underset{A_2}{N}-G_1-R_{32} \quad \text{(V)}$$

wherein $R_{31}$ represents an aliphatic group or an aromatic group; $R_{32}$ represents a hydrogen atom, an alkyl group, an aryl group, an alkoxyl group, an aryloxy group, an amino group, a carbamoyl group, or an oxycarbonyl group; $G_1$ represents a $$-\overset{\overset{O}{\|}}{C}-$$

group, a $-SO_2-$ group, a $-SO-$ group, a $$-\overset{\overset{O}{\|}}{\underset{\underset{R_{32}}{|}}{P}}-$$

group, wherein $R_{32}$ is as defined above, a $$-\overset{\overset{O}{\|}}{C}-\overset{\overset{O}{\|}}{C}-$$

a group, a thiocarbonyl group, or an iminomethylene group; $A_1$ and $A_2$ each represents a hydrogen atom, or one of $A_1$ and $A_2$ represents a hydrogen atom, and the other represents a substituted or unsubstituted alkylsulfonyl group, a substituted or unsubstituted arylsulfonyl group, or a substituted or unsubstituted acyl group.

19. A silver halide photographic material as claimed in claim 18, wherein $R_{31}$ represents an aryl group.

20. A silver halide photographic material as claimed in claim 18, wherein $G_1$ represents a carbonyl group.

21. A silver halide photographic material as claimed in claim 20, wherein $R_{32}$ represents a hydrogen atom, an alkyl group, an aralkyl group, or an aryl group.

22. A silver halide photographic material as claimed in claim 18, wherein $R_{32}$ represents a group represented by the following formula (a):

$$-R_{33}-Z_{31} \quad \text{(a)}$$

wherein $Z_{31}$ represents a group which nucleophilically attacks $G_1$ to split the $G_1-R_{33}-Z_{31}$ moiety from the remainder; $R_{33}$ represents a group derived by removal of one hydrogen atom from $R_{32}$; and $R_{33}$ and $Z_{31}$ form a cyclic structure together with $G_1$ upon nucleophilic attack of $Z_{31}$ on $G_1$.

23. A silver halide photographic material as claimed in claim 22, wherein the group represented by formula (a) is a group represented by the following formula (b) or (c):

$$\begin{array}{l} \left(CR_b{}^1R_b{}^2\right)_m C \\ \qquad\qquad \| \\ Z_{31}\left(CR_b{}^3R_b{}^4\right)_n C \end{array} \quad \text{(b)}$$

wherein $Z_{31}$ is as defined above; $R_b{}^1$, $R_b{}^2$, $R_b{}^3$, and $R_b{}^4$, which may be the same or different, each represents a hydrogen atom, an alkyl group, an alkenyl group, or an aryl group; B represents an atomic group necessary to form a substituted or unsubstituted 5-membered or 6-membered ring; m and n each represents 0 or 1; and (n+m) is 1 or 2;

$$-(N)_p-(CR_c^1R_c^2)_q-Z_{31} \quad (c)$$

wherein $Z_{31}$ is as defined above; $R_c^1$ and $R_c^2$, which may be the same or different, each represents a hydrogen atom, an alkyl group, an alkenyl group, an aryl group, or a halogen atom; $R_c^3$ represents a hydrogen atom, an alkyl group, an alkenyl group, or an aryl group; p represents 0 or 1; q represents an integer of from 1 to 4; $R_c^1$, $R_c^2$, and $R_c^3$ may combine and form a ring so long as $Z_{31}$ remains capable of intramolecular nucleophilic attack on $G_1$.

24. A silver halide photographic material as claimed in claim 18, wherein $A_1$ and $A_2$ each represents a hydrogen atom.

25. A silver halide photographic material as claimed in claim 18, wherein an amount of the hydrazine derivative is from $1\times10^{-6}$ to $5\times10^{-2}$ mol per mol of silver halide.

* * * * *